US007688222B2

(12) United States Patent
Peddie et al.

(10) Patent No.: US 7,688,222 B2
(45) Date of Patent: Mar. 30, 2010

(54) METHODS, SYSTEMS AND DEVICES RELATED TO ROAD MOUNTED INDICATORS FOR PROVIDING VISUAL INDICATIONS TO APPROACHING TRAFFIC

(75) Inventors: Timm Peddie, Capitola, CA (US); David P. Bim-Merle, Palo Alto, CA (US); Thomas A. Burnham, San Jose, CA (US); Daniel O. Santos, Palo Alto, CA (US); Lawrence E. Miller, Burlingame, CA (US); Vineet Mehta, Sunnyvale, CA (US); Johannes B. Van Niekerk, Redwood City, CA (US)

(73) Assignee: Spot Devices, Inc., Sparks, NV (US)

( * ) Notice: Subject to any disclaimer, the term of this patent is extended or adjusted under 35 U.S.C. 154(b) by 313 days.

(21) Appl. No.: 11/055,558

(22) Filed: Feb. 10, 2005

(65) Prior Publication Data

US 2005/0270175 A1 Dec. 8, 2005

Related U.S. Application Data

(60) Provisional application No. 60/544,138, filed on Feb. 13, 2004.

(51) Int. Cl.
*G08G 1/09* (2006.01)

(52) U.S. Cl. ..... 340/905; 340/901; 340/906; 340/907; 340/937; 340/539.1; 340/539.25; 340/332; 340/333; 116/63 P

(58) Field of Classification Search ..... 340/908, 340/910, 916, 917, 905, 901, 906, 907, 937, 340/539.1, 539.25, 332, 333; 116/1, 63 P, 116/63

See application file for complete search history.

(56) References Cited

U.S. PATENT DOCUMENTS

| | | | | |
|---|---|---|---|---|
| 1,572,214 | A | 2/1926 | McEwing et al. | |
| 1,708,108 | A | 4/1929 | Rolph | |
| 1,952,942 | A | 3/1934 | Ross | 88/1 |
| 2,126,224 | A | 8/1938 | Shaffer et al. | 88/79 |
| 2,246,098 | A | 6/1941 | Jaeckel | 240/106.1 |
| 2,260,498 | A | 10/1941 | Wise | 88/79 |
| 2,308,525 | A | 1/1943 | Lowe | 40/125 |
| 3,096,024 | A | 7/1963 | Young | 240/1.2 |

(Continued)

FOREIGN PATENT DOCUMENTS

EP 0 578 413 A1 1/1994

(Continued)

*Primary Examiner*—Daryl Pope
(74) *Attorney, Agent, or Firm*—Alston & Bird LLP

(57) ABSTRACT

A traffic informational system provides information to traffic moving along a road and may include a plurality of traffic information devices mountable to the road, each having an integral power producing source, at least a first set of illumination sources, and a wireless communications subsystem. The traffic informational system may further include at least a first external control device comprising at least one antenna and a transmitter communication wirelessly with the traffic information devices and/or with one another. The traffic information device may communicate with one another, and may include sensor for sensing ambient conditions. The system employs various approaches to reducing power consumption and improving communications, and is suitable for a wide range of applications, including use in remote environments.

29 Claims, 34 Drawing Sheets

U.S. PATENT DOCUMENTS

| | | | | |
|---|---|---|---|---|
| 3,257,552 | A | 6/1966 | Converso | 240/1.2 |
| 3,302,168 | A | 1/1967 | Gray et al. | 340/31 |
| 3,697,738 | A | 10/1972 | Decker et al. | 240/10.6 |
| 3,732,842 | A | 5/1973 | Vara, Sr. | 116/63 P |
| 3,754,210 | A | 8/1973 | Preti | 340/40 |
| 3,783,446 | A | 1/1974 | McGimpsey | 340/31 R |
| 3,818,439 | A | 6/1974 | Maine | 340/81 R |
| 3,836,275 | A | 9/1974 | Finch | 404/13 |
| 3,904,920 | A | 9/1975 | Griffith | 315/78 |
| 3,920,981 | A | 11/1975 | Bailey | 240/22 |
| 3,963,362 | A | 6/1976 | Hollis | 404/10 |
| 3,996,556 | A | 12/1976 | Eigenmann | 340/117 |
| 4,001,778 | A | 1/1977 | Ross | 340/114 B |
| 4,049,358 | A | 9/1977 | King et al. | 404/11 |
| 4,050,834 | A | 9/1977 | Lee | 404/16 |
| 4,058,751 | A | 11/1977 | Brooks | 315/200 A |
| 4,070,095 | A | 1/1978 | Suhr | 350/103 |
| 4,130,370 | A | 12/1978 | Kone | 404/11 |
| 4,174,184 | A | 11/1979 | Heenan | 404/72 |
| 4,203,091 | A | 5/1980 | Kruskopf | 340/331 |
| 4,234,264 | A | 11/1980 | Baldi | 404/11 |
| 4,234,265 | A | 11/1980 | Otis | 404/16 |
| 4,253,083 | A | 2/1981 | Imamura | 340/44 |
| 4,292,627 | A | 9/1981 | Knight | 340/114 R |
| 4,293,841 | A | 10/1981 | Potter | 340/44 |
| 4,297,051 | A | 10/1981 | Robinson | 404/11 |
| 4,309,741 | A | 1/1982 | Smith | 362/72 |
| 4,314,198 | A | 2/1982 | Rogers | 323/351 |
| 4,358,217 | A | 11/1982 | Stone | 404/16 |
| 4,382,274 | A | 5/1983 | De Backer et al. | 362/153 |
| 4,394,715 | A | 7/1983 | Dahlberg | 362/153 |
| 4,413,923 | A | 11/1983 | Wright | 404/11 |
| 4,447,802 | A | 5/1984 | Böse | 340/119 |
| 4,475,101 | A | 10/1984 | Kulp et al. | 340/114 R |
| D277,739 | S | 2/1985 | Grammas et al. | D10/109 |
| 4,516,109 | A | 5/1985 | Thurston | 340/114 B |
| 4,563,668 | A | 1/1986 | Martino | 340/114 R |
| 4,570,207 | A | 2/1986 | Takahashi et al. | 362/152 |
| 4,590,455 | A | 5/1986 | Fritzinger | 340/907 |
| 4,595,312 | A | 6/1986 | Corless | 404/11 |
| 4,668,120 | A | 5/1987 | Roberts | 404/12 |
| 4,680,717 | A | 7/1987 | Martin | 364/436 |
| 4,685,824 | A | 8/1987 | Eigenmann | 404/9 |
| 4,697,950 | A | 10/1987 | Copeland | 404/9 |
| 4,710,053 | A | 12/1987 | Kulp et al. | 404/9 |
| 4,718,185 | A | 1/1988 | Conlin et al. | 40/442 |
| 4,727,371 | A | 2/1988 | Wulkowicz | 340/917 |
| 4,739,302 | A | 4/1988 | Kinard | 340/114 B |
| 4,750,129 | A | 6/1988 | Hengstmengel et al. | 364/436 |
| 4,751,622 | A | 6/1988 | Williams | 362/183 |
| 4,772,990 | A | 9/1988 | Linehan et al. | 362/183 |
| 4,841,278 | A | 6/1989 | Tezuka et al. | 340/908.1 |
| 4,843,337 | A | 6/1989 | Conn, Jr. et al. | 340/906 |
| 4,843,525 | A | 6/1989 | Williams | 362/157 |
| 4,848,958 | A | 7/1989 | Sheldon | 404/11 |
| 4,851,836 | A | 7/1989 | Wilkinson et al. | 340/944 |
| 4,854,768 | A | 8/1989 | Flanagan et al. | 404/11 |
| 4,857,885 | A | 8/1989 | Umerez | 340/321 |
| 4,864,299 | A | 9/1989 | Kuhl | 340/908.1 |
| 4,875,799 | A | 10/1989 | Harrison | 404/12 |
| 4,884,017 | A | 11/1989 | Williams | 320/2 |
| 4,893,903 | A | 1/1990 | Thakar et al. | 350/331 R |
| 4,904,998 | A | 2/1990 | Niimi | 340/908.1 |
| 4,907,361 | A | 3/1990 | Villard | 40/565 |
| 4,908,615 | A | 3/1990 | Bayraktaroglu | 340/917 |
| 4,914,435 | A | 4/1990 | Gould et al. | 340/144 |
| 4,914,544 | A | 4/1990 | Dahlberg | 362/153.1 |
| 4,916,594 | A | 4/1990 | Headley | 362/108 |
| 4,925,335 | A | 5/1990 | Eigenmann | 404/12 |
| 4,929,942 | A | 5/1990 | Niimi | 340/908.1 |
| 4,934,862 | A | 6/1990 | Gartlacher | 404/14 |
| 4,993,868 | A | 2/1991 | Eigenmann | 404/12 |
| 5,006,010 | A | 4/1991 | Duckett | 404/12 |
| 5,013,181 | A | 5/1991 | Harrison | 404/12 |
| 5,030,029 | A | 7/1991 | Johnsen | 404/6 |
| 5,032,961 | A | 7/1991 | Pouyanne et al. | 362/251 |
| 5,074,706 | A | 12/1991 | Paulos | 404/12 |
| 5,092,705 | A | 3/1992 | Raswant | 404/1 |
| 5,103,205 | A | 4/1992 | Halligan | 340/473 |
| 5,105,347 | A | 4/1992 | Ruud et al. | 362/268 |
| 5,109,224 | A | 4/1992 | Lundberg | 340/907 |
| 5,152,601 | A | 10/1992 | Ferng | 362/183 |
| 5,173,692 | A | 12/1992 | Shapiro et al. | 340/943 |
| 5,175,528 | A | 12/1992 | Choi et al. | 340/331 |
| 5,203,624 | A | 4/1993 | Schier et al. | 362/158 |
| 5,225,003 | A | 7/1993 | Ming-Che | 136/206 |
| 5,240,344 | A | 8/1993 | Green | 404/14 |
| 5,241,307 | A | 8/1993 | Bidault et al. | 340/944 |
| 5,252,893 | A | 10/1993 | Chacham et al. | 315/200 A |
| 5,252,969 | A | 10/1993 | Kishi | 340/908 |
| 5,253,150 | A | 10/1993 | Vanni | 362/183 |
| 5,257,020 | A | 10/1993 | Morse | 340/908.1 |
| 5,257,194 | A | 10/1993 | Sakita et al. | 364/436 |
| 5,262,756 | A | 11/1993 | Chien | 340/332 |
| 5,265,556 | A | 11/1993 | Hall | 116/63 P |
| 5,276,424 | A | 1/1994 | Hegemann | 340/321 |
| 5,278,554 | A | 1/1994 | Marton | 340/910 |
| 5,280,220 | A | 1/1994 | Carter | 315/152 |
| 5,294,924 | A | 3/1994 | Dydzyk | 340/908.1 |
| 5,310,278 | A | 5/1994 | Kaczmarczik et al. | 404/14 |
| 5,313,187 | A | 5/1994 | Choi et al. | 340/331 |
| 5,313,188 | A | 5/1994 | Choi et al. | 340/331 |
| 5,319,365 | A | 6/1994 | Hillinger | 340/908.1 |
| 5,335,151 | A | 8/1994 | Dahlberg | 362/153.1 |
| 5,342,140 | A | 8/1994 | Glass | 404/9 |
| 5,343,374 | A | 8/1994 | Gordin et al. | 362/153.1 |
| 5,343,375 | A | 8/1994 | Gross et al. | 362/248 |
| 5,389,921 | A | 2/1995 | Whitton et al. | 340/933 |
| 5,390,090 | A | 2/1995 | Nau | 362/153 |
| 5,402,327 | A | 3/1995 | Gordin et al. | 362/298 |
| 5,406,276 | A | 4/1995 | Ogle | 340/944 |
| 5,412,381 | A | 5/1995 | Dicks | 340/908.1 |
| 5,414,603 | A | 5/1995 | Conway | 362/153.1 |
| 5,438,495 | A | 8/1995 | Åhlen et al. | 362/153.1 |
| 5,448,219 | A | 9/1995 | Yoshikawa et al. | 340/436 |
| 5,449,244 | A | 9/1995 | Sandino | 404/14 |
| 5,453,663 | A | 9/1995 | Nakayama | 315/159 |
| 5,454,664 | A | 10/1995 | Siblik | 404/14 |
| 5,457,449 | A | 10/1995 | Kuning et al. | 340/908 |
| 5,469,157 | A | 11/1995 | Carpenter et al. | 340/908.1 |
| 5,490,045 | A | 2/1996 | Lindner | 362/35 |
| 5,501,545 | A | 3/1996 | Walter | 404/14 |
| 5,502,593 | A | 3/1996 | Hedgewick | 359/547 |
| 5,521,595 | A | 5/1996 | Totten et al. | 340/908 |
| 5,523,929 | A | 6/1996 | Ogihara | 362/183 |
| 5,559,509 | A | 9/1996 | Ogle | 340/944 |
| 5,572,202 | A | 11/1996 | Regel et al. | 340/917 |
| 5,577,824 | A | 11/1996 | Wright | 340/908.1 |
| 5,585,783 | A | 12/1996 | Hall | 340/473 |
| 5,594,433 | A | 1/1997 | Terlep | 340/908.1 |
| 5,606,309 | A | 2/1997 | Smith | 340/473 |
| 5,610,599 | A | 3/1997 | Nomura et al. | 340/931 |
| 5,617,086 | A | 4/1997 | Klashinsky et al. | 340/907 |
| 5,633,629 | A | 5/1997 | Hochstein | 340/907 |
| 5,648,904 | A | 7/1997 | Scott | 364/436 |
| 5,654,705 | A | 8/1997 | Houten et al. | 340/944 |
| 5,660,453 | A | 8/1997 | Lewis | 362/32 |
| 5,663,628 | A | 9/1997 | Fujii | 320/1 |
| 5,664,874 | A | 9/1997 | Winterer | 362/191 |
| 5,680,033 | A | 10/1997 | Cha | 320/61 |
| 5,680,121 | A | 10/1997 | Shiozaki et al. | 340/908.1 |
| 5,681,105 | A | 10/1997 | Nau | 362/153 |
| 5,703,719 | A | 12/1997 | Chen | 359/547 |
| 5,710,560 | A | 1/1998 | Cohn | 340/982 |

5,729,214 A 3/1998 Moore ..... 340/905
5,729,215 A 3/1998 Jutras ..... 340/908.1
5,734,339 A 3/1998 Ogle ..... 340/944
5,751,226 A 5/1998 Hretsina ..... 340/947
5,751,227 A 5/1998 Yoshida et al. ..... 340/928
5,754,124 A 5/1998 Daggett et al. ..... 340/908.1
5,765,122 A 6/1998 Nagai et al. ..... 701/208
5,777,564 A 7/1998 Jones ..... 340/917
5,782,552 A 7/1998 Green et al. ..... 362/183
5,785,410 A 7/1998 Branson, Sr. ..... 362/153.1
5,801,646 A 9/1998 Pena ..... 340/902
5,825,544 A 10/1998 Poisson ..... 359/551
5,839,816 A 11/1998 Varga et al. ..... 362/153.1
5,869,934 A 2/1999 Goff ..... 315/200 A
5,890,794 A 4/1999 Abtahi et al. ..... 362/294
5,892,445 A 4/1999 Tomich ..... 340/573
5,898,389 A 4/1999 Deese et al. ..... 340/907
5,900,826 A 5/1999 Farber ..... 340/908
5,906,425 A 5/1999 Gordin et al. ..... 362/153.1
5,908,263 A 6/1999 Conners et al. ..... 404/9
5,917,432 A 6/1999 Rathbone ..... 340/907
5,933,095 A 8/1999 Junker ..... 340/908
5,951,144 A 9/1999 Gavigan et al. ..... 362/153
5,952,940 A 9/1999 Matsumoto ..... 340/905
5,957,617 A 9/1999 Delamere ..... 404/11
5,959,553 A 9/1999 Raswant ..... 340/907
5,959,554 A 9/1999 Armstrong et al. ..... 340/908
5,984,570 A 11/1999 Parashar ..... 404/14
5,997,156 A 12/1999 Perlo et al. ..... 362/328
6,005,491 A 12/1999 Kopchak et al. ..... 340/907
6,008,741 A 12/1999 Shinagawa et al. ..... 340/907
6,014,941 A 1/2000 Bent et al. ..... 116/63 R
6,027,280 A 2/2000 Conners et al. ..... 404/19
6,052,067 A 4/2000 Nuxoll ..... 340/908
6,072,391 A 6/2000 Suzuki et al. ..... 340/468
6,082,886 A 7/2000 Stanford ..... 362/576
6,092,909 A 7/2000 Sools et al. ..... 362/153.1
6,104,313 A 8/2000 Boyd, II ..... 340/908.1
6,106,134 A 8/2000 Bomas ..... 362/153.1
6,107,941 A 8/2000 Jones ..... 340/915
6,119,065 A 9/2000 Shimada et al. ..... 701/201
6,123,441 A 9/2000 Kasboske ..... 362/543
RE36,930 E 10/2000 Houten et al. ..... 340/944
6,127,943 A 10/2000 Tauchi et al. ..... 340/944
6,150,957 A 11/2000 Henz et al. ..... 340/908
6,164,782 A 12/2000 Pojar ..... 359/528
6,172,617 B1 1/2001 Bullock ..... 340/909
6,202,587 B1 3/2001 Stewart ..... 116/205
6,204,778 B1 3/2001 Bergan et al. ..... 340/936
D439,856 S 4/2001 Knowlton ..... D10/109
6,210,017 B1 4/2001 Miura et al. ..... 362/153.1
6,224,240 B1 5/2001 Shimizu et al. ..... 362/260
6,224,290 B1 5/2001 Lavis ..... 404/6
6,226,389 B1 5/2001 Lemelson et al. ..... 382/104
6,259,375 B1 7/2001 Andras ..... 340/907
6,259,990 B1 7/2001 Shojima et al. ..... 701/209
6,262,657 B1 7/2001 Okuda et al. ..... 340/439
6,288,651 B1 9/2001 Souza ..... 340/933
6,305,818 B1 10/2001 Lebens et al. ..... 362/184
6,305,874 B1 10/2001 Custers et al. ..... 404/9
6,307,484 B1 10/2001 Sasaki et al. ..... 340/903
6,317,058 B1 11/2001 Lemelson et al. ..... 340/910
6,320,515 B1 11/2001 Olsson ..... 340/905
6,323,781 B1 11/2001 Hutchison ..... 340/815.4
6,334,695 B1 1/2002 Abe et al. ..... 362/153.1
6,337,637 B1 1/2002 Kubota et al. ..... 340/901
6,339,383 B1 1/2002 Kobayashi et al. ..... 340/907
6,341,255 B1 1/2002 Lapidot ..... 701/209
6,354,714 B1 3/2002 Rhodes ..... 362/153.1
6,366,214 B1 4/2002 Mitchell et al. ..... 340/815.45
6,366,219 B1 4/2002 Hoummady ..... 340/907
6,384,742 B1 5/2002 Harrison ..... 340/944
6,398,399 B1 6/2002 Neophytou ..... 362/576
6,418,374 B2 7/2002 Sakamoto et al. ..... 701/209
6,419,376 B1 7/2002 Friebolin ..... 362/335
6,422,714 B1 7/2002 Hubbell ..... 362/84
6,427,113 B1 7/2002 Rahman ..... 701/117
6,429,790 B1 8/2002 Frese et al. ..... 340/905
6,448,905 B1 9/2002 Jones ..... 340/907
6,459,218 B2 * 10/2002 Boys et al. ..... 315/324
6,459,384 B1 10/2002 Wahlin ..... 340/907
6,459,403 B1 10/2002 Nakahara et al. ..... 342/52
6,473,002 B1 10/2002 Hutchison ..... 340/944
6,499,858 B2 12/2002 Hart ..... 362/183
6,522,263 B2 2/2003 Jones ..... 340/915
6,525,656 B1 2/2003 Hahn ..... 340/463
6,549,121 B2 4/2003 Povey et al. ..... 340/322
6,556,147 B1 4/2003 Fisher et al. ..... 340/908
6,558,011 B2 5/2003 Fritz ..... 359/552
6,559,774 B2 5/2003 Bergan et al. ..... 340/908
6,568,827 B2 5/2003 Forster ..... 362/153.1
6,579,035 B1 6/2003 Watson ..... 404/14
6,580,374 B2 6/2003 Schrage ..... 340/933
6,592,245 B1 7/2003 Tribelsky et al. ..... 362/551
6,597,293 B1 7/2003 Harrison ..... 340/944
6,602,021 B1 * 8/2003 Kim ..... 404/16
6,608,554 B2 8/2003 Lesesky et al. ..... 340/431
6,617,981 B2 9/2003 Basinger ..... 340/909
6,621,177 B2 9/2003 Westcott ..... 307/10.1
6,624,782 B2 9/2003 Jocoy et al. ..... 342/70
6,624,845 B2 * 9/2003 Loyd et al. ..... 348/151
6,633,238 B2 * 10/2003 Lemelson et al. ..... 340/909
6,637,973 B1 10/2003 Kim ..... 404/9
6,641,283 B1 11/2003 Bohler ..... 362/238
6,654,399 B1 11/2003 Kimura et al. ..... 372/50
6,655,814 B1 12/2003 Tagawa et al. ..... 362/183
6,662,099 B2 12/2003 Knaian et al. ..... 701/117
6,683,540 B1 1/2004 Harrison ..... 340/944
6,707,391 B1 3/2004 Monroe ..... 340/901
6,707,393 B1 3/2004 Moore ..... 340/907
6,714,140 B2 3/2004 Eguiluz Fernandez ..... 340/908
6,739,735 B2 5/2004 Talamo et al. ..... 362/249
6,752,519 B2 6/2004 Seland et al. ..... 362/339
6,753,762 B1 6/2004 Jorba Gonzalez ..... 340/333
6,784,357 B1 8/2004 Wang ..... 136/244
6,789,915 B2 9/2004 Van Der Poel et al. ... 362/153.1
6,801,638 B1 10/2004 Janssen et al. ..... 382/104
6,808,287 B2 10/2004 Lebens et al. ..... 362/184
6,809,654 B2 10/2004 Hudson ..... 340/907
6,813,370 B1 11/2004 Arai ..... 382/104
6,836,222 B1 12/2004 Carini ..... 340/908.1
6,839,001 B1 1/2005 Bonin ..... 340/908
6,850,171 B2 2/2005 Mathias ..... 340/907
6,861,959 B1 3/2005 Torres Sabate et al. ..... 340/944
7,023,361 B1 * 4/2006 Wallace et al. ..... 340/952
7,095,337 B2 * 8/2006 Sudou et al. ..... 340/905
2001/0021894 A1 9/2001 Sakamoto et al. ..... 701/209
2001/0054970 A1 12/2001 Jones ..... 340/915
2001/0055206 A1 12/2001 Liao et al. ..... 362/183
2002/0008637 A1 1/2002 Lemelson et al. ..... 340/907
2002/0008973 A1 * 1/2002 Boys et al. ..... 362/307
2002/0012244 A1 1/2002 Van Der Poel et al. ... 362/153.1
2002/0036584 A1 3/2002 Jocoy et al. ..... 342/70
2002/0044444 A1 4/2002 Forster ..... 362/153.1
2002/0060625 A1 5/2002 Lesesky et al. ..... 340/431
2002/0063960 A1 5/2002 Fritz ..... 359/515
2002/0097166 A1 7/2002 Eguiluz Fernandez ..... 340/907
2002/0101360 A1 8/2002 Schrage ..... 340/901
2002/0145540 A1 10/2002 Westcott ..... 340/907
2002/0159245 A1 10/2002 Murasko et al. ..... 362/84
2002/0159251 A1 10/2002 Hart ..... 362/183
2002/0175829 A1 11/2002 Dunagin et al. ..... 340/905
2002/0175830 A1 11/2002 Hudson ..... 340/907
2002/0175831 A1 11/2002 Bergan et al. ..... 340/908.1
2002/0176248 A1 11/2002 Wismeth et al. ..... 362/159
2002/0177942 A1 11/2002 Knaian et al. ..... 701/117

2002/0186147 A1 12/2002 Basinger ..... 340/910
2003/0025607 A1 2/2003 Povey et al. ..... 340/815.45
2003/0048201 A1 3/2003 Weiss et al. ..... 340/929
2003/0053307 A1 3/2003 Talamo et al. ..... 362/153.1
2003/0063016 A1 4/2003 Mathias ..... 340/907
2003/0090896 A1 5/2003 Sooferian ..... 362/183
2003/0091388 A1 5/2003 Siblik ..... 404/13
2003/0095406 A1 5/2003 Lebens et al. ..... 362/231
2003/0132858 A1 7/2003 Hutchison ..... 340/944
2003/0185625 A1 10/2003 Albanese ..... 404/19
2003/0191577 A1 10/2003 Decaux ..... 701/117
2003/0193799 A1 10/2003 Bohler ..... 362/240
2003/0235051 A1 12/2003 Seland et al. ..... 362/329
2004/0021580 A1 2/2004 Higgs ..... 340/908
2004/0023678 A1 2/2004 Fredriksson ..... 455/502
2004/0047685 A1 3/2004 Van Der Poel ..... 404/9
2004/0075584 A1 4/2004 Fournier ..... 340/944
2004/0090793 A1 5/2004 Morsing ..... 362/551
2004/0100371 A1 5/2004 Rowledge ..... 340/472
2004/0101364 A1 5/2004 Kuo ..... 404/16
2004/0105264 A1 6/2004 Spero ..... 362/276
2004/0160153 A1 8/2004 Shikano ..... 313/112
2004/0160595 A1 8/2004 Zivkovic et al. ..... 356/73
2004/0184881 A1 9/2004 Burchell ..... 404/16
2005/0002203 A1 1/2005 Kojima et al. ..... 362/540
2005/0008434 A1 1/2005 Chen ..... 404/16
2005/0030739 A1 2/2005 Wang ..... 362/153.1
2005/0046597 A1 3/2005 Hutchison et al. ..... 340/917
2005/0073437 A1 4/2005 Perri ..... 340/944
2005/0073438 A1 4/2005 Rodgers et al. ..... 340/944
2005/0104747 A1 5/2005 Silic et al. ..... 340/944

FOREIGN PATENT DOCUMENTS

EP 1 179 637 A1 2/2002
WO WO 01/31125 A1 5/2001

* cited by examiner

METHODS, SYSTEMS AND DEVICES RELATED TO ROAD MOUNTED INDICATORS FOR PROVIDING VISUAL INDICATIONS TO APPROACHING TRAFFIC

CROSS-REFERENCE TO RELATED APPLICATION

This application claims the benefit under 35 U.S.C. § 119(e) of U.S. Provisional Patent Application No. 60/544,138, filed Feb. 13, 2004.

BACKGROUND OF THE INVENTION

1. Field of the Invention

This disclosure relates to traffic safety and communication methods, systems and/or devices, specifically for advanced warning and notification to vehicular and pedestrian traffic.

2. Description of the Related Art

Prior approaches have employed a set of visual indicators mounted to a road to provide visual indications to approaching traffic.

For example, U.S. Pat. No. 4,570,207 teaches locating the visual indicators in apertures or channels formed in a road, such that a top surface of each of the visual indicators is flush with the top surface of the road. The visual indicators are formed with an exterior that wears away, in a similar fashion to the top surface of the road, to maintain the top surface of the visual indicators flush with the road.

Also for example, U.S. Pat. Nos. 6,384,742 and 6,597,293 teaches the placement of visual indicators at crosswalks and/or intersections. The indicators may be affixed or embedded in the roadway. The visual indicators may be activated by an activation device, for example, via a loop detector embedded in the road or other device that detects the approach of a vehicle. Alternatively, or additionally, the visual indicators may be activated by an activation device, for example, a manual switch such as a pedestrian operated push button, sensor, and/or conventional traffic timing mechanism. Power may be supplied via a utility grid, or from a photovoltaic array positioned on a pole adjacent the roadway.

Previous approaches employing road mounted visual indicators are inefficient, expensive and/or cumbersome. For example, providing power and/or communications typically requires the laying of wires or cable along or underneath the road, a sidewalk, and/or an area adjacent the road. Such often requires trenching across an entire length or width of the road. For example, prior approaches typically require digging up large portions of the road, sidewalk and/or adjacent areas, via trenching or saw-cutting. In addition to trenching of the road to create locations for mounting the visual indicators, previous approaches require additional trenching in order to provide power and/or communications. Thus, additional trenching is required to provide power to the visual indicators from an existing power producing source, typically located along a curb or street. Additionally trenching may also be required to provide power to the activation device (e.g., loop sensor, other sensor, manually activated button, etc.). Further, additional trenching may be required to provide communications between the activation device and the road mounted visual indicators.

Such prior approaches typically also require the installation of a costly transformer box to transform power from a higher voltage (e.g., 110V or 240V provided by a utility grid) to a smaller voltage amount (e.g., 12 volts) for use by the road mounted visual, or by the activation devices.

Despite market demand, no known previous approach has successfully addressed these issues. Know approaches have also failed to adequately address minimizing power consumption while maximizing efficiency and sensory output. Thus, prior approaches miss a very high percentage, such as 90%, of potential implementations for in-surface devices, due to concerns over cost and/or inconvenience.

BRIEF SUMMARY OF THE INVENTION

Road mounted visual indicator devices for use in commercial, private, and/or public sector use garner significant market demand with respect to addressing issues surrounding traffic safety and enhanced signaling of information. While prior approaches include hard-wired devices, they present no functional path or detail to overcoming real-world power and communication issues. The approach described herein offers novel physical and mechanical differences which provide the means and methodology to meet a variety of stringent operational and regulatory needs, while being completely standalone for long periods of time encompassing several years. The approach used for these developments is unobvious, as it does not yet exist in any commercially available form relating to invention's market. It has been a long felt but unsolved need until development of invention, with the failure of previous efforts. This present approach overcomes these seeming liabilities with a series of developments and unappreciated advantages that solve prior inoperability concerns.

In one aspect, A traffic visual indicator device for mounting to a surface of a road that carries traffic in at least a first direction comprises: a housing comprising a base and at least a first face extending generally upward from the base; a power producing source carried by the housing and operable to produce power; a first illumination source carried by the housing and positioned to transmit light out from the first face of the housing toward the traffic in a second direction generally opposed to the first direction when the traffic visual indicator device is mounted to the surface of the road; a circuit carried by the housing, electrically coupling the power producing source and the first illumination source, the circuit operable to selectively supply power from the power producing source to the first illumination source; and a wireless communications subsystem carried by the housing and operable to at least receive wireless communications from an external source remotely spaced from the housing.

In another aspect, a method of providing information to traffic moving along a road in at least a first direction comprises: producing power from a respective integral power producing source at each of a number of traffic visual indicator devices mounted to a surface of a road that carries traffic; wirelessly receiving information by at least a first one of the traffic visual indicator devices, the wirelessly received information from an external device remotely located with respect to at least the first one of the number of traffic visual indicator devices; and transmitting light from at least one of the number of traffic visual indicator devices toward the traffic, in a direction generally opposed to the first direction based at least in part on the wirelessly received information.

In a further aspect, a traffic informational system for providing information to traffic moving along a road in at least a first direction comprises: a plurality of traffic information devices mountable to the road, each of the traffic information devices, comprising: a housing comprising a base; a power producing source carried by the housing, the power producing source operable to produce power; a first illumination source carried by the housing, the first illumination source operable to transmit light out of the housing generally toward on-coming traffic when the traffic visual indicator device is mounted to the road; a circuit carried by the housing, the circuit operable to selectively supply power from the power producing source to at least the first illumination source; and a wireless communications subsystem carried by the housing and operable to at least receive wireless communications externally from the housing. The traffic informational system may further comprise at least a first external control device comprising at least one antenna and a transmitter coupled to the antenna and operable to transmit wireless communications to at least a first one of the plurality of traffic information devices.

In some aspects, small, self-powered road mounted visual indicators may be used in providing surface lighting, mounted lighting, in-roadway communication and ambient condition sensing.

In another aspect, a traffic information system and/or visual indicator devices realize low power consumption, utilizing power modulation, signaling, and coding techniques to minimize the typical power consumption associated with wireless communications, while providing full functionality.

In another aspect, a traffic information system and/or visual indicator devices allows for dynamic configuration and operation. Design and operational parameters may be updated based on wirelessly receives signals and/or self-detected information from ambient environment. Visual indicator devices may process information, and store commands, programming, and configurations; allowing each device to be an interactive and dynamic component of its environment.

In another aspect, a traffic information system and/or visual indicator devices may be programmed in real-time or pre-programmed. An "intelligent" ability to process information from the ambient environment, allows devices to communicate based upon realtime events surrounding in the environment or based on wireless communications to device, as well as, pre-programmed commands based upon various constraints including time of day, type of weather, proximity and/or type of stimuli, etc.

In another aspect, a traffic information system and/or visual indicator devices provides wireless interference mitigation capabilities, for example, proactively checking for interference in wireless signaling, allowing frequent minor changes in frequency to overcome congestion or distortion issues. This not only may improve reliability, but also may improve the integrity for sending data, images, and commands as well as receiving data, images, and commands.

In another aspect, a traffic information system and/or visual indicator devices employ reliable self-power. A flow valve and energy control sensor controls the power supply for operation of visual indicator device, selecting a rechargeable power supply when power storage levels are high or a high density, long lasting, non-rechargeable power supply when power levels are low. This allows the visual indicator device to build up power reserves through use of a self power apparatus, such as solar panels, providing continuous power for long periods.

In another aspect, a traffic information system and/or visual indicator devices are long lasting. Power management allows each visual indicator device to last for several years, making the device's durability and life constrained more by physical structure rather than electrical efficiency.

In another aspect, a traffic information system and/or visual indicator devices employ brightness control. A control sensor that continually checks the brightness levels in ambient environment allows the controlling of the optical emission of each visual indicator device. Thus, one option is that when it is darker in device's surroundings, a lower intensity optical brightness level may be used, as a more intense or brighter level may be used during times of greater light in device's environment. By performing this unique control mechanism, the efficiency of the visual indicator devices may be improved while also responding directly to improving the observable effect of device, thereby improving its effectiveness and safety.

In another aspect, a traffic information system and/or visual indicator devices employ audio control. A control sensor checks the ambient noise in device's environment, and the visual indicator devices modify the audio output based on the ambient noise. Thus, one option may be to increase the audio output during periods of high background or ambient noise while lowering audio output for periods of normal or low background or ambient noise. This approach seeks to improve devices audio notification and sensory messaging, thereby improving effectiveness and subsequent safety.

In another aspect, a traffic information system and/or visual indicator devices is flexible. Many unappreciated advantages and functions allow the traffic information system and/or visual indicator devices to be used in areas with insufficient or no power. The traffic information system and/or visual indicator devices may be used in a plethora of previously long felt but unrealized locations, needs, and uses. Due to the many advantages, previous inoperability in many of these environments is no long an issue.

In another aspect, a traffic information system and/or visual indicator devices are easy to maintain and replace, if necessary. A special anchoring mechanism may be used that is mounted in or on the road, allowing visual indicator devices to be removably mounted to the anchoring mechanism with one or more types of mounting apparatus such as screws, locks, or brackets for quick and convenient installation and removal.

In another aspect, a traffic information system and/or visual indicator devices provides for device status reporting. A specialized reporting option provides for the proactive management of each visual indicator device by sending notification of operational information such as battery charge levels, previous average solar absorption rates, and ratios of activation attempts to flashing cycles, etc. The approach provides proactive management capabilities to site maintenance, providing information regarding exactly how each visual indicator device is performing, and permitting the changing or replacing units well in advance of need.

In another aspect, a traffic information system and/or visual indicator device provides reporting tools. A variety of reporting tools and/or options may be provided to administrators of from usage information to proactive notification of problems or communication errors. The content and format of said reporting provides a variety of usage information which can be used for a variety of needs, such as to show implementers how many times each traffic information system is used, allowing them to better gauge future traffic patterns and improve overall traffic safety.

Additional aspects and advantages will be apparent upon consideration of the ensuing drawings and description.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with transmitters, receivers, transceivers, charging circuits, power conditioning circuits, processors and/or controllers, and the like have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Figure 1:
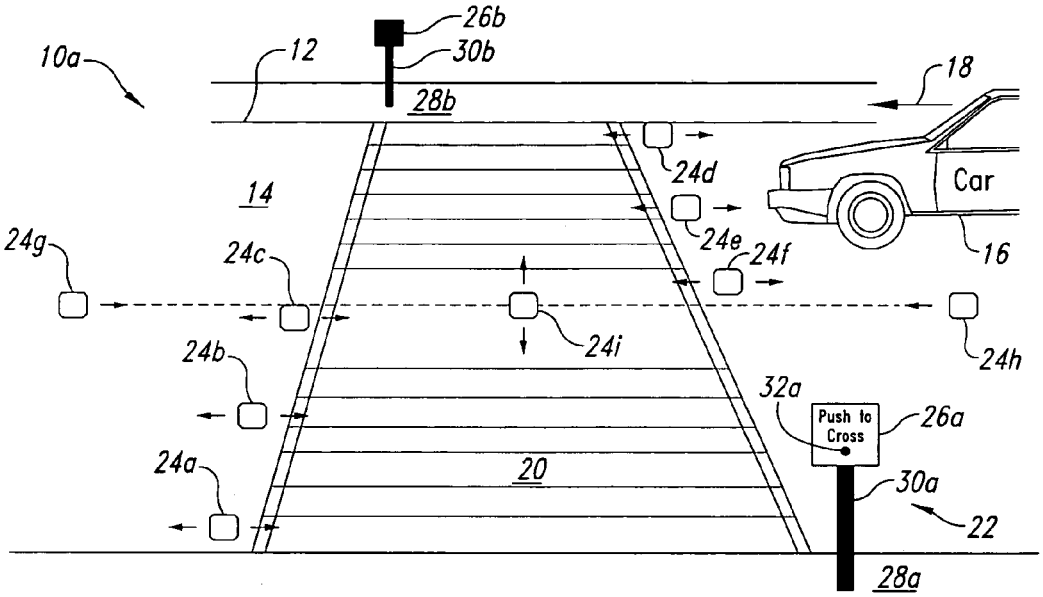
FIG. 1 is a schematic view of an environment showing a road carrying traffic in at least one direction proximate a pedestrian crosswalk, and a traffic information system comprising a number of road mounted traffic visual indication devices providing visual indications and a number of activation devices located proximate the road but remotely from the traffic visual indication devices, according to one illustrated embodiment.

FIG. 1 shows an environment 10*a* including a road 12 having a surface 14, that carries traffic 16 in at least a first direction indicated by arrow 18. The particular illustrated location is a crosswalk 20, which may be marked or unmarked for example by stripes. However, the teachings herein are applicable to other locations along a road, such as an intersection, median, exit, or entrance. As used herein and in the claims the term road means any road, street, highway, freeway, turnpike, rail, roadbed, taxiway, runway or other vehicular traffic bearing medium.

A traffic information system 22 comprises a number of traffic visual indicator devices 24*a*-24*i* mounted to the road 12, and a number of activation devices 26*a*, 26*b* located remotely from the traffic visual indicator devices 24*a*-24*i*.

A number of the traffic visual indicator devices 24*a*-24*f* may be positioned partially extending across the road 12 on both sides of the crosswalk 20. One or more of the traffic visual indicator devices 24*g*, 24*h* may be positioned to provide an advanced warning to traffic 16, being spaced upstream of a traffic flow from the crosswalk 20. One or more of the traffic visual indicator devices 24*i* may be positioned and/or oriented to provide a lighted indication to pedestrian traffic, for example, crossing at the cross walk perpendicular the general orientation of the road.

The activation devices 26*a*, 26*b* may be located proximate the road 12, for example, on a bicycle path or sidewalk 28*a*, 28*b*, and may or may not be mounted on a pole 30*a*, 30*b*. In at least one embodiment, the activation devices 26*a*, 26*b* may comprise push button 32*a* mounted on the pole 30*a*. As discussed in detail below, one or more of the activation devices 26*a*, 26*b* may include a wireless communications subsystem that communicates (e.g., broadcasts or pointcasts) with one or more of the traffic visual indicator devices 24*a*-24*i*, for example to provide information regarding a dynamic criteria or criterion such as a pedestrian pushing a button.

Figure 2:
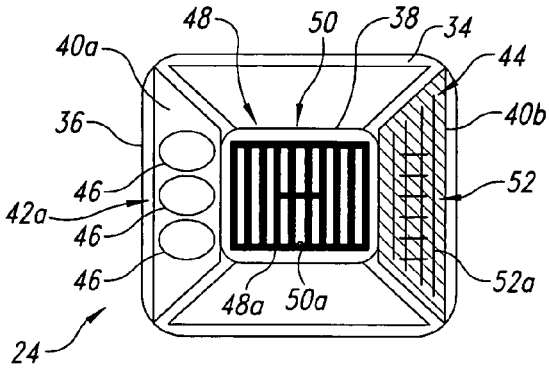
FIG. 2 is a top plan view of a traffic visual indication device according to one illustrated embodiment, showing a first set of visual indicators, an array of photovoltaic cells, an antenna, and an audio transducer.

FIG. 2 shows one of the traffic visual indicator devices 24*a*-24*i* (collectively referred to as 24) according to one illustrated embodiment. The traffic visual indicator device 24 comprises a housing 34 including a base 36 designed to be affixed or mounted to the road 12 or an anchoring mechanism 58 (discussed below). The housing 34 may also include a top 38, comprising a clear structural support mechanism with sufficient rigidity and strength the protect components within the housing 34 when the traffic visual indicator device 24 struck by traffic 16 such as a vehicle such as a truck, bus, automobile, motorcycle, bicycle, train, plane. The top 38 of the housing 34 may be made from one or more materials including metal, metal composite, carbon fiber, synthetic, or organic based materials, and may be designed to support, for example, 15 metric tons of weight.

The housing 34 may further comprise a first face 40*a*, and a second face 40*b* opposed to the first face 40*a*. In use, the traffic visual indicator devices 24 may be mounted to the road 12 such that the first face 40*a* faces the direction from which traffic 16 is approaching. Where the road 12 carries traffic in two, opposed directions, each of the first and second faces 40*a*, 40*b* will thus face approaching traffic 16. One or more of the faces 40*a*, 40*b* may form an acute angle with the base 36, which may facilitate the passing of traffic 16 over the traffic visual indicator devices 24.

The traffic visual indicator device 24 comprises one or more illuminations sources. For example, a first set of illuminations sources 42*a* are positioned to project light out from the first face 40*a* of the housing.

Figure 3:
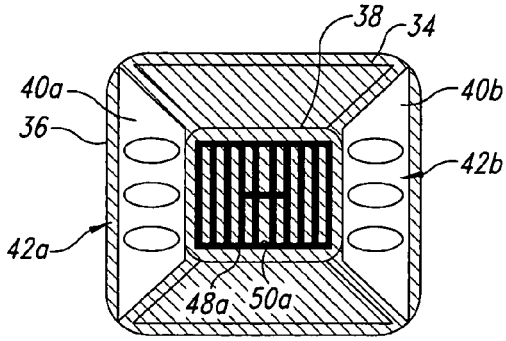
FIG. 3 is a top plan view of a traffic visual indication device according to another illustrated embodiment, showing a second set of visual indicators opposed to the first set of visual indicators.

As illustrated in FIG. 3, the traffic visual indicator device 24 may include a second set of illumination sources 42*b* to project light out from the second face 40*b* of the housing 34. The light from the second set of illuminations sources 42*b* would generally be projected in the direction indicated by arrow 18 (FIG. 1), that is toward a flow of traffic coming from an opposite direction from the traffic 16 illustrated in FIG. 1. Thus, the embodiment of FIG. 3 would be particularly useful where the road 12 carries traffic in two opposing directions. Alternatively, or additionally, reflectors or retro-reflectors 44 may be positioned along or beneath one or more faces, such as best illustrated in FIG. 2.

With reference to FIGS. 2 and 3, the illumination sources 42*a*, 42*b* may, for example, comprise one or more light emitting diodes (LEDs) 46 (only three called out in the Figures) and may include one or more optical components (not shown) such as simple or compound lenses for focusing emitted light, and/or one or more mirrors, reflectors, or prisms for directing the emitted light. Some of the illumination sources 42*a*, 42*b* may comprises light sources of a single color. Alternatively, the illumination sources 42*a*, 42*b* may comprise light sources of more than one color, which may be operated to produce a greater number of perceived colors. For example, one or both of the illumination sources 42*a*, 42*b* may comprises groups of red light emitting LEDs, blue light emitting LEDS and/or green light emitting LEDs, positioned closely together and operated to produce over 16 million perceived color combinations. Also for example, one or both of the illumination sources 42*a*, 42*b* may comprise color filters for transmitting light of various colors, for example three color filters in order to produce over 16 million perceived color combinations.

With continuing reference to FIGS. 2 and 3, the traffic visual indicator device 24 also comprises a wireless communications subsystem 48. The wireless communications subsystem 48 may comprise an antenna 48*a* and a receiver and/or transmitter or transceiver 48*b* (FIGS. 9A-9D). The antenna 48*a* may employ a variety of designs and/or positions to maximize signal reception and/or transmission. The antenna 48*a* may, for example, extend across a top 38 of the traffic visual indicator device 24. For example, the antenna 48*a* may be centered in the traffic visual indicator device 24, and may be formed as a plane on a layer in a printed circuit board. The antenna 48*a* may extend perpendicularly to the surface 14 of the road 12. The antenna 48*a* may advantageously bend at an approximately right angle, around one or more edges of the traffic visual indicator device 24. The antenna 48*a* may be tuned to 0.25 W.

The traffic visual indicator device 24 further comprises a power producing source 50. For example, as illustrated in FIG. 2, the power producing source 50 may comprise one or more photovoltaic cells 50*a* for converting insolation into electrical current. The photovoltaic cells 50*a* may be protected by the clear top 38 of the housing 34. Alternatively or additionally, as illustrated in FIG. 3, the power producing source 50 may comprise one or more pressure transducers 50*b*, for example piezo-electric transducers, for converting pressure or pressure changes into electrical current. Alternatively or additionally, as illustrated in FIG. 2 and 3, the antenna 48*a*, or some other antenna may capture electromagnetic radiation, for example in the form of RF transmissions, and appropriate circuitry can converter the electromagnetic radiation into electrical current. Such an approach is presently used in passive radio frequency identification (RFID) technology.

Figure 4:
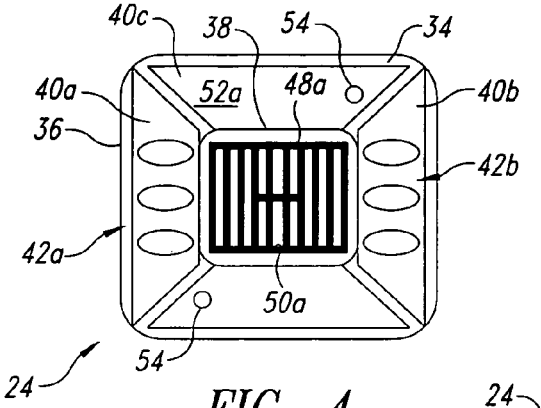
FIG. 4 is a schematic diagram of the traffic visual indication device of FIG. 3, showing a number of throughholes for receiving fasteners to mount the traffic visual indication device to an anchor mechanism.

As illustrated in FIG. 2, the traffic visual indicator device 24 may further comprises one or more ambient transducers for detecting or sensing conditions of the ambient environment. For example, traffic visual indicator device 24 may include one or more acoustical transducers 52*a*, which may be capable of detecting and producing sound. As illustrated in FIG. 4, the acoustical transducer 52*a* may be positioned on a third face 40*c* of the housing, for example, where the first and second faces 40*a*, 40*b* are encumbered by the first and second sets of illuminations sources 42*a*, 42*b* such as in the embodiment of FIG. 3. Also as illustrated in FIG. 4, the traffic visual indicator device 24 may include one or more through-holes 54, discussed in more detail below with reference to FIG. 5.

The traffic visual indicator device 24 further comprises circuitry 56 (FIGS. 9A-9D) which may include one or printed circuit boards including one or more processors (e.g., microprocessor, digital signal processor, application specific integrated circuit or the like) and or discrete electrical components (e.g., inductors, transformers, antennas, energy storage devices such as rechargeable and non-rechargeable batteries and/or ultracapacitors). Such circuitry is discussed in detail below with reference to FIGS. 9A-9D.

Figure 5:
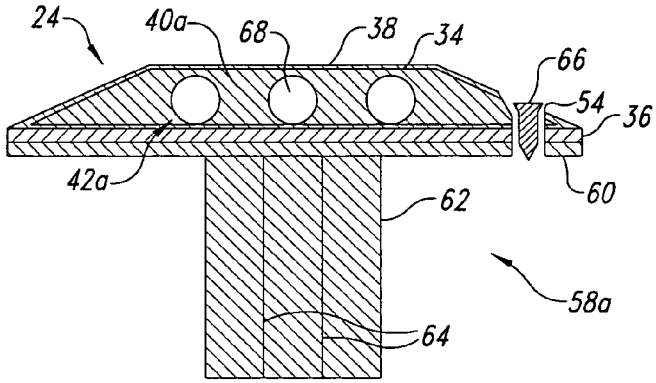
FIG. 5 is a front elevational view of a traffic visual indication device of FIGS. 3 and 4, showing an anchoring mechanism comprising a base plate and elongated fluted extending from the base plate according to one illustrated embodiment, and further showing a fastener received through one of the throughholes.

FIG. 5 shows the traffic visual indicator device 24 in conjunction with an anchoring mechanism 58*a* according to one illustrated embodiment.

The anchoring mechanism 58*a* may include a base plate 60 and an elongated stem 62 extending from the base plate 60. The base plate may be sunk in the road 12 to provide a smaller above surface profile, improving durability, an may have a lip formed around a perimeter thereof. The stem 62 may provide greater support and may improve the ability to adhere to the road 12. The stem 62 may, or may not, include one or more flanges or flutes 64 for improving device retention and limiting twisting or turning once mounted. The flanges or flutes 64 may run vertically down the length of the stem 62 and may be deep enough to act as a flange that improves the lateral support of the traffic visual indicator device 24 in adhering to the road 12.

A fastener 66 may be received through a through-hole 54 (FIG. 4) extending through a face 40 and/or top 38 of the housing 34 to secure the top 38 and/or base 36 to the base plate 60 of the anchoring mechanism 58*a*. The fastener 66 may, for example, be a security screw, expansion bolt, or other tamper-resistant mechanism.

Additionally, a pair of rails (not shown) may be coupled to the base plate 60 and/or the traffic visual indicator device 24 to reduce the likelihood of damage to the traffic visual indicator device 24 from excessive forces, for example those applied by snow plows. The rails may extend from the traffic visual indicator device 24 toward the approaching traffic, and form a decreasing angle of inflection leading up to the traffic visual indicator device 24 to guide the blade of the plow over the traffic visual indicator device 24. The rails may be coupled to the traffic visual indicator device 24 via two or more holes and fasteners, and may be fixed to the road 12 at distal ends of the rails.

FIG. 5 also shows one or more optical guides 68 that may provide an angled tunnel that seals to the respective face 40*a*, 40*b*, and which may focus the emitted light.

Figure 6:
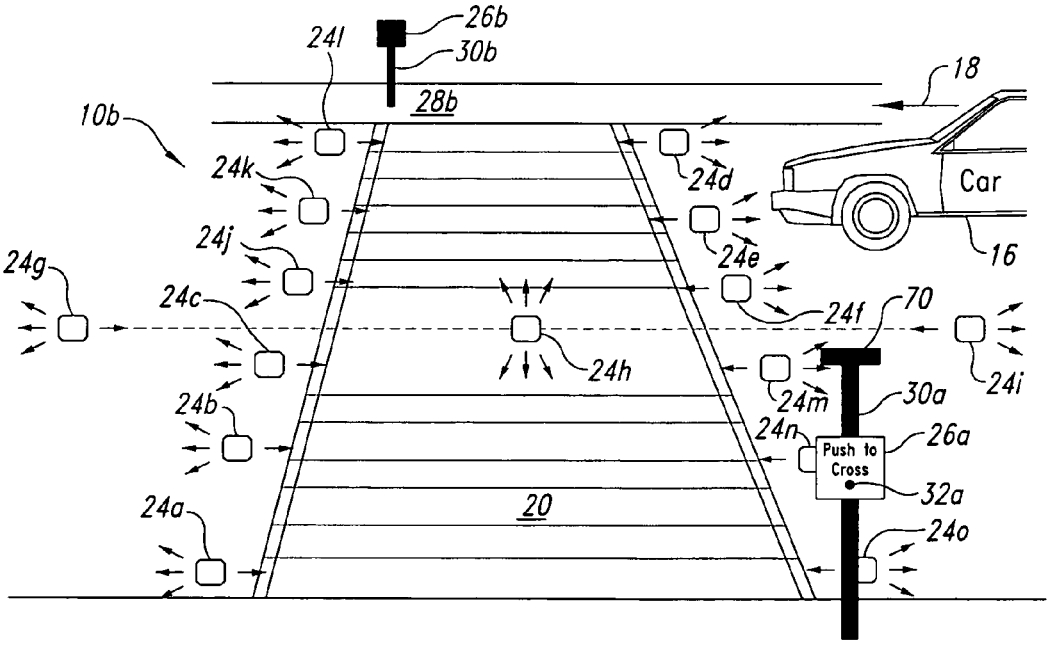
FIG. 6 is a schematic view of the environment of FIG. 1, showing wireless communications between the traffic visual indication devices and/or remotely located activation devices.

FIG. 6 shows another environment 10*b* where the traffic information system 22 comprises traffic visual indicator devices 24*a*-24*f*, 24*j*-24*o*, extending completely across the road 12 on both sides of the crosswalk 20.

The embodiment of FIG. 6 also shows a photovoltaic array 70 coupled to provide power to the activation devices 26*a*, 26*b*. This is particular suitable for rural locations, where the utility grid may lie at a great distance from the particular location. The photovoltaic array 70 may be conveniently mounted on the pole 30*a*. While FIG. 6 illustrates a photovoltaic array 70, the activation devices 26*a*, 26*b* may employ other sources of power, such as a manually operated generator or batteries, or a utility grid where available.

Figure 7:
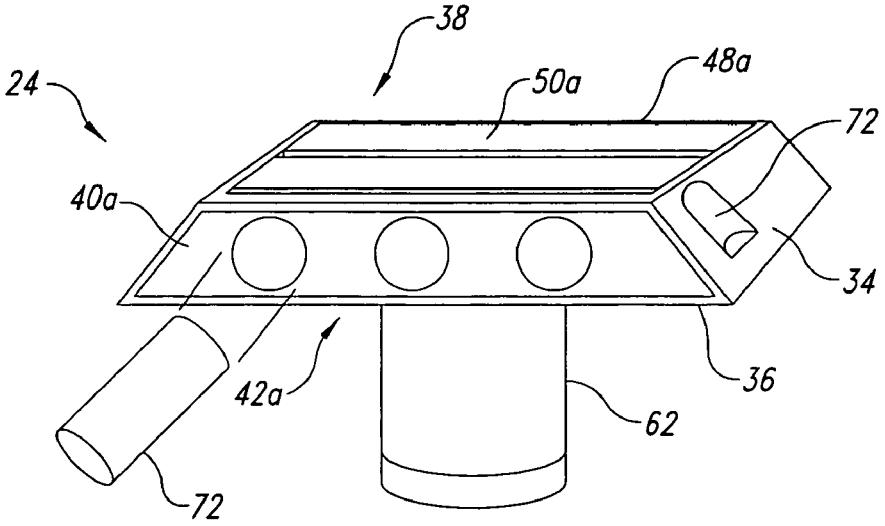
FIG. 7 is a partially exploded view of a traffic visual indication device.

FIG. 7 shows further aspects of the traffic visual indicator device 24.

As noted above, the traffic visual indicator device 24 may include one or more sets of illumination sources 42*a*, 42*b* carried by the housing 34 of the traffic visual indicator device 24. There may also be one or more sets of illumination sources 42*a*, 42*b* and/or acoustical transducers on each face 40 of the traffic visual indicator device 24. Each of the illumination sources 42*a*, 42*b* may include one or more LEDs 46 (FIG. 2). The LEDs 46 may be of a single color, or a variety of colors, for example a sequence of red-blue-green to form over 16.7 million colors. However, each LED 46 should operate at a maximized wavelength for the color of light sought by function of the traffic visual indicator device 24. In maximizing the wavelength at the LED level, rather than by using an additional lenses, up to an 80% improvement in optical output and efficiency may be maintained.

As further illustrated in FIG. 7, the photovoltaic array 50*a* should cover the maximum area possible while maintaining the other functions of the traffic visual indicator device 24, in order to ensure the greatest levels of insolation. Alternative embodiments may not require a photovoltaic cell, in which case this feature is not needed.

The traffic visual indicator device 24 may include one or more mounting bracket well 72 aligned with through-holes 54 for adhering the base 36 of the traffic visual indicator device 24 to the base plate 60 of the anchoring mechanism 58*a* via one or more fasteners 66 (FIG. 5). The mounting bracket well 72 may be offset of center to improve the lateral support. By creating an internally displaced cavity, each mounting bracket wells 72 may offer a flat plane for a mounting assembly, such as a security screw. Additionally, the cavity formed by the mounting bracket wells 72 preserves the head of the mounting assembly as well as its structural integrity, by keeping it protected from the wear from traffic, such as vehicular tires.

The use of an anchoring mechanism 58*a* advantageously provides a removable base 36, via a detachable assembly such as a clamp system or screw off base. The anchoring mechanism 58*a* may also include a watertight seal, such as a resilient washer assembly in between the inside of the removable piece and the rest of the stem. By having a removable design along the base 36 of the stem 62, permits easy replacement of a power storage device $V_B$ (discussed below) such as a rechargeable or non-rechargeable battery.

Further as illustrated in FIG. 7, the antenna 48*a* may be placed along the top 38 of the traffic visual indicator device 24, yet below the clear protective housing that protects the power producing source 50 (e.g., photovoltaic cells 50*a*), to ensure signal optimization. The antenna 48*a* may be positioned either in the middle of top 39 of the traffic visual indicator device 24, or along the perimeter in between the edge of the traffic visual indicator device 24 and the power producing source 50, in order to provide maximum exposure of the antenna 48*a* to the activation devices 26*a*, 26*b*.

FIG. 7 also illustrates the low profile of the traffic visual indicator device 24. The angular design of the traffic visual indicator device 24 minimizes surface obstruction allowing vehicles easily pass, while retaining maximum functionality, such as visibility of illuminations sources 42*a*, 42*b* and/or audibility of acoustical transducer 52*a*.

The traffic visual indicator device 24 may include an optical assembly channel 74 that goes inside the housing 34 The optical assembly channel 74 may include a reflective internal coating and be light-tight on the internal side, sealing securely to the optic source, such as a high output LED. A plastic bushing may be used to improve the light-tight adhering of the optic source to the optical assembly channel 74. By preventing light leaking out the backside of the optical assembly channel 74 and by making the internal coating reflective, improvements on the optical output will be found. Additionally, the channel 74 may be angled such as a cone to disperse the light in the most appropriate and effective manner, with a rounding of the body-side of the channel 74 to refract light toward the opposite and desired end.

Figure 8:
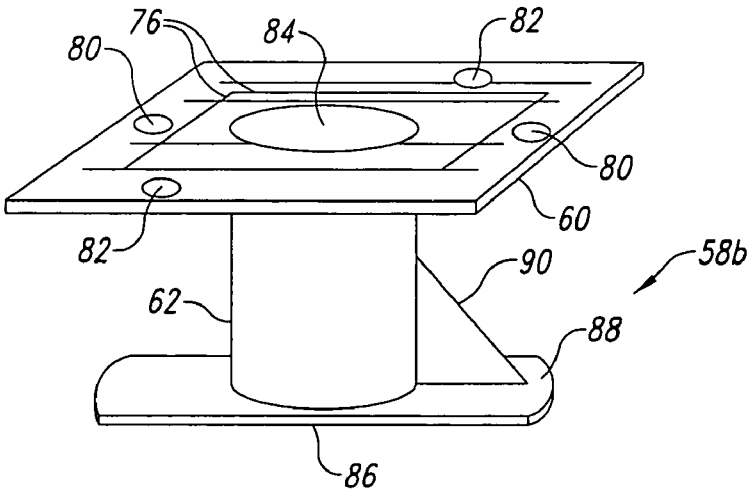
FIG. 8 is an isometric view of a base of the traffic visual indication device showing an anchoring mechanism according to another illustrated embodiment.
Figure 9A:
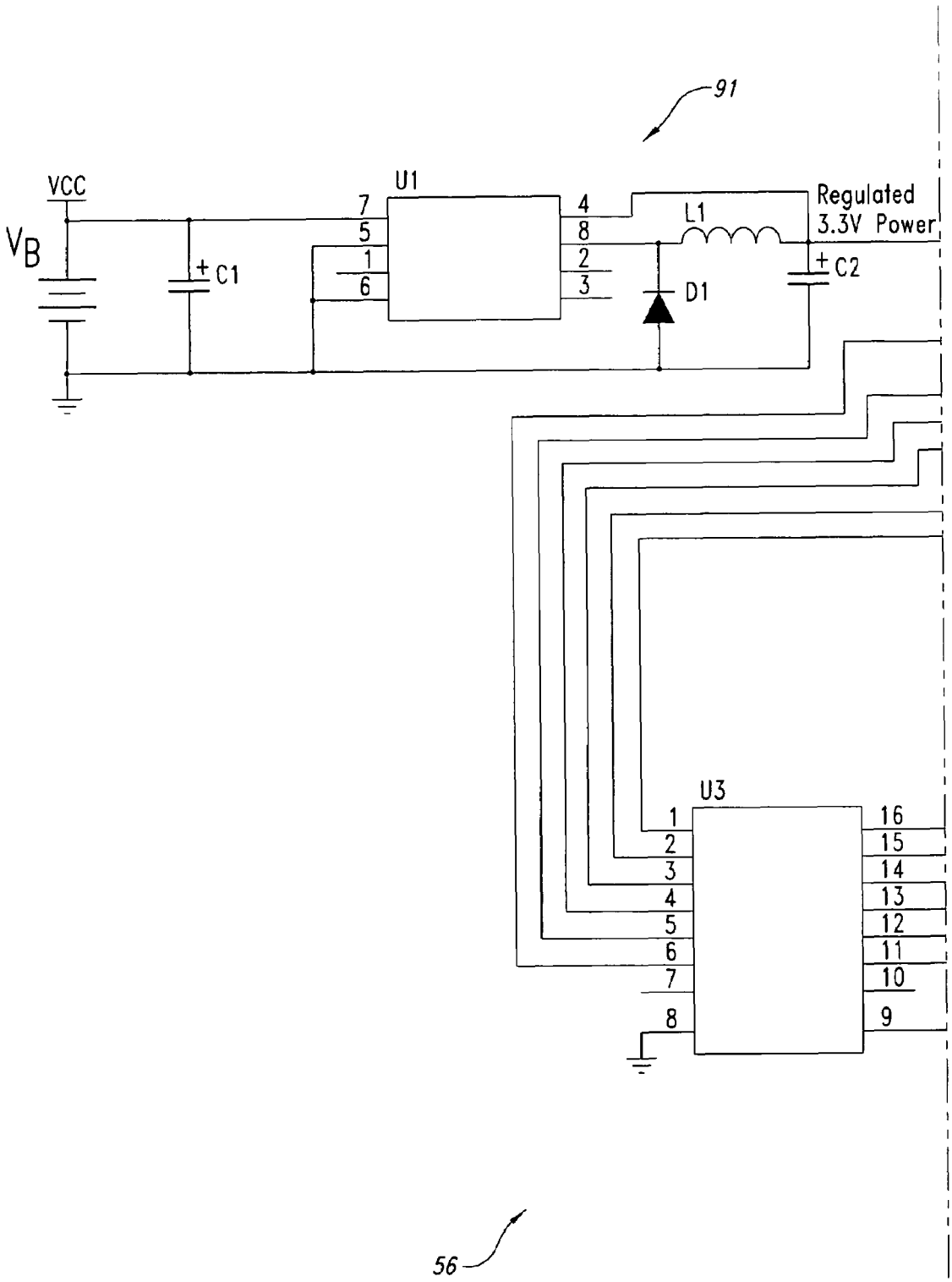
FIGS. 9A-9D are an electrical schematic diagram of the circuitry of a traffic visual indication device, according to one illustrated embodiment.
Figure 9B:
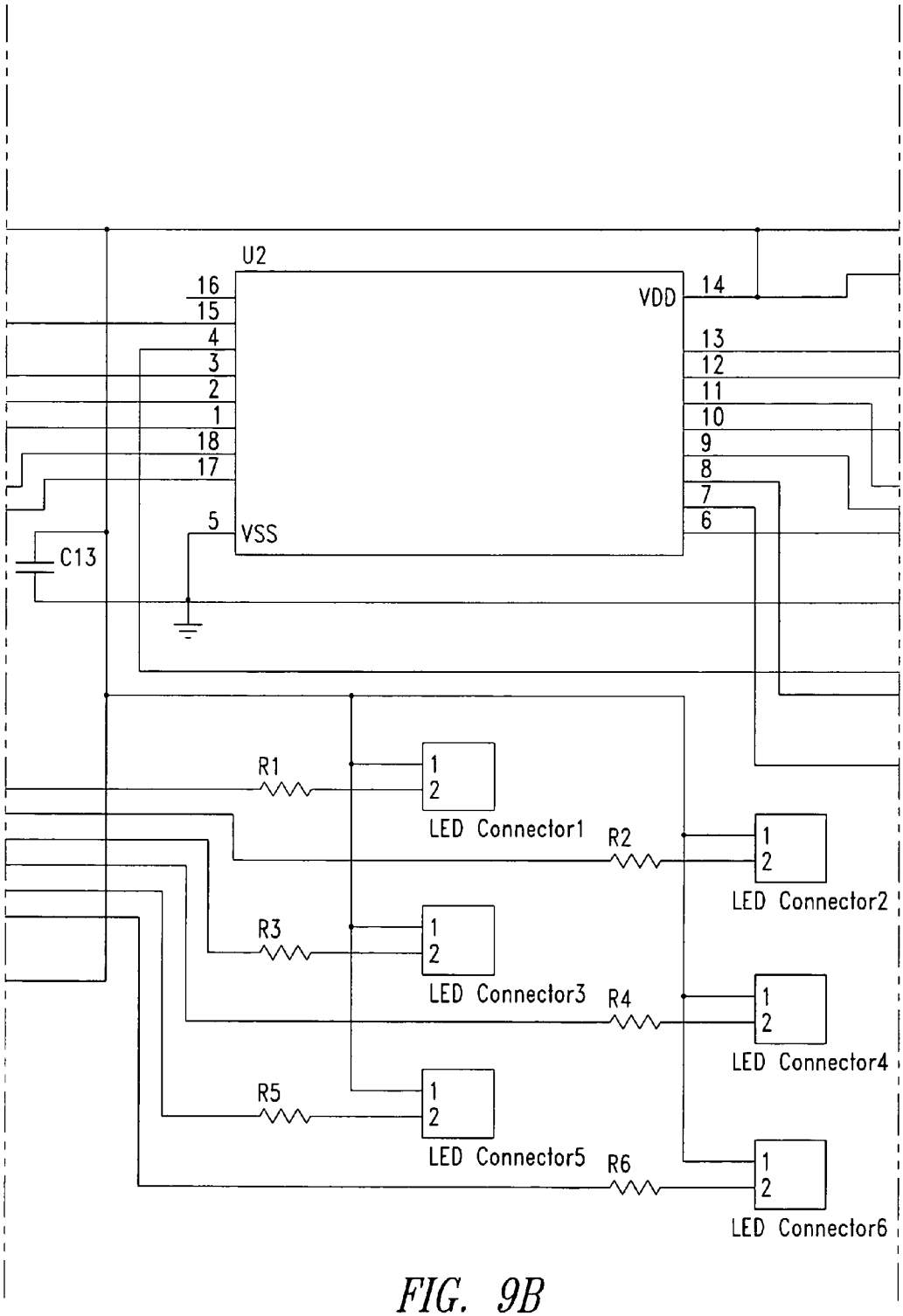
Figure 9C:
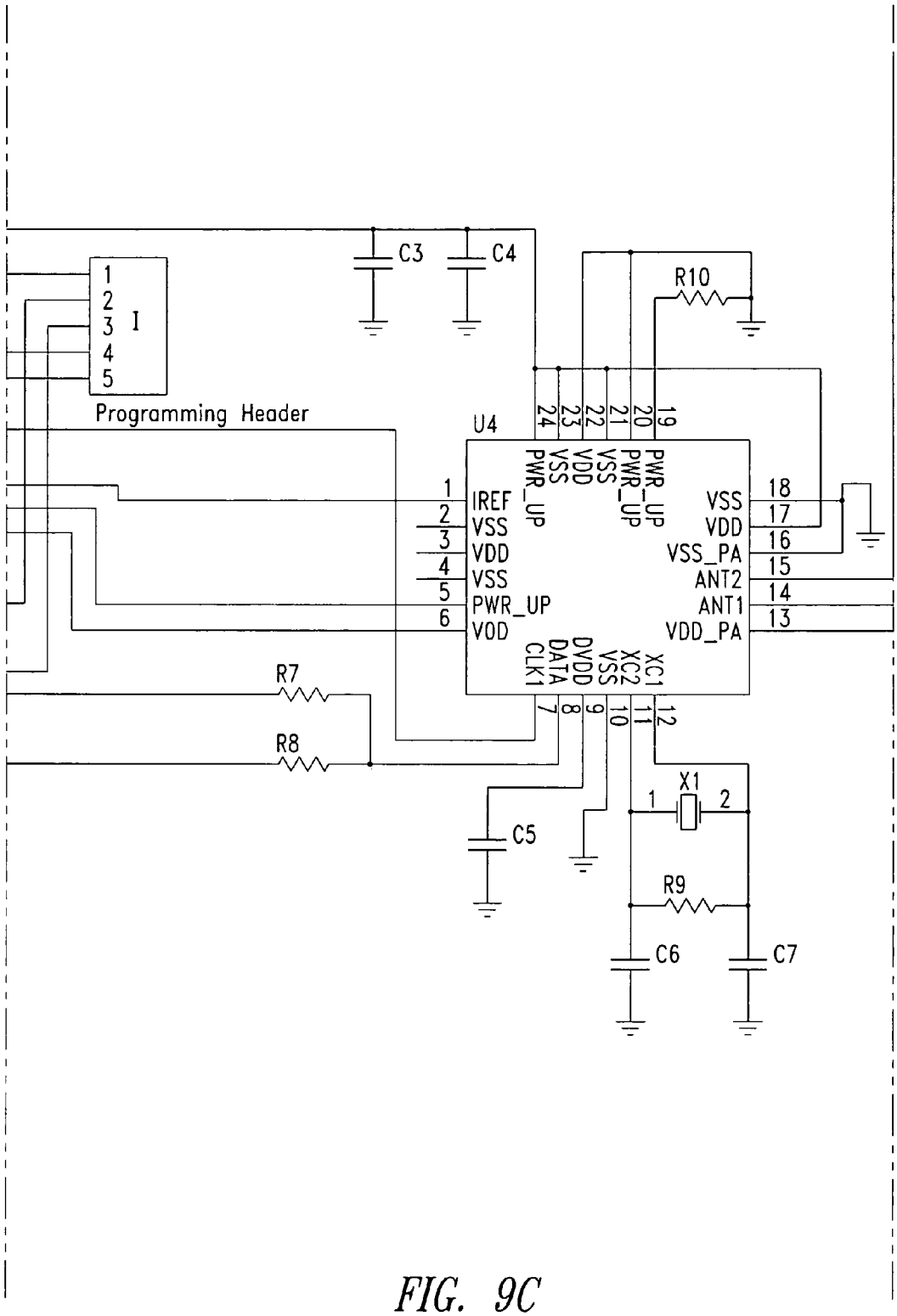
Figure 9D:
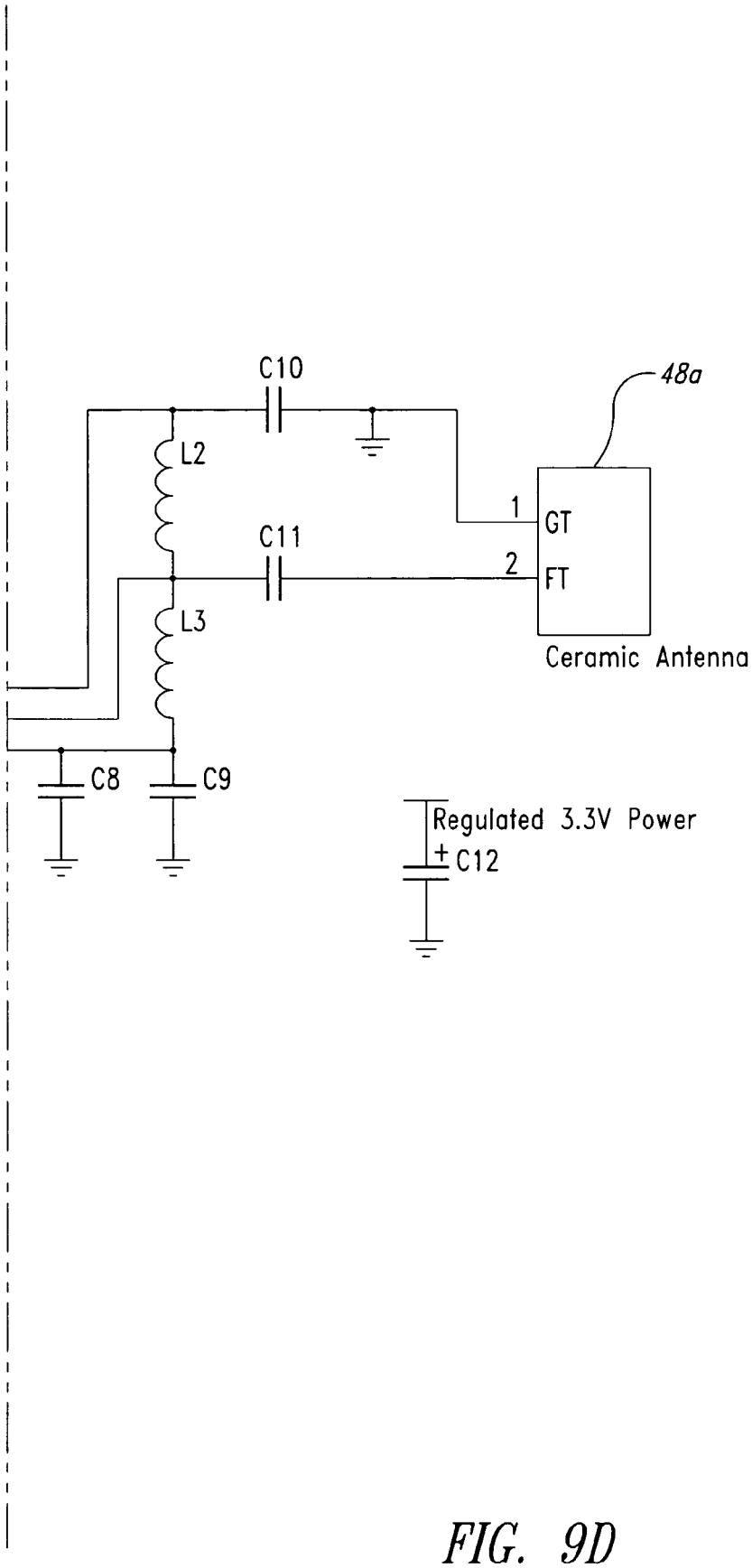

FIG. 8 shows the traffic visual indicator device 24 in conjunction with an anchoring mechanism 58*b* according to another illustrated embodiment.

As illustrated in FIG. 8, the base plate 60 may have the same dimensions as the base of the traffic visual indicator device 24, allowing a flush finish between the base 36 and the base plate 60, that will minimize the potential of pinches or cuts when handling. The base plate 60 may be smooth and well finished, and may be flush with surface, mounted on top of surface, or mounted slightly beneath the surface. The traffic visual indicator device 24 in generally, and the base 36 and base plate 60 in particular, may be of any geometric shape, whether as depicted (i.e., square), round, rectangular, etc. The traffic visual indicator device 24 should also be thin enough to minimize the overall height and potential obstruction to surface-level traffic, yet thick enough to provide ample strength and functionality, such as for threading of mounting screws to traffic visual indicator device 24.

One or more cuts and/or grooves 76 may be formed in a top surface 78 of the base plate 60. Such may increase the surface area, providing space for a seal to be used between the base 36 of the traffic visual indicator device 24 and the top surface 78 of the base plate 60. This seal may be waterproof and/or an adhering material. Thus, the PCB, and all components including the power storage device $V_B$ may be sealed, for example using a silicone gel, to provide structural protection and to render the traffic visual indicator device 24 water or moisture resistant.

The base plate 60 may include one or more tapping screw holes 80. The tapping screw holes 80 may be used for additional in-road fasteners, such as expander bolts or screws that help fasten the base plate to the road 12 (FIGS. 1 and 6). The tapping screw holes 80 may also be used to provide additional support and preservation of lateral orientation of base plate to road 12.

The base plate may also include one or more mounting holes 82 to facilitate adhering the traffic visual indicator device 24 to the base plate 60. If the base plate 60 includes more than one mounting holes 82, the mounting holes 82 may be offset from center to improve the lateral integrity of the hold. Additionally, the mounting holes 82 may be threaded, allowing for use of standard screws. Special security screws may also be used to minimize unauthorized removal of traffic visual indicator device 24 from the anchoring mechanism 58*b*.

As best illustrated in FIG. 8, base plate 60 may have an aperture 84, formed as an approximately cylindrical hollow fluted member, extending through the base plate 60 for receiving a proximate portion of the stem 62. The seal between the aperture 84 and the stem 62 may be watertight, to prevent saturation of debris or liquid that might hinder performance or hinder maintenance of the traffic visual indicator devices 24.

The stem 62 should be large enough to fit the stem yet small enough to minimize the required diameter and length of hole that must be bored into surface. The stem should be durable enough to withstand pressures placed on the traffic visual indicator devices 24 while providing enough depth or length to provide ample room for a possible extension of the stem.

The anchoring mechanism 58*b* may include a foot 86 that acts as a support to keep the base plate 60 from turning, providing additional lateral support to anchoring mechanism 58*b*. The length of the foot 86 may be customized to fit the exact diameter of a boring device in order to minimize the size of the hole required to receive the anchoring mechanism 58*b*. The foot 86 should have a width that is smaller than its length, so that an adhering material that helps keep anchoring mechanism 58*b* mounted to the road 12 may flow past the foot 86 to reside around the flutes of the stem 62, securely and firmly anchoring the anchoring mechanism 58*b* to the road 12 The ends 88 of the foot 86 may be rounded to facilitate ease of insertion by a standard boring device during installation, such as via a coring tool or drill. The length of the foot 86 and hence its subsequent effectiveness may be maximized by rounding the ends 88 to the same or smaller angular arc as boring device used to create the hole in the road 12 that receives for the anchoring mechanism 58*b*.

The anchoring mechanism 58*b* may further include a flange 90 extending between the stem 62 and the foot 86. The flange 90 may be any of a variety of shapes, including square or triangular, and may attach to the bottom of base plate 60 or rounded foot 86 at the bottom of the anchoring mechanism 58*b* (as shown herein). One or more flanges 90 may be used to provide additional lateral support to the anchoring mechanism 58*b* and traffic visual indicator devices 24.

FIG. 9A-9D are an electrical schematic of the traffic visual indicator devices 24 including circuitry 56 according to one illustrated embodiment.

The traffic visual indicator devices 24 may include one or more power storage devices such as a battery $V_B$. along with a smoothing capacitor C1 electrically coupled thereacross. The traffic visual indicator devices 24 may include a power regulation circuit 91 comprising a charge/discharge controller U1 along with an inductor L1, capacitor C2, and diode D1. The power regulation circuit 91 may be operable to condition power, for example increasing or decreasing voltage, and may be operable to limit the prevent the flow of power from the battery $V_B$ to the power producing source 50 when the voltage of the battery $V_B$ is higher than the voltage of the power producing source 50. The power regulation circuit 91 may be designed or selected to maximize the particular conversion, for example, the conversion of solar power to electrical current for supply to a load and/or power storage device $V_B$. In one embodiment, the traffic visual indicator devices 24 may employ more than one photovoltaic cell and more than one power storage device $V_B$ in order to maximize the conversion efficiency. In one embodiment, the photovoltaic cells may produce approximate 2V, with a drop of 0.3V across the diode, and 1.35V for charging a single 1.2V "C-type" battery, leaving approximately 0.35V for operating the LEDs 46, or shunted and/or dissipated as heat. The charge level of the power storage device $V_B$ may checked periodically, for example, every 100 clock cycles or every 30 minutes. While, the traffic visual indicator devices 24 may employ shunting of power where the power storage device $V_B$ is fully charged, the activation devices 26 will typically not employ shunting but will rather dissipate the excess power in the form of heat at the photovoltaic array 70 (FIG. 6).

The traffic visual indicator devices 24 may include a processor U2 for controlling operation of the various elements and executing functions. An interface I provides a programming interface or header for reprogramming the controller U2. The traffic visual indicator devices 24 may also include a drive controller U3 for controlling operation of the various light sources such as LEDs 46 to produce the desired output. With respect to wireless communications, a single communications controller chip may implement both transmitter and receiver, and thus be denominated a transceiver U4. Inductors L2, L3 and capacitors C10, C11, C11 may be coupled across the antenna 48*a* for impedance matching. The transceiver U4 may operate in three modes, including 1) transmit, 2) listen, and 3) sleep to maximize power efficiency. The traffic visual indicator devices 24 may be in the sleep mode while flashing the LEDs 46 and during most of its normal operation. The traffic visual indicator devices 24 may transmit data based on a time of day, month or device memory limits, for example before on-board memory fills up.

The circuitry 56 may be formed and/or carried on a multilayer printed circuit board (PCB). The PCB may adjust a distance between the power producing source 50 and other components, while also supporting an antenna 48*a* one a side of the PCB opposite the other components. The PCB may include multiple power regulators to handle high output requirements of the LEDs 46. Power may be cycled to provide for deep charge to charging of the power storage device $V_B$, to increase the life of the power storage device $V_B$, and may, for example, be based on a time of year and/or an average amount of power absorption, such as a 30 day average.

Figure 31:
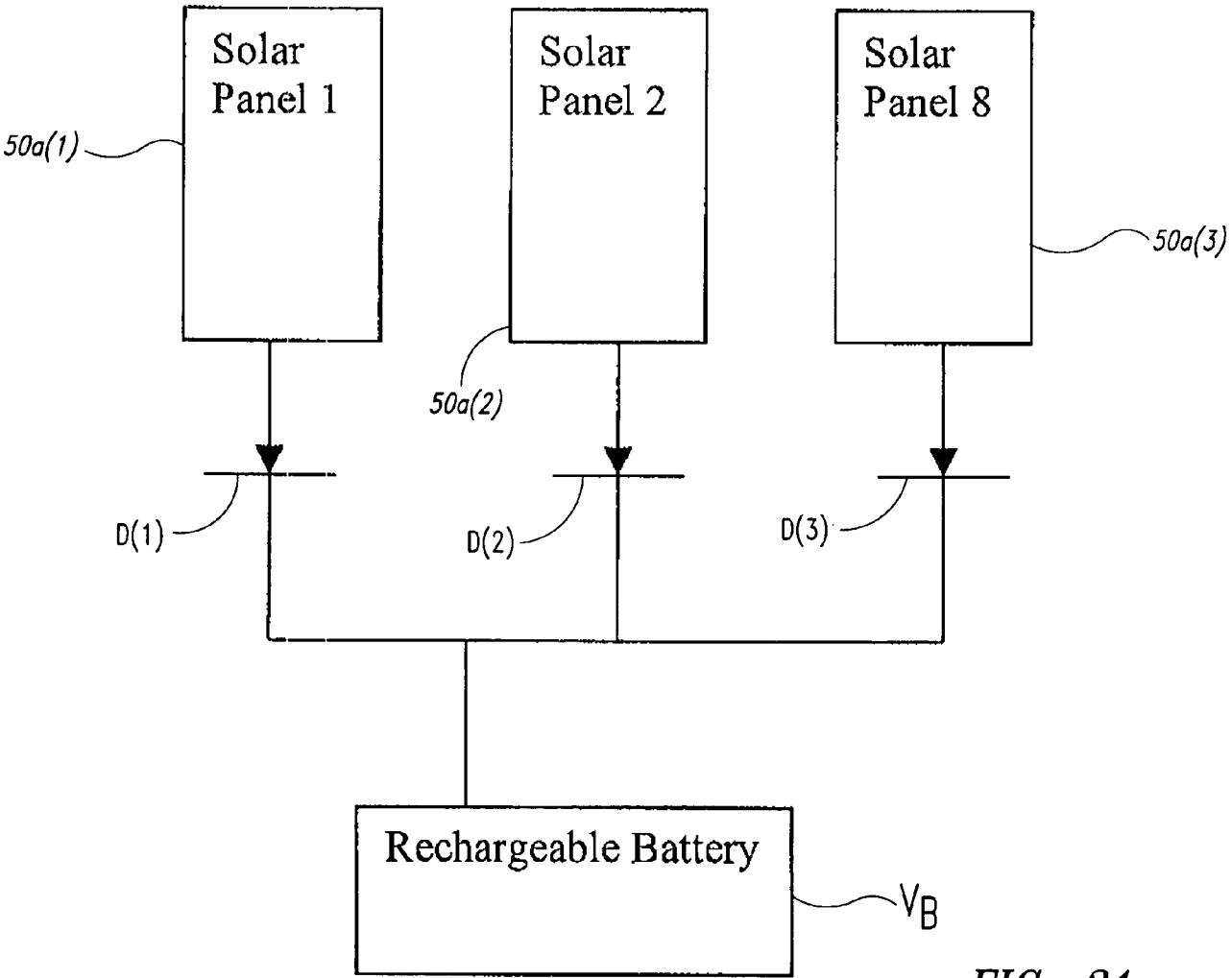
FIG. 31 is a schematic diagram of a number of groups of photovoltaic cells coupled by respective diodes to at least one energy storage device, according to one illustrated embodiment.

As illustrated in FIG. 31, the photovoltaic cells may be arranged in two or more groups of two or more photovoltaic cells 50*a*(1), 50*a*(2), 50*a*(3). Each group of photovoltaic cells may be associated with a respective diode D(1), D(2), D(3). While such will incur a loss of efficiency during normal operation, this approach allows a diode, e.g., D(2) associated with a malfunctioning group of photovoltaic arrays 50*a* (2) to be turned "OFF" to prevent the leakage of current through the "valve" that might be otherwise be dissipated by the photovoltaic cells 50*a*(2).

The output of the LEDs 46 may be increased when the power storage device $V_B$ is fully or nearly fully charged, in order to dissipate heat and/or increase brightness. The controller and/or processors may selected based on a power profile of the traffic visual indicator device 24. Thus, the controller and/or processor selection may be in order to optimize various aspects of the traffic information system 22, based on factors such minimizing voltage in order to reduce cost and inefficiencies that result through the waste of signal voltage, yet to provide sufficient voltage to realize the desired functionality. An external crystal may be used to improve the timing of individual LEDs 46 should an internal oscillator $X_1$ (FIG. 9A-9D) does not provide sufficient accuracy.

Figure 11:
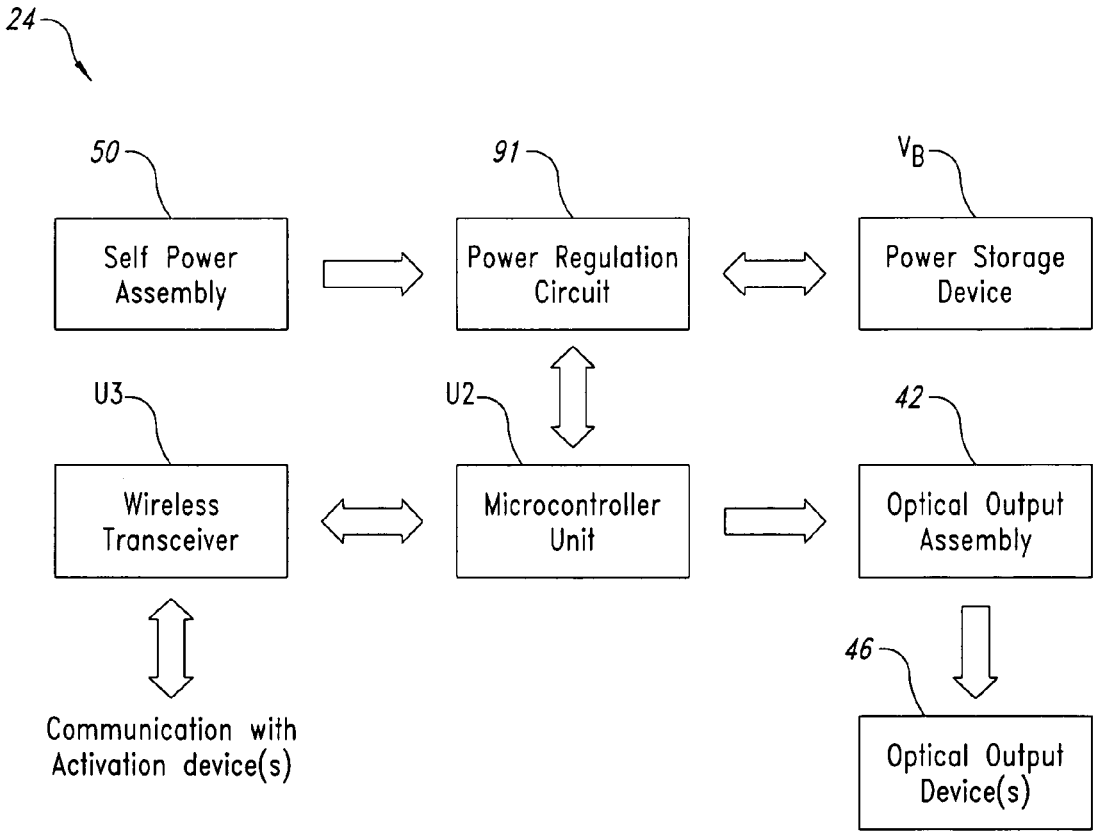
FIG. 11 is a schematic diagram of the traffic visual indicator device showing communications between various subsystems and/or element thereof, according to one illustrated embodiment.

Interaction between the various subsystems and components of the traffic visual indicator device 24 is best illustrated in FIG. 11.

Thus, as specifically discussed above, One or more of the traffic visual indicator devices 24 include one or more illumination subsystems, which may include one or more optical components, for example LEDs such as a multitude of organic LEDs, that may face one or more directions. The optical components may be capable of projecting one or more colors, including the forming of a high-density graphical display that may be used for applications from text messaging, graphics and images, or video.

One or more of the traffic visual indicator devices 24 may also include one or more acoustical transducers, such as a speaker and/or microphone, for detecting and/or producing sound. Each traffic visual indicator device 24 may dynamically adjust a volume of an audio output based at least in part on a volume of ambient noise.

One or more of the traffic visual indicator devices 24 may be shaped in a variety of geometric designs. In some applications it should be small enough to be portable and carried or mounted individually, with a sufficiently low clearance and angular design so as to allow vehicles to pass over the traffic visual indicator device 24 with minimal need for caution. The base of each traffic visual indicator device 24 or anchoring mechanism may also include a stem or sub-surface chamber for additional support and adhering ability.

Protective hardware may be used to lock one or more of the traffic visual indicator devices 24 into a secure hold with the road 12. This may include the use of security or tamper proof hardware such as screws and/or expander bolts to facilitate both temporary and permanent attachment to the road 12. The base plate of the anchoring mechanism may be made out of one or more materials including metal, metal composite, synthetic, or organic based materials and may be flush mounted, surface mounted, or imbedded into the road 12. It base plate may also contain a small locking mechanism, for example, a foot to prevent the anchoring mechanism from being easily pulled out of the road 12.

Specialized bonding or sealing materials may be used to adhere the traffic visual indicator device 24 to the base plate of its respective anchoring mechanism and/or the road 12, including adhering the base plate, if used, to the road 12. This may be in addition to or in replacement of any mounting hardware.

One or more of the traffic visual indicator devices 24 may also include a reflective mechanism to highlight its location even when not being actively used for providing visual communications. This reflective mechanism may be a standard plastic reflector adhered to the body of the traffic visual indicator device 24, may face one or more directions, and may be one or more colors.

One or more of the traffic visual indicator devices 24 may also include an assembly that absorbs or receives energy from its environment. This may be through one or more photovoltaic cells, a wireless radiation receiver that captures energy, pressure transducer activated by passing traffic, as well as one or more energy inverters, circuit breakers, electric meters, and other related assembly components.

One or more of the traffic visual indicator devices 24 may include processing functionality, such as one or more printed circuit boards (PCBs) and may contain the following assembly components: resistors, capacitors, inductors, crystals, transistors, flash memory, RAM, a regulator, processor, RF transceiver circuitry, micro controller circuitry, and a power switching converter circuit.

One or more of the traffic visual indicator devices 24 include a wireless communications subsystem that may contain one or more antennas 48*a*, transmitters, receivers, transceivers U4 and signal modulation and/or control devices.

One or more of the traffic visual indicator devices 24 may include one or more energy storage devices $V_B$. The energy storage devices $V_B$ may include one or more rechargeable batteries, one or more non-rechargeable batteries, and/or one or more super- or ultra-capacitors.

One or more of the traffic visual indicator devices 24 may include one or more ambient sensors or transducers that allow it to interact with its ambient environment. This may include electromagnetic, precipitation-based, seismic, inductive, acoustical, or optical sensors that allow the traffic visual indicator device 24 to obtain information for data capture and/or processing. For example, one or more of the traffic visual indicator devices 24 may include one or more monitoring devices such as a photo imaging device or video capture device. This may also include one or more data or proximity interaction devices, such as an external microprocessor chip device or smart card. Communications apparatus may be purely for the collection and transmission of data that each traffic visual indicator device 24 collects and/or distributes to its environment. Additionally, one or more of the traffic visual indicator devices 24 may interact with a separate environmental sensor, including electromagnetic, precipitation-based, seismic, inductive, audio, or optical sensors, including but not limited to loop detectors, time-of-day configuration, radar, etc.

The traffic information system 22 may include a option rich software interface that allows each traffic visual indicator device 24 to be updated based upon a large variety of options remotely and before or after installation. This includes the interface not only for updating but also for receiving data and system diagnostics. It may be loaded onto a variety of devices, including laptops, PDAs, etc and may connect with the wireless software transceiver (ST) via Ethernet, serial, USB, or other methodology.

A wirelessly controlled, self powered, intelligent traffic visual indicator devices 24 is described that intercepts commands and receives information from its environment 10, processes the information, and writes, transmits, or stores it for current or future use, which may be used in numerous applications and encompassing numerous embodiments including those for advanced warning, notification, and identification of obstacles, situations, and states of communication need its deemed audience including for people and organizations such as government, police, hospital, ambulance, construction, service and other public and private entities. Each traffic visual indicator devices 24 may provide direct information, such as the flash of a yellow light to warn of a crosswalk ahead or text messaging to warn of unsafe road or situational conditions, or symbolic information such that it notifies said deemed audience to act or behave in a particular fashion, such as to warn citizens of a regional disaster, requiring they abstain from driving or seek additional information before proceeding in a normal daily routine.

Each of the traffic visual indicator devices 24 takes sensory information from its environment or specific instruction from persons monitoring said device, processes it, and delivers a form of output. The output may be in one or more electromagnetic ranges including those in the (1) optical spectrum including lighting, pictures, and video, (2) audio including sound, voice, and other intelligible or non-intelligible signaling, and (3) data linking to one or more recording or interactive devices such as a base station, transceiver, processing unit, or network accessible device.

Based upon dynamic environmental information, in at least one embodiment the traffic visual indicator devices 24 receives one or more sensory inputs, processes them, and responds with a resulting action. Information includes that of electromagnetic stimuli including magnetic polarity, radio, microwave, infrared, visible light, ultraviolet, X-rays, gamma rays, and/or cosmic rays.

One advantage may be the ability to complete one or more modes of operation within the tight confines of a self-powered, wirelessly controlled, open environment. Such an approach may resolve a variety of power issues, while working within the confines of both national and international regulations on wireless signaling.

The described embodiments provide advanced and supplemental notification to and communication with motorists, pedestrians, and bicyclists. By placing one or more traffic visual indicator devices 24 along one or more surfaces including bike paths, sidewalks, walking trails, roadways, and commercial environments, a variety of communications may be performed. Each may perform as a visual, audio, or combinations of audio and electromagnetic communication. Rather than dealing with geographic and environmental requirements relating to electrical power availability and communications wiring, each traffic visual indicator device 24 installs easily, with one or more tools such as a core-boring tool. This makes them extremely flexible, negating typical requirements of bringing power to each implementation. Implementers of invention benefit from this attribute by gaining considerable flexibility and freedom for deploying said invention. Once a suitable location is found, one or more traffic visual indicator devices 24 typically get installed on a roadway. This includes using the traffic visual indicator devices 24 either perpendicular or parallel to the path of traffic. Furthermore, traffic visual indicator devices 24 may be used in other presentation formats that maximize the ability of the traffic visual indicator devices 24 to be noticed and underlying purpose for the traffic visual indicator device 24 implementation.

Figure 10:
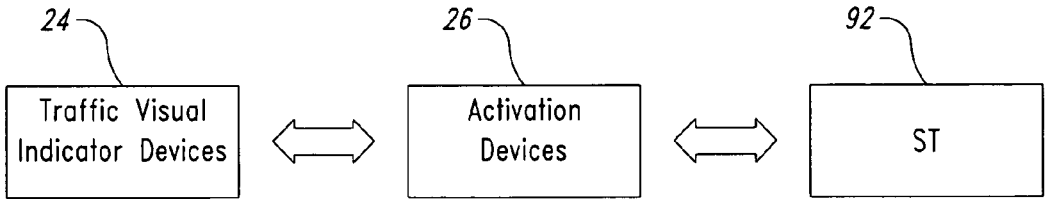
FIG. 10 is a schematic diagram of the traffic information system illustrating communications between traffic visual indicator devices, activation devices, and a full-featured software configuration tool, according to one illustrated embodiment.

As illustrated in FIGS. 1 and 6, according to one embodiment, the traffic visual indicator devices 24 may be installed along the path of a pedestrian crosswalk. Each of the traffic visual indicator devices 24 directs optical emissions toward oncoming traffic with optional optical and audio notification for crossing pedestrians, allowing each to both see and/or hear that optical communication is being performed for approaching traffic. As a pedestrian or cyclist approaches said traffic visual indicator device 24 deployment, one or more methods of activation may be used, including a manual push button, motion sensor, time of day programming, or a dynamic traffic flow monitoring tool. Prior to entering the path of traffic, each of the traffic visual indicator devices 24 begins to flash toward approaching traffic with flash warning and audio/or messaging to the pedestrian or bicyclist, as they proceed into the path of traffic, through the crosswalk. Flashing and audio messaging may be fully configured in advance based upon a variety of constraints by traffic engineer or city planner through use of a full-featured software configuration tool (ST) 92 (FIG. 10). Toward the end of each crossing cycle, the flash frequency of each of the traffic visual indicator devices 24 may be increased, along with audio countdown timing announcements via the acoustical transducer 52*a* (FIG. 2), to better communicate the conclusion of each crossing cycle to the pedestrian or bicyclist crossing the path of traffic.

Traffic visual indicator devices 24 do not require an additional, outside power producing source. This ability to provide self-power enhances the flexibility of each system 22, as it allows the traffic visual indicator devices 24 to be placed and used outside existing areas with power. Furthermore, each of the traffic visual indicator devices 24 installs quickly and easily, without trenching or saw-cutting. Thus, the methods and apparatus for maximizing efficiency of each of the traffic visual indicator devices 24 is considered novel.

According to one embodiment, a power producing source 50 absorbs energy from a radiation source such as the sun or another radiation source from one or more self-powering assemblies such as photovoltaic cells 50*a*. This can be used in conjunction with an energy storage device such as a rechargeable battery $V_B$ (FIGS. 9A-9D). Additionally, for locations of little or no solar exposure, a specialized long lasting energy storage device such as non-rechargeable battery may be used.

The traffic visual indicator devices 24 may includes a one-way energy valve diode that controls the energy storage device $V_B$ leaking to the power producing source 50 during times when there is little or no solar exposure or radiation collection capability and manages the power cross-over between one or more of the rechargeable and/or non-rechargeable power storage devices. This energy valve diode may be configured with one or more sensor tiers, monitoring the flow of energy between the self-powering mechanism (i.e., power producing source 50) and the power storage device. A voltage comparator is used to detect the direction of current flow through the switch connecting the power storage device to the self-powering assembly. If the self-powering assembly voltage is greater than the voltage of the power storage device, the switch is more forward biased allowing the charging current to flow into the power storage device. If there is no sunlight/radiation and the power absorption mechanism has little or no output then the voltage comparator senses this condition and turns the switch in a reverse or negative bias in order to prevent the current flow from the power storage device back to the power absorption mechanism. This energy preservation technique also protects the longevity of the power absorption mechanism.

The traffic visual indicator devices 24 may also include a unique directional current sensor that reduces the effective loss in the diode by as much as 90% from conventional means. This operates in a similar fashion to that of the energy valve diode. This directional current sensor may also be configured with one or more sensor tiers, monitoring the flow of current between the self-powering mechanism and the power storage device. A voltage comparator is used to detect the direction of current flow through the switch connecting the self-powering mechanism to the power storage device. If the self-powering mechanism voltage is greater than the power storage device, the switch allows the charging current to flow into the power storage device. If there is no sunlight and the power absorption mechanism has little or no output then the voltage comparator senses this condition and reverses the switch in order to prevent the current flow from the power storage device back to the self-powering mechanism.

The signaling method employed in this system may advantageously use a distributed and alternating methodology such as frequency shift keying (FSK). In order to best identify the congestion level at a particular frequency, a novel and unique frequency band test is performed with a monitoring sensor that changes the frequency to a subsequent shift when congested. Additionally, to ensure FCC regulations for power output, a distributed and alternating frequency methodology allows a higher output, which improves reliability and accuracy of wireless signal and data transmission.

In order to maximize operational efficiency in the tight power constraints met by use of certain self-powering mechanisms, like solar power, several threshold controls monitor the recharging of the power storage device from the self-powering mechanism. As described in detail below, this includes one or modes such as Passive, Active, Service, and Sleep. Each threshold level maximizes power efficiency for that state. As the receiver is the largest usurper of power, under normal conditions using traditional battery control methods, the battery would be depleted very quickly. Multiple voltage comparators are set for different thresholds and their second input commonly tied to the power storage voltage. Their outputs are logic levels and are fed to the microcontroller integrated circuit. The microcontroller integrated circuit reads these outputs and based on the output logic level, decides on the appropriate operating mode. By having different modes, more power intensive cycles may be limited to a particular mode. This further improves efficiency of the traffic visual indicator devices 24.

As illustrated in FIG. 10, according to an embodiment suitable for a crosswalk application, the traffic visual indicator devices 24 waits for a wakeup call from the activation device 26. By using communication modulation of the wireless signal sent from the activation device 26 to each traffic visual indicator device 24, additional power savings is realized. This is achieved by mass sum signaling, whereby each traffic visual indicator device 24 need only hear less than one percent of the total broadcast of the activation device 26, in order to pass from a standby mode to an active mode. Additional power savings stem from a system of switches that reduce the consumption of each microcontroller based upon the function. This novel development saves over 80% in energy efficiency at 1.2 volts from standard processes.

In order to improve the reliability of the wireless link between the activation devices 26 and each traffic visual indicator device 24, the system 22 may employ a process called packet minimization. Packet minimization reduces the protocol bit length for each critical active packet while reverting to standard data packet lengths on non-critical commands. This improves flexibility, efficiency, and overall value for deploying service commands and structural updates and broadcasts. This greatly enhances the functional reliability of the wireless transmissions and improves the ability of each traffic visual indicator device 24 to hear and follow remote orders and instruction.

In order to obtain the greatest amount of information from each traffic visual indicator device 24, each has the ability to be individually addressed and identified. This is useful for service updates relating to individual device usage statistics, information for diagnostic analysis, environmental identification, and device specific communication. A process of writing this unique address or identifier on each PCB is performed prior to configuring each traffic visual indicator devices 24 or system 22 for deployment, and may be written into the imbedded code on each traffic visual indicator device 24. Additionally, each traffic visual indicator device 24 monitors the current power storage levels. In instances with a rechargeable device, at times when solar absorption has maximized the rechargeable level of the power storage device $V_B$, the traffic visual indicator device 24 uses the solar power to send data and status updates to the activation device 26 for storage and ultimate downloading to the site administrator.

Signaling from each activation device 26 to traffic visual indicator devices 24 occurs on two or more channels. This channel differentiation provides greater accuracy, improves distance, and heightens quality of the wireless communications signal. Because there is no physical communications link between the activation devices 26 on each side of the crosswalk in some embodiments, the first crosswalk activation device utilizes "channel 1", communicating to each additional activation device 26, which broadcasts on "channel 2", or a subsequent channel to each traffic visual indicator device 24. Each activation device 26 is configured to always listen for a status command from a subsequent activation device 26. Upon receiving this command, the activation device 26 switches to a subsequent channel, broadcasting to the other traffic visual indicator device(s) 24. This increases potential distance limitations seen by signal restrictions placed by the FCC that limit power and signal strength. It also minimizes interference while eliminating normal communication confusion from traffic visual indicator devices 24 when receiving commands from multiple activation devices 26. Each traffic visual indicator device 24 may receive on any channel, thereby allowing greater flexibility of use for each signal activation mechanism. This feature also allows traffic visual indicator devices 24 to perform multiple, unrelated tasks, assisting in additional preferred embodiments, such as communication repeaters.

A method for regulating traffic visual indicator device communication consistency may also be used. With standard wireless communication, interference and signal obstruction become problematic issues. When one or more traffic visual indicator devices 24 miss a command to activate, under normal circumstances they begin to flash out of sequence over time. By regulating the communication consistency, this flash cycle is no longer an issue. Each activation device 26 broadcasts the activation prompt for more than one signal cycle. However, a vehicle or third-party interference may inhibit the traffic visual indicator device 24 from receiving the activation commands. With communications consistency, even after other traffic visual indicator devices 24 activate their communication cycle, the previously inhibited traffic visual indicator device 24 jumps in with them at the proper communication rhythm, flashing or communicating in unison with the other traffic visual indicator devices 24 while also ending at the proper time. Instead of getting out of turn or continuing for a time period longer than the others, each traffic visual indicator device 24 knows how many cycles it missed and subtracts them from the total cycle duration, so all traffic visual indicator devices 24 conclude their sequence at the same time.

The present approach may also include a method for communicating staggered requests of the same scenario. For example, a unit A would flash three times with a 50% duty cycle and 1 hertz flash rate while an unit B might also flash three times with a 50% duty cycle and 1 hertz flash rate. However, with "staggered output signaling," a novel approach may allow unit A to operate for a series while unit B waits. When unit A completes its (three-flash) sequence, unit B flashes (three times), passing back and forth like this until the end of the flash cycle. The methodology for doing this with multiple staggered outputs is considered novel. The time delay is programmed into each microcontroller. The A delay equals to zero and B delay equals to the time required to complete the number of flashes (service command) at the flashing frequency (another service command). The microcontroller calculates the time delay form these two commands and adds it to the flashing sequence when activated.

Operation of the traffic visual indicator devices 24 may include a method of using an electromagnetic sensor to filter out extraneous signal noise, increasing reliability and functional integrity of each traffic visual indicator device 24. This unappreciated benefit improves reception of the in-band frequency resulting in greater signal reliability and communications integrity. By utilizing this electromagnetic sensor, each traffic visual indicator device 24 effectively reduces the signal strength of non-known frequencies and wavelengths, so that it may focus on those FSK frequencies it requires for operation.

The ST may be configured to control any individual sensor and/or LED from remote means. By the unique graphical depiction of the traffic visual indicator device 24 on the ST, a system manager may select one or more functions for each traffic visual indicator device 24. This unique functionality allows greater control and functionality while also allowing each traffic information system 22 to operate in a power or output maximized setting. This sensor management allows for output, such as LED lighting, to be changed or modified without the need of replacing a traffic visual indicator device 24. It is also a novel approach to allowing system administrators the flexibility of determining the most desired configuration based upon output needs coupled with power absorption assembly.

The present approach may also include one or more preventive maintenance tools. Wireless radio circuits use a quartz crystal for their frequency reference. However, over time and due to temperature and phase noise, both long and short-term frequency drift occurs. To minimize this natural phenomenon, the activation device 26 records the shift integrity during one of the diagnostic modes and updates the ST of frequency drift levels. This novel proactive management approach allows the traffic information system 22 manager to replace the traffic visual indicator device 24, modify the crystal, or correct the frequency in the wireless radio circuit.

The system 22 may use spread spectrum signaling, such as frequency hopping, to communicate more effectively and efficiently. This development results in one thousand times the normal output compared to what is normally realized in FCC regulations and is a unique development for this application. This technical effort greatly enhances the efficiency and integrity of the communications signaling. This may be accomplished in one or more wireless bands, including the 2.4 GHz ISM band. Regardless of the wireless band, invention uses one or more types of wireless transceivers for its operation and maintenance. With spread spectrum signaling, the transmitter power may be increased as compared to a standard fixed frequency operation. This increases the wireless communication range 32 times to that of fixed frequency signaling.

LED control is used to further maximize energy and life of each traffic visual indicator device 24. A method was developed to control the brightness of each LED based upon the output of each self-powering mechanism (i.e., power producing source 50) such as a photovoltaic assembly. The brightness of each LED is also varied based on the energy storage device such as the battery charge level. This maximizes the charge and subsequent life of each rechargeable battery while also protecting it from overcharging and failure. A novel approached is developed for increasing or decreasing actual LED output based upon dynamic environmental factors. This system 22 can also be manually overridden, if so desired by system deployment manager in the ST. The microcontroller has an integrated analog to digital converter. The battery voltage is fed to one of the analog to digital converter inputs. The microcontroller samples the power storage voltage over a predetermined time period and integrates its value. The power storage charge level can be extracted from this value. If the power storage device's charge level comes close to 100% (or the desired level tier, as defined by the system administrator in the ST) the sensory output level of each traffic visual indicator device 24 increases. The increased current drains the power storage device faster preventing overcharging. The energy is not wasted but used towards the useful task of increasing the communications intensity of the traffic visual indicator device 24. If the power storage charge comes close to 0% the microcontroller delays or suspends sensory output and other power hungry tasks until the self-powering mechanism builds up a predefined charge in the power storage device.

As defined earlier in this document, the traffic visual indicator device 24 gets mounted on or embedded into a surface such as a roadway, to perform one or more communication and sensory functions. In this preferred embodiment, it provides optical and/or acoustic notification to approaching motorists of an impending pedestrian or cyclist presence. The traffic visual indicator device 24 may achieve this optical notification through one or more light emitting diodes (LED) and an audio assembly. The traffic visual indicator device 24 also contains a wireless controller printed circuit board (PCB), a self powering mechanism such as photovoltaic cells, one or more energy storage devices which may include a primary (non-rechargeable) battery and a secondary (rechargeable) battery, and housing which may be hermetically sealed. The wireless controller PCB facilitates the wireless communication to the activation devices 26 and ST units 92, controls the communication sequence of the LEDs, dictates the audio messaging to each traffic visual indicator device 24, monitors and regulates the charging current from the self powering mechanism to the energy storage device, and stores the various operating variables into its integrated memory for future retrieval. The wireless controller PCB hosts the frequency transceiver, which may be radio frequency, the integrated circuit, the microcontroller integrated circuit, the integrated antenna, the self-powering mechanism, one or more various sensors (e.g., camera, light sensor, temperature sensor, humidity sensor, etc.) and the power conditioning and regulation circuitry.

Depending on the operating conditions, the traffic visual indicator device 24 may enter one or more operating modes such as: Passive, Active, Service, and Sleep. The ST 92 may also control the traffic visual indicator device 24 to enter any of the aforementioned modes for testing and servicing purposes.

Mode One—a default mode that initiates upon initial activation of the traffic visual indicator device 24. The microcontroller integrated circuit operates in a reduced power mode and the radio integrated circuit cycles between the active and shutdown states with a low duty cycle such as 2% active and 98% shutdown. This allows the traffic visual indicator device 24 to conserve power while retaining a full signaling awareness for operation commands.

Mode Two—a mode such as this can allow the traffic visual indicator device 24 to enter active mode only upon reception of an activation device 26 wakeup or ST 92 wakeup command. In active mode the traffic visual indicator device 24 may keep the radio integrated circuit also in the active mode continuously in order to receive additional command structure signaling or requests.

Mode Three—a mode such as this can be initiated by the ST 92 or automatically upon sensing a power tier where the voltage level in the power storage device enters a low threshold state. The purpose of this mode is to prevent further discharging of the power storage device(s) due to continued operation of sensory outputs such as LEDs and an audio assembly. The traffic visual indicator device 24 in this mode does not respond to operation commands but only service commands. If the service mode was initiated due to the crossing of the appropriate voltage threshold the unit can return to standby mode once the normal power storage device threshold has been exceeded, or go into sleep mode if the power storage device's voltage falls below critically low threshold. If the service mode was initiated by service request command of the ST 92, the traffic visual indicator device 24 returns to the standby mode after the specified time delay.

Mode Four—the traffic visual indicator device 24 enters a mode such as this upon sensing of the critically low power storage condition. The purpose of this mode is to power conservation during the long periods of absence of charging current from the self-powering mechanism. The traffic visual indicator device 24 puts the signaling integrated circuit into shutdown mode, the microcontroller integrated circuit goes into low power mode until the power storage voltage returns above the critically low level. There can be one or more tiers of Sleep mode, each with commemorate functionality.

One or more traffic visual indicator devices 24 may also function as a slave or master to other traffic visual indicator devices 24. By having one master traffic visual indicator devices 24 control one or more slave traffic visual indicator devices 24, large geographic distances may be covered without use of an activation device 26. Additionally, usage constraints may be minimized which greatly increases the commercial appeal of the system 22. This may also used in other alternative embodiments, such as dynamic highway lighting and street lighting.

Figure 12:
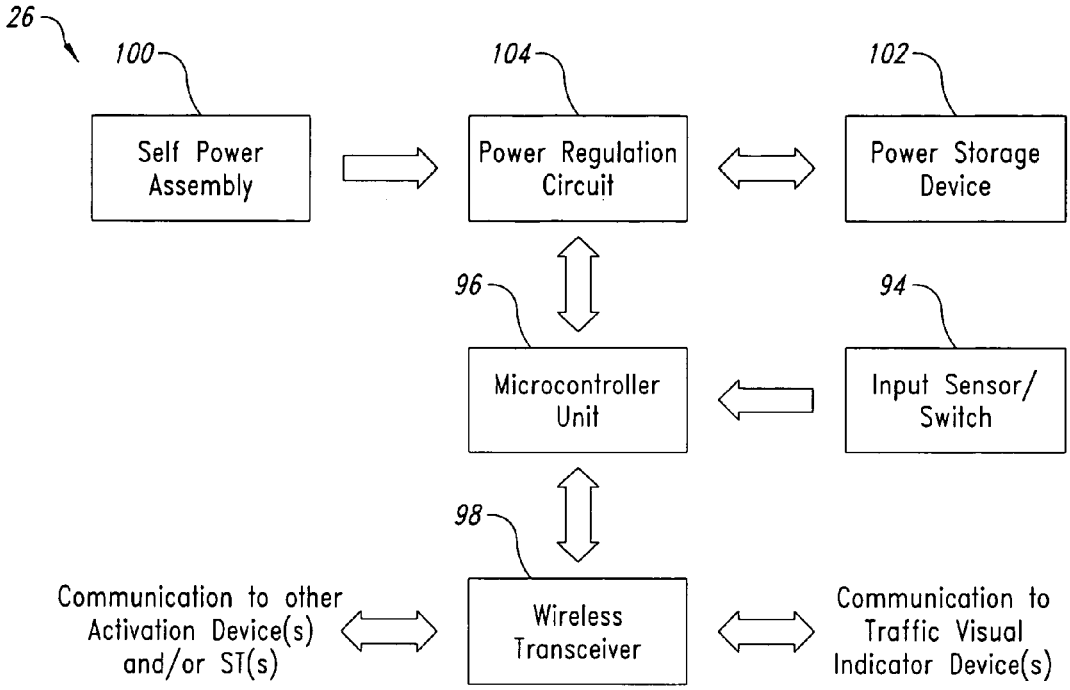
FIG. 12 is a schematic diagram of an activation device showing interaction between a controller, wireless transceiver, power storage devices, power regulating circuit and power producing source, according to one illustrated embodiment.

The crosswalk situation activation device 26 may include a push button, loop trigger, radar, etc, may connect with one or more activation devices 26. This activation device 26 initiates the sensory output for the traffic visual indicator device 24 along one crosswalk. As illustrated in FIG. 12, the activation device 26 comprise an input sensor or switch 94 such as a push button 32*a* (FIGS. 1 and 6), proximity sensor, time of day sensor, or other internal or external sensor. The activation device 26 also comprises an activation control mechanism such as a microcontroller 96, digital signal processor and/or application specific integrated circuit; coupled to receive signals from the input sensor or switch 94. The activation device 26 further comprise a wireless controller PCB with a transmitter, or transceiver 98 for providing wireless communications with the traffic visual indicator devices 24, other activation devices 26, and/or STs 92. The activation device 26 optionally comprises a self powering mechanism 100, such as a photovoltaic assembly; one or more power storage devices 102 such as a primary (non-rechargeable) battery and secondary (rechargeable) battery; and/or a power regulation circuit 104 coupling the self power mechanism 100 and/or power storage device 102 to the microcontroller 96. The power regulation circuit may be similar to that shown in FIGS. 9A-9D for the traffic visual indicator devices 24. The activation device 26 may include a housing that may be hermetically sealed. This is typically placed within close proximity to the crosswalk activation mechanism but may also be placed on a neighboring structure including a building, overhead wire, or traffic light for enhanced communications accuracy.

Components of the activation device 26 may be installed in the traffic visual indicator devices 24 for certain applications and additional embodiments.

Additional activation devices 26 may be used as repeaters for increasing the range and effectiveness of each installation and is also applicable in several other invention embodiments.

Each activation device 26 and/or traffic visual indication device 24 may act as either a master or a slave. When activated, tells the master to extend a flash cycle. The slave may waits until the end of a flash cycle to provide such information. The slave is able to track the cycle of the master. The slave is able to collect data from traffic visual indication devices 24 when the master does not receive the data, for example due to range limitations or obstacles interfering with the communications, and may then pass the information to the master for storage.

A Software Configuration Tool or ST 92 may be used for programming of the communication parameters and retrieval of the status variables stored in the traffic visual indicator devices 24 and/or activation devices 26. The ST 92 may be housed on any standard processing device such as a laptop or personal desktop assistant (PDA) or be its own device. One or more communication sequences can be administered through the ST 92, allowing for traffic visual indicator devices 24 to provide sequential signaling with other traffic visual indicator devices 24.

The ST 92 allows for dynamic customizations including changes to the duty cycle, frequency, duration of primary pattern, flash duration of concluding or additional communication pattern, etc. Due to federal and state regulations, it is very advantageous to be able to change and/or modify programming of traffic visual indicator devices 24 based upon both short term and long term goals. Even after being installed in the surface, each traffic visual indicator device 24 may be fully configured remotely with the ST 92. A means of use can enable this feature with wireless connection to Ethernet or other advanced networking transport that will allow any implementation of invention to be fully configured, monitored, and tested from the Internet or any location on the related private network.

The ST 92 offers a visual representation or simulation of the desired control parameters that can be run to give the traffic engineer or city planner (system manager) a means for gauging the effective and aesthetic parameters of any configuration prior to deploying said configuration on a traffic visual indicator device 24. The methodology and means for developing this interface and tool are considered novel.

ST 92 provides means for preventive maintenance, with monitoring diagnostics for managing power storage levels, usage requests and implementations, pattern analysis, etc. Each ST 92 is also configurable at both a micro and macro level, allowing for two or more systems of traffic visual indicator device scenario management, as well as individual programming of traffic visual indicator devices 24. This may be accomplished by assigning one or more management tiers to each implementation category that may be customized individually to control one or more implementations of invention.

Figure 13:
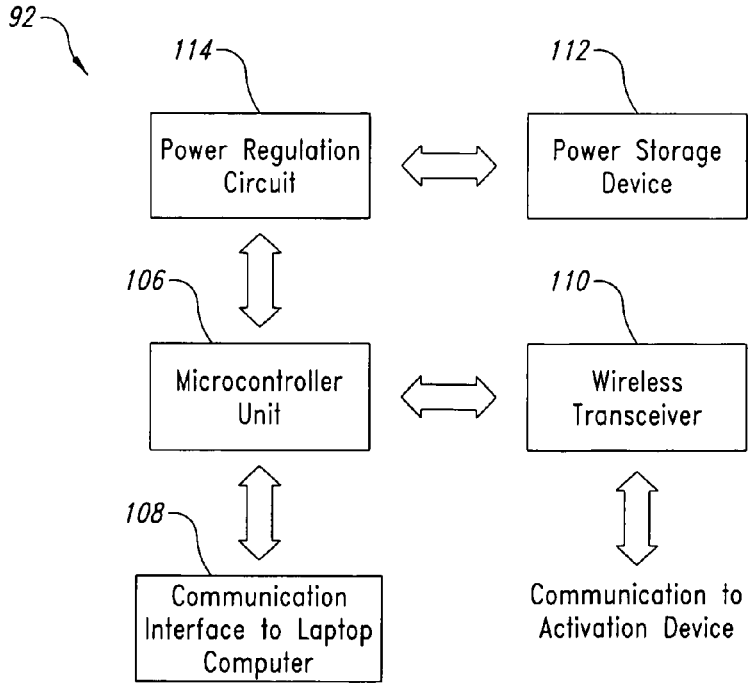
FIG. 13 is a schematic diagram of a software configuration tool according to one illustrated embodiment.

As illustrated in FIG. 13, the ST 92 comprises a microcontroller 106 such as a microprocessor, digital signal processor and/or application specific integrated circuit. The ST 92 may comprise an interface connector 108 such as a USB, RS232 serial interface, Ethernet to provide external communications between the microcontroller 106 and an external device. The ST 92 may also comprise a wireless signaling connector such as a transmitter and/or transceiver 110, to provide wireless communications between the microcontroller 106 and an external device. The ST 92 may optionally comprise a power storage device 112 and power regulation circuit 114. The power regulation circuit 114 may be similar to that illustrated in FIGS. 9A-9D, or may be any conventional power regulation circuit suitable for the specific application.

Below, are described some specific applications. Other applications will be apparent from the teachings herein.

Corner Crosswalk—uses one or more traffic visual indicator devices 24 to enable flashing of devices at the corner of a street potentially interoperating with a traffic controller. This would allow pedestrians, cyclists, or traffic controller to cue signal, warning motorists by signaling surface mounted communications devices that pedestrians and/or cyclists wish to cross intersection Transit Approach Notification—uses traffic visual indicator devices 24 that communicate with an activation device 26 located in transit vehicles 116, including bus, train, taxi, and shuttle. At the approach of the correct transit vehicle 116, an identifying image, light, and/or sound could be produced to notify potential passengers of the impending transit vehicle's approach, including approximate time of arrival and/or route identifier.

Figure 14:
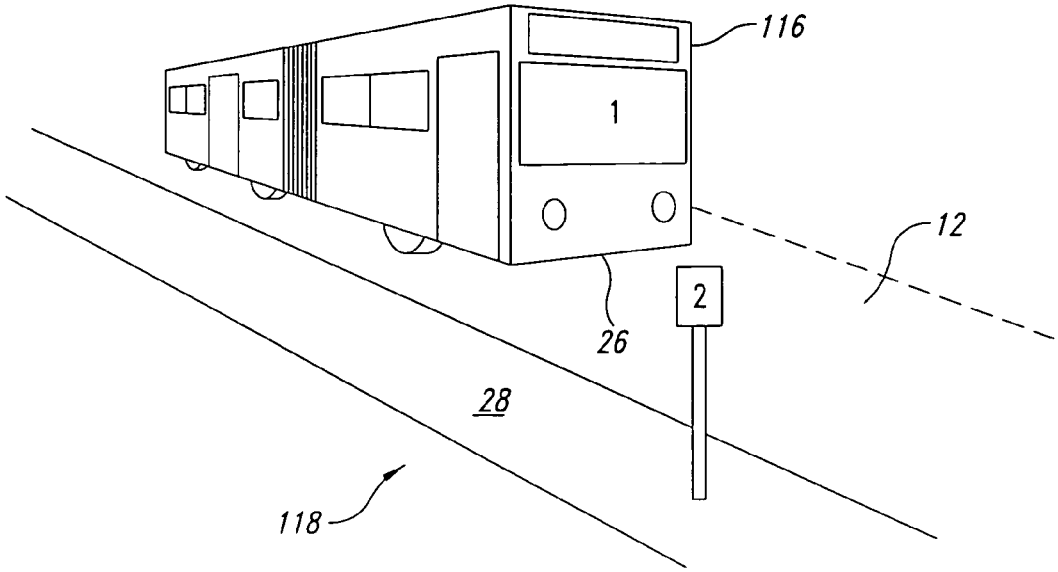
FIG. 14 is a schematic diagram of a road and a transit stop, employing traffic visual indicator devices according to one illustrated embodiment.

As shown in FIG. 14, a transit vehicle 116 carries an activation device 26. Transit vehicle operator may turn on the activation device 26 for providing advanced warning a transit stops 118 that the impending identified vehicle 116 is approaching within a certain measure of time that may be identified and relayed to traffic visual indicator devices 24.

One or more traffic visual indicator devices 24 are located in such a way and/or manner that they are readily viewable to potential transit vehicle passengers. The traffic visual indicator device(s) 24 may engage potential transit vehicle passenger via optical or audio communication, relating essential information including the time until the approach of the transit vehicle, the route ID, and/or special bus features. The passengers typically wait on a sidewalk, platform or other waiting area 28 at the transit stop 118, along side the transit surface medium such as roadway, train tracks, rail tracks, etc. 12.

Fire Hydrant Proximity Identification—uses one or more traffic visual indicator devices 24 to identify the location of water hydrants to improve ease of location for fire and/or emergency vehicles. A driver in the relating fire and/or emergency vehicle would flip a switch on a small in-vehicle transmitter that would enable surface mounted communication devices to flash and/or signal to impending vehicle within a pre-determined distance of the approach of said vehicle(s).

Figure 15:
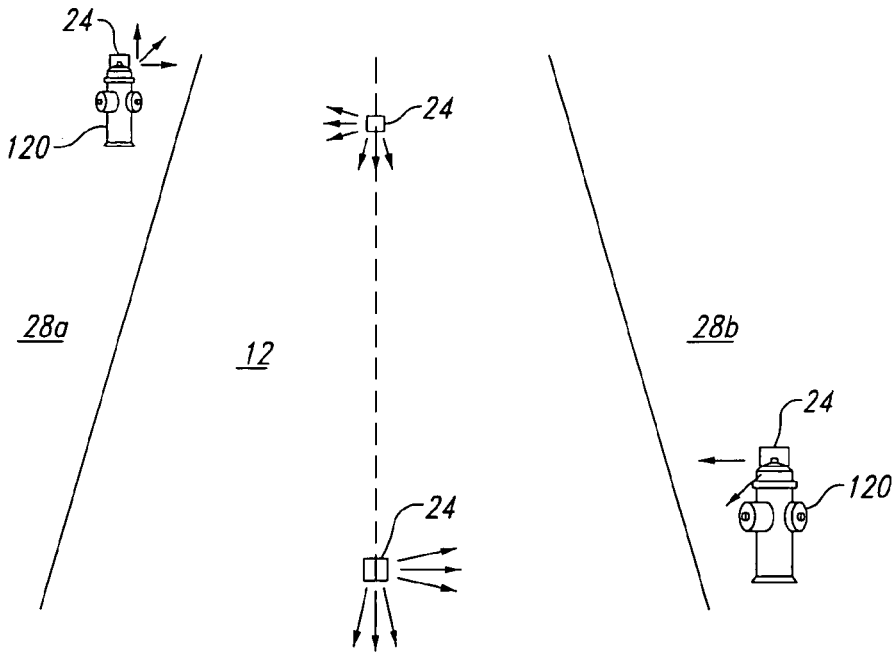
FIG. 15 is a schematic diagram of a road and hydrants, employing traffic visual indicator devices according to one illustrated embodiment.

FIG. 15 illustrates such, showing a number of traffic visual indicator devices 24 mounted on roadway 12, sidewalk 28*a*, 28*b*, and/or hydrant 120.

Notification Of Speeding—uses one or more traffic visual indicator device(s) 24 to notify motorists that their speed exceeds that of the posted limit, or notifies them that their speed exceeds that of an impending corner or road hazard. traffic visual indicator device(s) 24 may either be enabled with a sensor to detect a vehicle's speed or linked to an activation device 26 that achieves this. When a driver approaches, based on speed constraints such as exceeding speed limit, exceeding safe speed for safe navigation of a corner or hazard, etc, traffic visual indicator device(s) 24 may signal to motorist with one or more optical signaling sequences and/or methodologies allowing motorist to realize that they may need to modify their speed for their environment.

Dynamic Road Lighting—uses one or more traffic visual indicator device(s) 24 to trigger street lights base upon one or more methodologies such as with the approach of vehicles, cyclists, and/or pedestrians, by time of day, or by environmental factor such as a public or private event. For example, at the approach of a car down a roadway, traffic visual indicator device(s) 24 would activate or trigger the activation of a series of street lights that shine as the car approaches and turn to a different power state after the car leaves.

Figure 16:
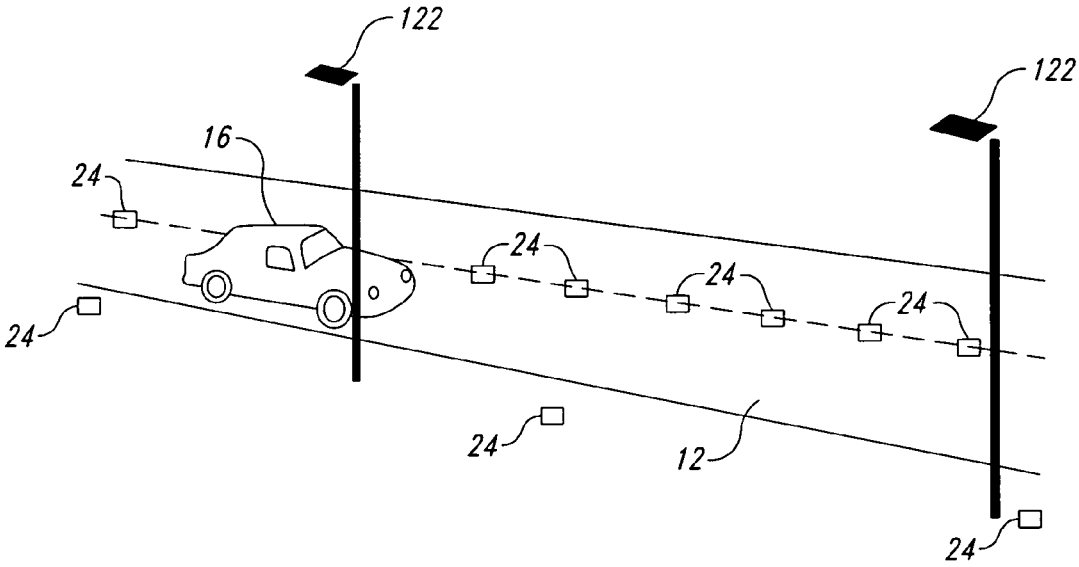
FIG. 16 is a schematic diagram of a road with overhead lighting, employing traffic visual indicator devices according to one illustrated embodiment.

FIG. 16 illustrates such a use, showing one or more traffic visual indicator devices 24 mounted along or in transit surface 12. Each traffic visual indicator device 24 either utilizes its own environmental sensor to identify the approach of a vehicle 16 or communicates with an activation device 26 either inside the approaching vehicle 16, FIG. 4, or along the vehicular path, FIG. 3. The traffic visual indicator devices 24 may utilize any number of sensory emissions including optical and/or audio. Information may also be submitted to the traffic visual indicator devices 24 (FIGS. 1 and 6) via periodic wireless transmissions from the activation devices 26, to provide updated information. This same update may also be used to provide information to an traffic visual indicator device 24 in the vehicle, FIG. 4, as it continues along the roadway, allowing it to obtain sensory information from its environment.

Lights 122 located along a road 12 may employ traffic visual indicator devices 24 to allow for wireless, dynamic communication to control lighting parameters based on the ambient conditions surrounding the lights 122. This may include time of day programming, environmental use such as proximity congestion levels, and other preprogrammed and dynamic options that may be used for a variety of purposes including saving energy and limiting energy costs to street lights. For example, the traffic visual indicator devices 24 may adjust the amount of illumination provided by the illuminations sources 42 based at least in part on the level of light in the ambient environment. The traffic visual indicator devices 24 may additionally, or alternatively adjust the amount of illumination provided by the illuminations sources 42 based at least in part a time of day and/or year. The traffic visual indicator devices 24 may additionally, or alternatively adjust the amount of illumination provided by the illuminations sources 42 based in part on power production of the power producing source 50 and/or power reserves of the power storage device $V_B$.

Additional traffic visual indicator devices 24 may additionally, or alternatively, be mounted at a side of the road for wireless and dynamic communication to control parameters surrounding the road mounted traffic visual indicator devices 24.

The road 12 may take the form of a street, highway, freeway, turnpike, bike path, train track, etc on which a moving vehicle may travel. The road 12 may have one or more traffic visual indicator device(s) 24 mounted thereto, in order to provide audio and/or optical communication and/or lighting to vehicles including pedestrians along surface.

Hazard Ahead Identification—uses one or more traffic visual indicator devices 24 to warn impending motorists, pedestrians, or cyclists of potentially hazardous changes, including raised medians, changes in the road's surface and/or the road's direction, such as curves and corners, and intersections with one or more transit type. By using wireless signaling within each device or through communication of a advanced warning notification device, each device dynamically identifies the approach of vehicles, cyclists, and/or pedestrians and displays surface mounted communication warning to them of the potential impending hazard. Similar to the example regarding notification of speed, traffic visual indicator devices 24 may contain their own sensor or be linked to an activation device 26 with a sensor that identifies the approach of a vehicle. As the vehicle approaches, optical and/or audio communication increases the perception of each motorist, pedestrian, cyclist, etc to the hazard ahead.

Figure 17:
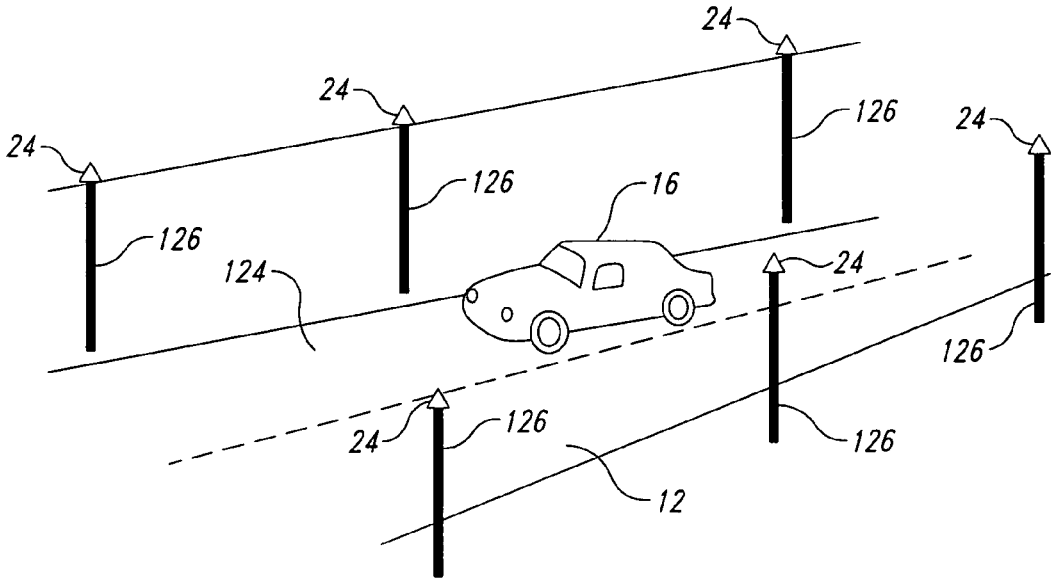
FIG. 17 is a schematic diagram of road including an obstruction such as snow, employing traffic visual indicator devices according to one illustrated embodiment.

Icy Road Condition Beacon—uses one or more traffic visual indicator devices 24 placed on a pole, such as existing snow-depth poles, road signs, or feature specific poles at the side of or above the road to warn impending motorists of freezing temperatures and subsequently hazardous road conditions FIG. 17 shows such a use, showing a vehicle 16 approaching an obstruction 124 such as snow and/or a snow bank where snow has been plowed.

One or more traffic visual indicator devices 24 sitting on top of a pole, sign, or other object 126 that enables improved detection by motorist. Each traffic visual indicator device 24 may include a temperature sensor that notifies impending motorist of poor road conditions. Different flash cycles and patterns, colors, and/or visual display may be used to identify one or more road conditions. For example one methodology may be used for temperatures just above freezing, another for right around freezing, one for well below freezing, and one for normal and/or safe driving conditions. In seeing the traffic visual indicator devices 24 flash one or more colors or display the temperature and or other impending road conditions, motorists may be kept aware of dynamic road conditions.

Emergency Turnout Identification—uses one or more traffic visual indicator devices 24 to identify areas in the roadway where police and/or emergency vehicles may turn-around and cross-over to opposite directions or additional roads linking freeways. Vehicles equipped with a special transmitter (activation device 26) would flip a switch that would identify emergency turnouts along freeways, allowing them to turn around and/or cross over to the opposite side of a closed shoulder freeway.

Figure 18:
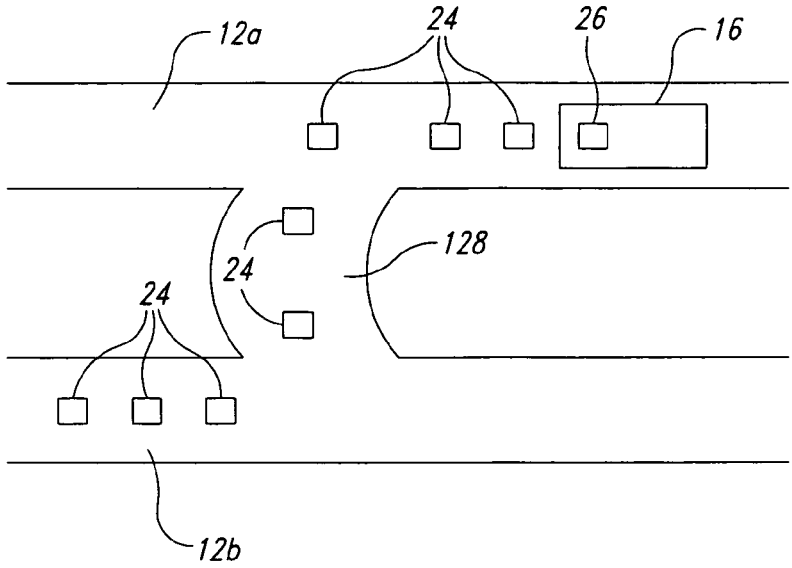
FIG. 18 is a schematic diagram of a two roads carrying traffic in generally opposed directions and a turnaround road or area, employing traffic visual indicator devices according to one illustrated embodiment.

FIG. 18 illustrates such a use, showing a road 12*a* carrying traffic in a first direction, a road 12*b* carrying traffic in the opposite direction, and a turn around road or area 12*c* connecting the roads 12*a*, 12*b*. A vehicle 16 approaches along the road 12*a*, and desires to turn around onto road 12*b*. If the vehicle is authorized to use the turn around road or area 12*c*, the vehicle may carry an activation device 26 which may employ security measures to prevent activation by unauthorized users, or which may be issued only to authorized users. Traffic visual indicator devices 24 are located along both road 12*a*, 12*b*, ways as well as at the turn around road or area 12*c*.

Roadway Exit Identification—uses one or more traffic visual indicator devices 24 to identify exits along a roadway for police, emergency vehicles, or general traffic. For emergency use, vehicles would be equipped with a small transmitter (activation device 26) with a switch that would be flipped to identify intersecting roadways and/or turnouts. For public or commercial use, there would be a motion detector that would communicate with said surface mounted communications device, or each surface mounted communications device would detect the proximity of an approaching vehicle prior to its subsequent flashing and communication.

Shared Lane Flow Identification—uses traffic visual indicator devices 24 along roadway to identify change of shared traffic lane(s), giving transition to direction of predominant traffic based upon commute time, road hazard, dynamic traffic volume indicator, or traffic cycle. This could be used on any joined, roadway seeking to maximize flows through high volume areas, including use on bridges, carpool or special lanes, and tunnels. Surface mounted traffic visual indicator devices 24 would flash green to one traffic direction and red to the other, able to change based upon a variety of factors including time of day, day of year, or override notification from a central or remote station for change in cycle due to accident, emergency, or other temporary and permanent reason.

Figure 19:
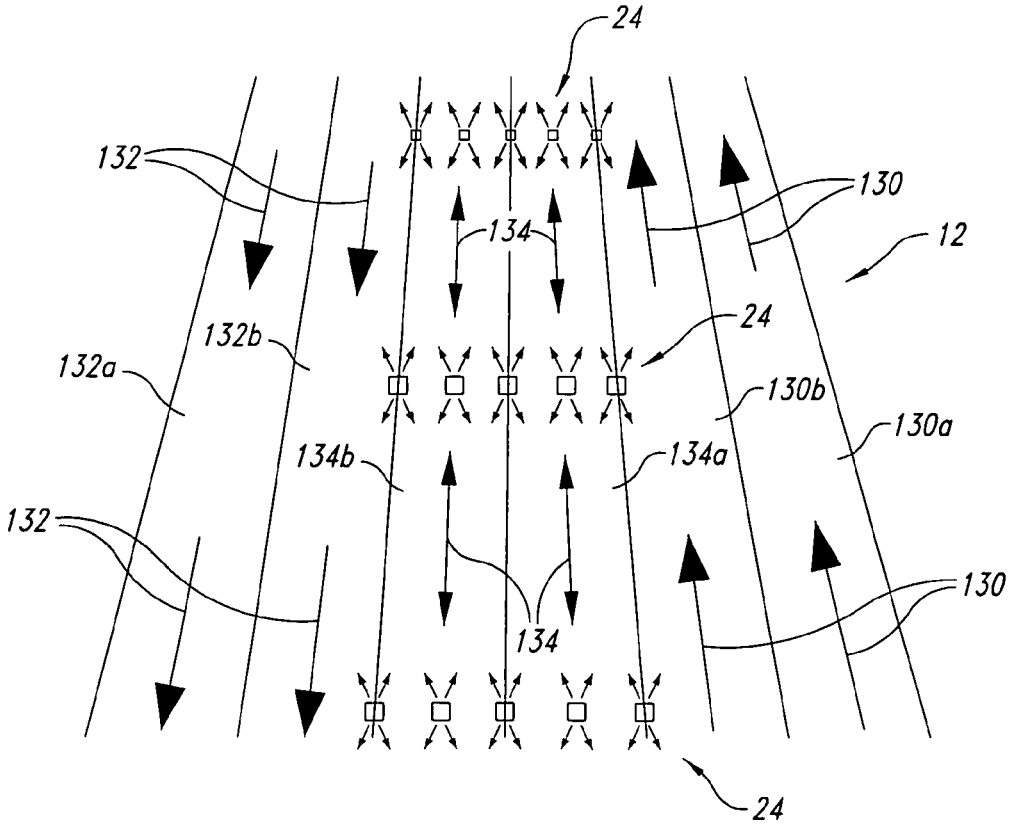
FIG. 19 is a schematic diagram of a six lane road, including a number of reversible lanes, employing traffic visual indicator devices according to one illustrated embodiment.

FIG. 19 illustrates such a use showing a road 12 comprising six lanes for traffic. Two of the lanes 130*a*, 130*b* are dedicated to traffic traveling in a first direction indicated by arrows 130, while another two lanes are dedicated to traffic traveling in a second direction indicated by arrows 132, generally opposed to the first direction. Finally, two lanes 134*a*, 134*b*, are reversible, allowing traffic to flow in the first or the second directions as indicated by double headed arrows 134. The two reversible lanes have traffic visual indicator devices 24 mounted there-along. The embedded into them based on a variety of constraints such as time of day, traffic volume, accidents, etc.

Dual-sided traffic visual indicator devices 24 (e.g., FIG. 3) are mounted in lanes 134*a*, 134*b* to provide optical emissions in order to notify motorists on the lane's proper direction or flow. For example, one side of the traffic visual indicator devices 24 may show red, with the other side green. At times when there may be a change, there could be a period of yellow before reversing to green and red, respectively. Each lane of traffic visual indicator devices 24 could be controlled individually. In this example, three lanes could be used for both directions simultaneously. For example, lanes 130*a*, 130*b*, and 134*a* in direction indicated by arrow 130, and lanes 132*a*, 132*b*, and 134*b* in direction indicated by arrow 132. Alternatively, four lanes could be used for travel in any one direction, with two lanes reserved for travel in the opposite direction. For example, lanes 130*a*, 130*b*, 134*a* and 134*b* for travel in the direction indicated by arrow 130 and lanes 132*a*, 132*b* for travel in the direction indicated by arrow 132. Alternatively, lanes 132*a*, 132*b*, 134*a* and 134*b* for travel in the direction indicated by arrow 132 and lanes 130*a*, 130*b* for travel in the direction indicated by arrow 130. Each traffic visual indicator device 24 could hold its own commands or be controlled by an activation device 26 which could either be located periodically along the roadway, or at specific locations.

Figure 20:
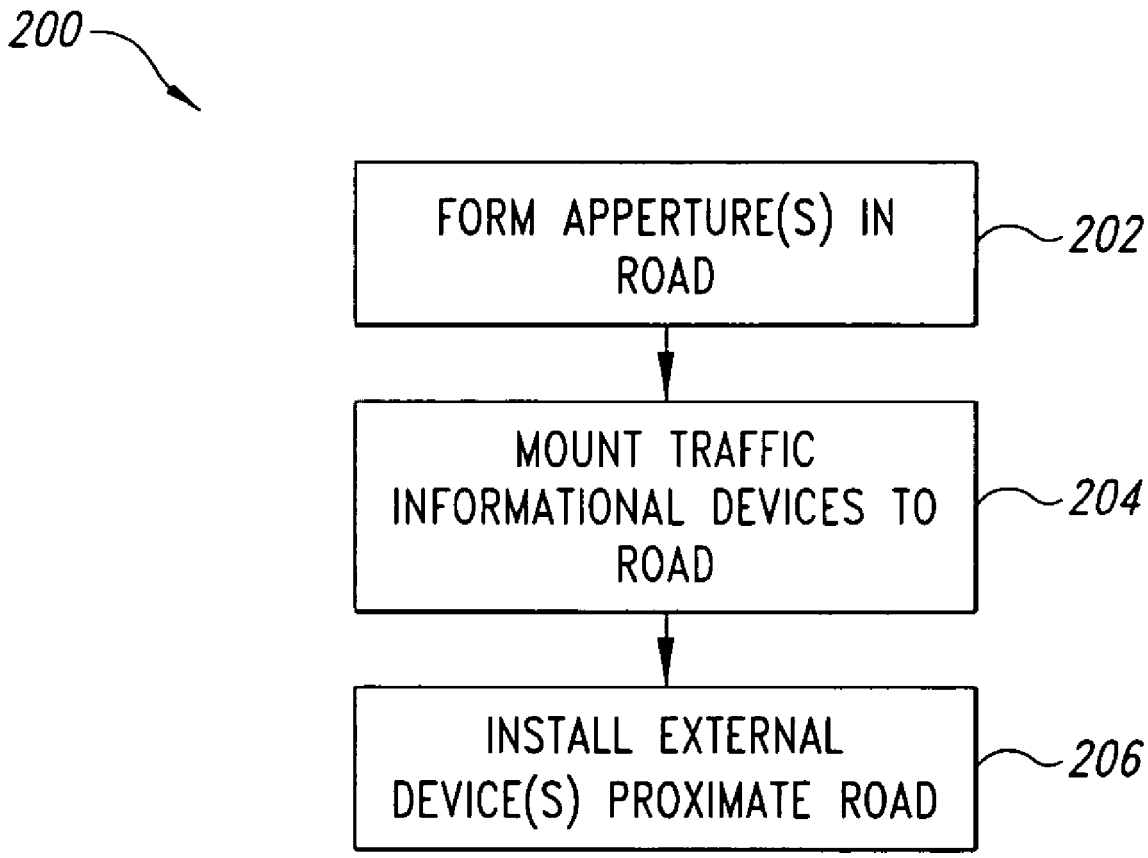
FIG. 20 is a flowchart showing a method of installing a traffic visual indicator device on a road, according to one illustrated embodiment.

FIG. 20 shows a method 200 of installing traffic visual indicator devices 24 in a road 12, according to one illustrated embodiment.

At 202, one or more channels or apertures are formed in the road 12. At 204, one or more traffic visual indicator devices 24 are mounted in the apertures formed in the road 12. The apertures may be formed by saw-cutting, coring, or other methods. Where an anchoring mechanism 58 is employed, the anchoring mechanism 58 is first mounted to the road 12 using any variety of methods, for example a friction fit, adhesive, and/or fasteners. The housing 34 is then secured by the base 36 to the base plate 60 of the anchoring mechanism 58. At 206, the actuator devices 26 are installed proximate the road 12.

Figure 21:
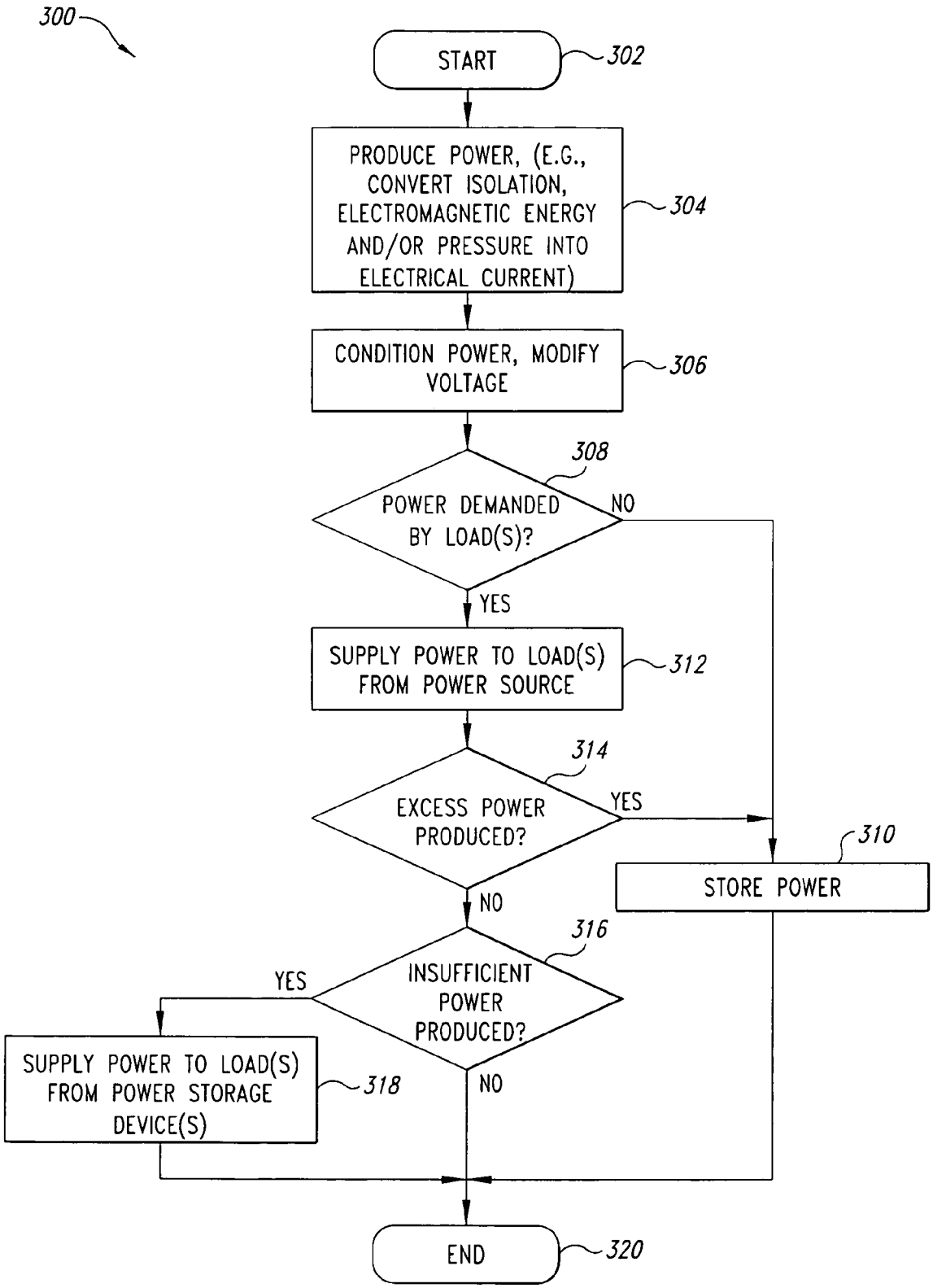
FIG. 21 is a flowchart showing a high level method of operating a traffic visual indicator device, according to one illustrated embodiment.

FIG. 21 shows a method 300 of operating the traffic visual indicator devices 24, according to one illustrated embodiment starting at 302.

At 304, the power producing source 50 produces power. At 306, the power conversion circuitry conditions the power, for example by modifying a voltage of the power. At 308, the circuitry determines whether power is demanded by one or more loads (e.g., illumination sources 42*a*). If no loads are demanding power, the power is stored in the power storage device $V_B$ at 310. If one or more loads demand power, power is supplied to the loads from the power producing source at 312.

At 314, the circuitry determines whether excess power is being produced. If excess power is being produced, the excess power is stored to the power storage device $V_B$ at 310. If excess power is not being produced, the circuitry determines whether insufficient power is being produced at 316. If insufficient power is being produced, then power is supplied from one or more of the power storage devices $V_B$ at 318. The method 300 terminates at 320.

Figure 22:
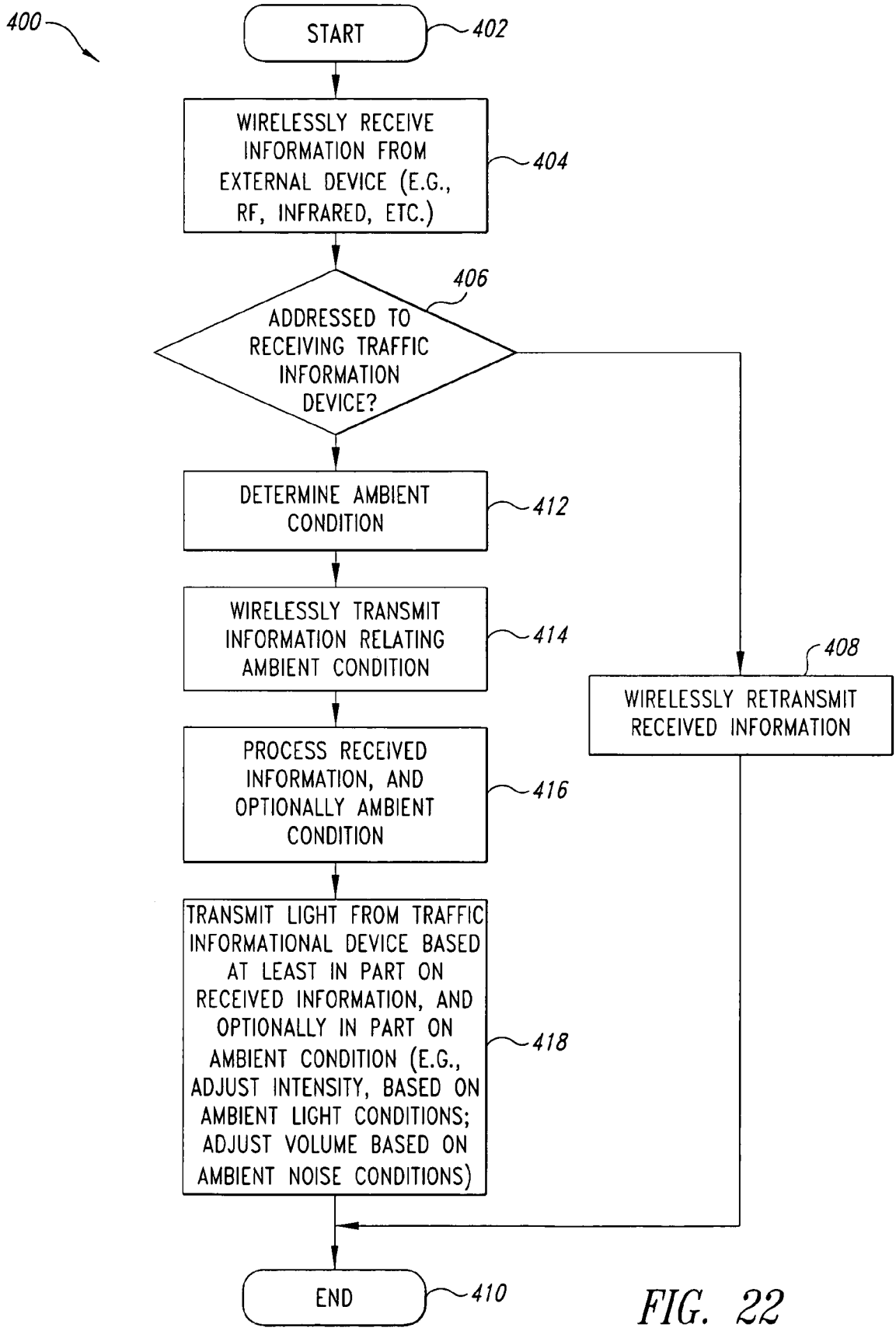
FIG. 22 is a flowchart showing a method of low level method of operating a traffic visual indicator device to wirelessly receive and/or transmit information, according to one illustrated embodiment.

FIG. 22 shows a method 400 of operating the traffic visual indicator devices 24 according to one illustrated embodiment starting at 402.

At 404, the traffic visual indicator device 24 wirelessly receives information from an external device, such as one or more of the activation devices 26. Wireless information may be received via radio frequency transmissions or via light transmissions, such as via infrared transmissions. At 406, each of the traffic visual indicator device 24 determines whether the wireless information is addressed to the particular traffic visual indicator device 24 receiving the wireless information, for example by determining whether the information includes a unique identifier that identifies the particular traffic visual indicator device 24.

If the wireless information is not addressed to the particular traffic visual indicator device 24, the traffic visual indicator device 24 may optionally wirelessly retransmit the received information at 408, and terminate the method 400 at 410. Otherwise, control passes to 412.

Optionally at 412, one or more sensors determine a condition of the ambient environment. Optional conditions may include precipitation, temperature, pressure, light levels, seismic, visual or acoustical information. Optionally, the traffic visual indicator device 24 wirelessly transmits the information regarding the ambient condition at 414.

At 416, the traffic visual indicator device 24 processes the received information, and optionally the ambient condition information. At 418, the traffic visual indicator device 24 activates the illuminations sources 42*a* based at least in part on the received information to transmit a visual signal toward approaching traffic. The traffic visual indicator device 24 may also base the activation of the illuminations sources 42*a* at least in part on the ambient conditions. For example, the traffic visual indicator device 24 may adjust an intensity of the light based on ambient light conditions, or may adjust the volume of sound based on ambient noise conditions.

Figure 23:
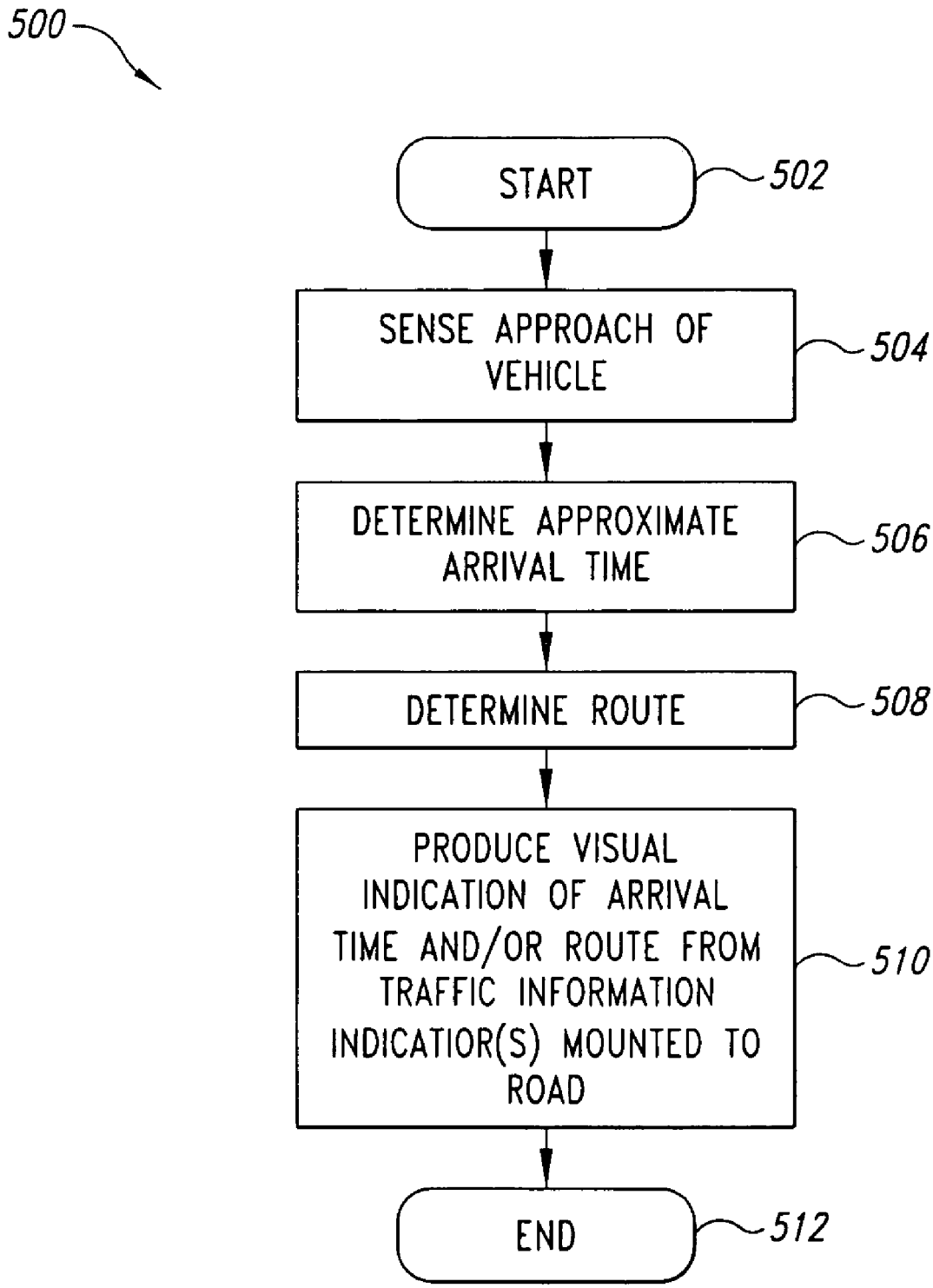
FIG. 23 is a flowchart showing a method of operating a traffic information system to detect and announce the arrival of a vehicle, for example a public transportation vehicle, according to one illustrated embodiment.

FIG. 23 shows a method 500 of operating a traffic information system 22 according to one illustrated embodiment starting at 502.

At 504, a portion of the traffic information system 22, for example the traffic visual indicator device 24, senses the approach of a vehicle such as a public transit vehicle or taxi. At 506, the traffic information system 22 determines an approximate arrival time for the vehicle. Optionally, at 508, the traffic information system 22 determines a route of the vehicle. At 510, the traffic visual indicator devices 24 produce visual indications of the arrival time and/or route of the vehicle. The method 500 terminates at 512.

Figure 24:
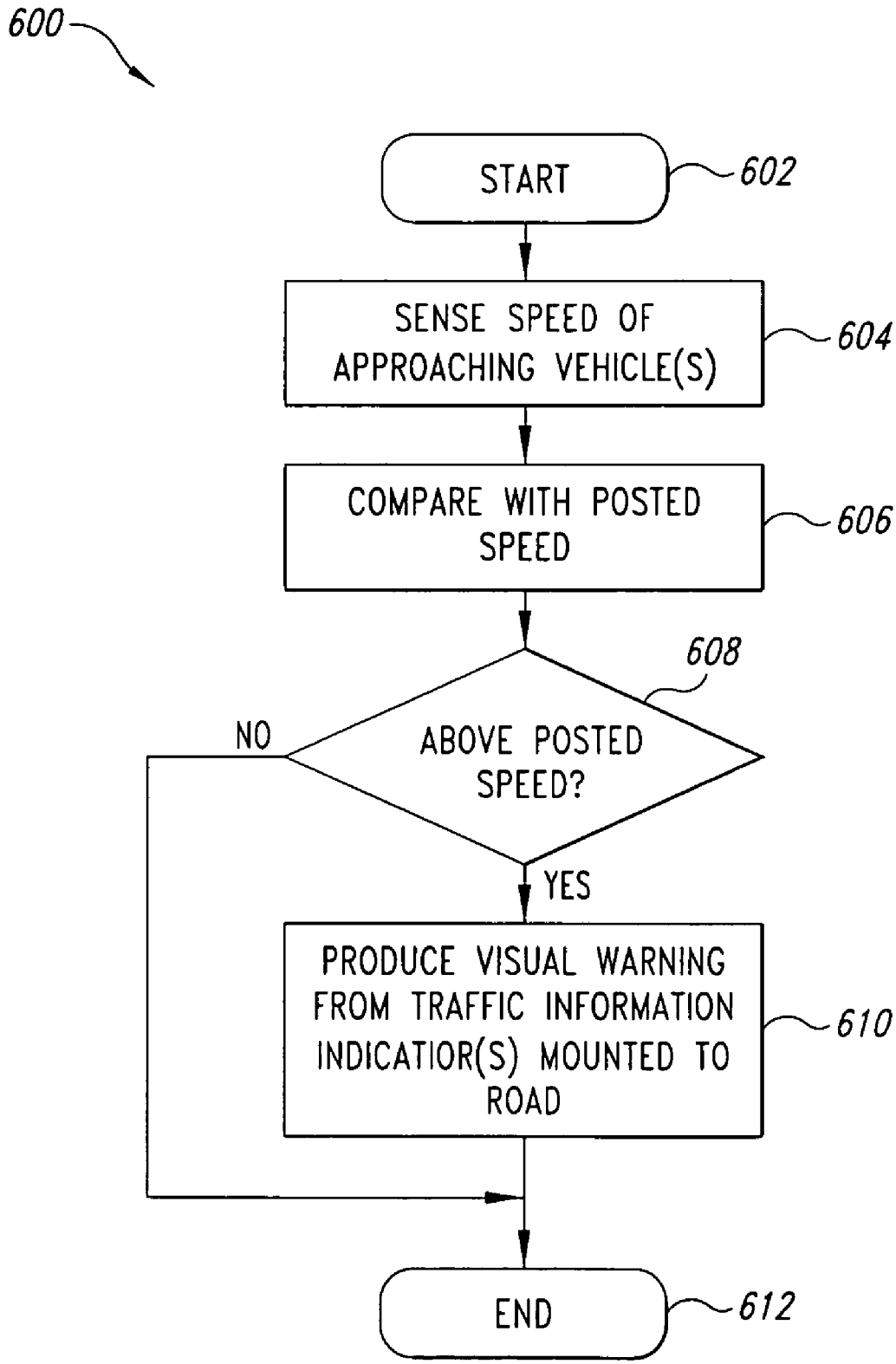
FIG. 24 is a flowchart showing a method of operating a traffic information system to detect and announce a speed of one or more vehicles, according to one illustrated embodiment.

FIG. 24 shows a method 600 of operating the traffic information system 22 starting at 602.

At 604, a portion of the traffic information system 22, for example the traffic visual indicator devices 24, senses the speed of one or more approaching vehicles. At 606, a portion of the traffic information system 22, for example the traffic visual indicator device 24, optionally compares the sensed speed with a posted speed. At 608, the traffic information system 22 optionally determines whether the sensed speed is above the posted speed. If the sensed speed is above the posted speed, at 610, the traffic visual indicator devices 24 activate the illuminations sources 42*a* to produce a visual warning to the approaching traffic. Alternatively, the traffic visual indicator devices 24 may activate the illuminations sources 42*a* to produce a visual warning to the approaching traffic without regard to whether the sensed speed in above or below the posted speed. The method 600 terminates at 612.

Figure 25:
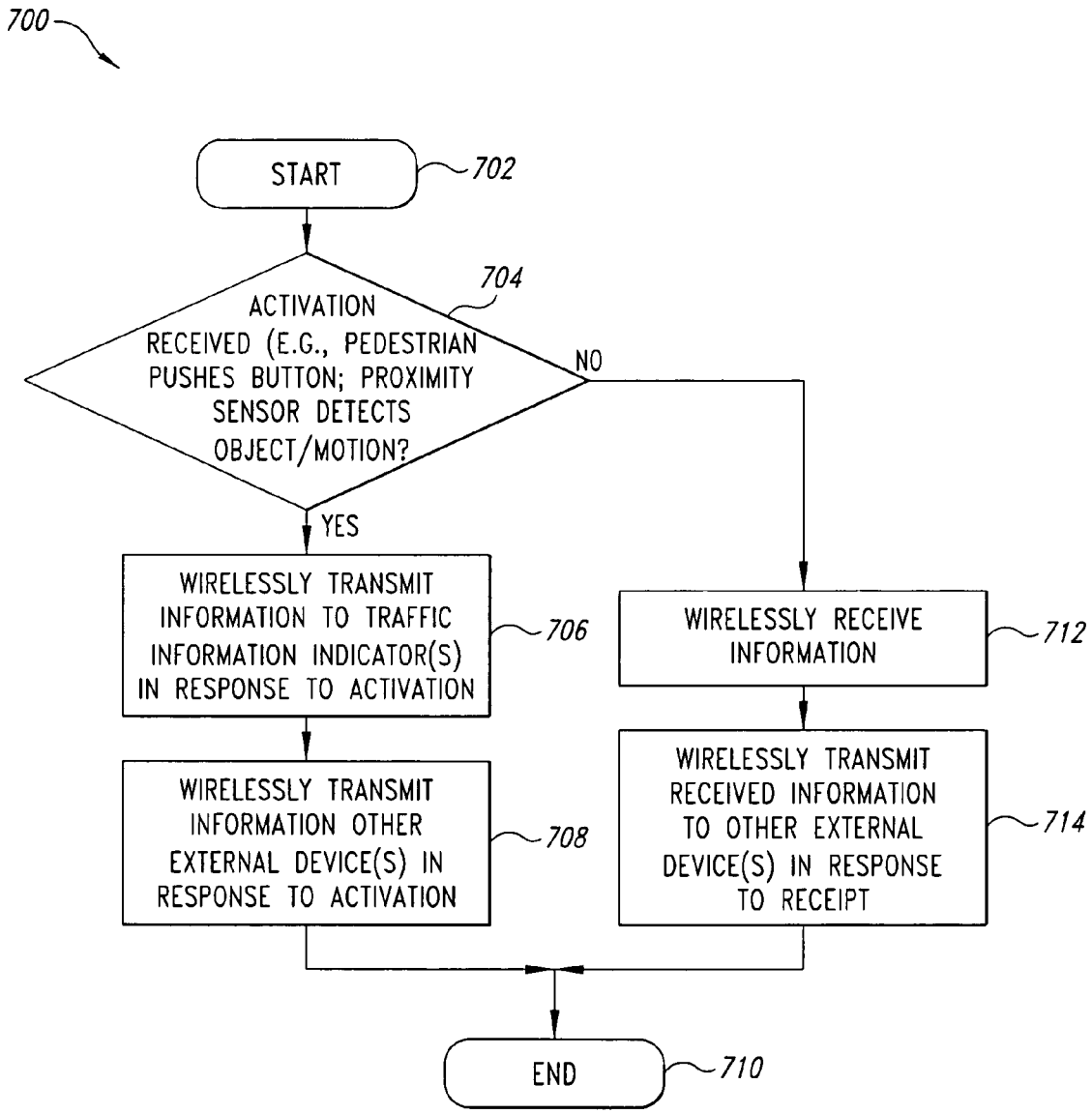
FIG. 25 is a flowchart showing a method of operating an activation device, according to one illustrated embodiment.

FIG. 25 shows a method 700 of operating an activation device 26 according to one illustrated embodiment, started at 702.

At 704, the activation device determines whether an activation has been received. For example, activation device determines whether a pedestrian has pushed a button, or whether a proximity sensor has detected an object or motion.

If activation is received, the activation device 26 wirelessly transmits information to the traffic visual indicator devices 24 at 706. At 708, the activation devices 26 optionally wirelessly transmit information to other activation devices 26 and the method 700 terminates at 710.

If an activation is not received at 704, then the activation device 26 determines whether information has been wirelessly received at 712. Optionally at 714, the activation device 26 may wirelessly retransmit received information to other activation devices 26.

Airport Traffic Flow—uses traffic visual indicator devices 24 on airport runways and on airport tarmacs for vehicular flow assistance. Rather than wiring lights, surface mounted communications devices would identify transit patterns for planes and airport vehicles. With a small wireless transmitter or controller in vehicles, lighting colors and impending permissions would change, giving right-of-way and navigational guidelines.

Children/Elderly/Handicap Present Notification—uses one or more is traffic visual indicator devices 24 along roadway and/or sidewalk to warn motorists that children, the elderly, and/or handicapped individuals are present. These traffic visual indicator devices 24 would be used in front of a school during opening and closing, at or near a playground and park, in front of a retirement home, etc); each would be pre-programmed by time of day and day of year or by the approach of vehicle, bicyclist, or pedestrian.

Vehicle Exit/Approach Warning—uses one or more traffic visual indicator devices 24 to warn pedestrians crossing in front of where the exit of a parking garage enters the street, that a vehicle is emerging from a parking garage. This would also include warning pedestrians, cyclists, and motorists that an emergency vehicle, such as a fire, ambulance, paramedic, or service vehicle is leaving/approaching a fire station, hospital, etc or traveling a path that would benefit by dynamic roadway lighting such as a service or emergency vehicle in a concentrated pedestrian area. There would be an auto sensor in each surface mounted traffic visual indicator device 24 or a sensor that would communicate with each traffic visual indicator device 24 in the example of the parking garage or related application and structure, while there could be a switch with a small wireless controller in each emergency vehicle or a controller with related switch in each related building that a person would use prior to leaving/approaching said related locality.

Pre-empter Trigger—uses one or more traffic visual indicator devices 24 to receive communication from a traffic controller at the approach of an on-call emergency vehicle using a pre-empter to proceed through a traffic signal. Currently emergency vehicles use audio signaling which oftentimes does not identify their locality or proximity. By tying communication to surface mounted traffic visual indicator devices 24 to a controller inserted into an existing traffic controller and placing said devices along roadway, sidewalks, and along the sides of buildings and/or traffic signs and roadway poles, pedestrians and motorists may see that an impending emergency vehicle approaches them, and the direction with which it comes. This would allow them to move over to the side of the roadway, possibly saving the emergency vehicle time getting through the intersection, which could possibly save lives and/or property.

National/Local Emergency Notification—uses one or more traffic visual indicator devices 24 to inform pedestrians, motorists, and the general public about a state of emergency or issue of national importance. Similar to the Emergency Broadcast Network found on both television and radio, this would enable the government to convey a message to the mass population who are in urban centers and along the roadway. While a particular color could be used, devices could also issue a pre-recorded or real-time audio message, as well as be used to project an image, picture, or video along a wall, sign, or building.

Crosswalk Time Notification—uses one or more traffic visual indicator devices 24 to warn pedestrians of the amount of time left before the crosswalk signal ends. This could be used in conjunction with surface mounted communications lighting or independently to provide audio notification of the time left on a crosswalk signal or for notification that it is okay to cross the roadway. Each traffic visual indicator device 24 would be used in conjunction with a signaling transmitter, which could be placed inside each said device or used in conjunction with another device, including a push-button or bollard with wireless detector.

Crosswalk Directional Navigation—uses one or more traffic visual indicator devices 24 to assist vision impaired pedestrians navigate across a crosswalk or intersection through audio emissions Instruction Device—uses one or more surface mounted traffic visual indicator devices 24 to provide instructions to people at locations of public and private interest such as historical spots, museums, parks, zoos, public buildings, etc. At the approach of a person or by pushing an activation device such as a button, or by stepping on the surface mounted communications device, a pre-recorded or real-time audio message may be played.

Handicapped Hazard Notification—uses one or more traffic visual indicator devices 24 to auto-sense the approach of handicapped pedestrians and warn of curb, door, wall, stairs, etc.

National/Local Emergency Notification—similar to above, uses one or more traffic visual indicator devices 24 to deliver audio messages and/or real-time dialogue to pedestrians and/or general public regarding information of local, regional, or national concern Corridor Traffic Counter—uses one or more traffic visual indicator devices 24 to identify traffic volumes along any given lane (place several to determine volumes along any given roadway). This may be via one or more sensory methodologies such as magnetic or infrared detection.

Navigation Identification—uses one or more traffic visual indicator devices 24 to record movement and location, and/or transit pattern of tagged vehicles, people, or animals, for use in closed environments such as prisons, military bases, or corporate campuses or for open environments of public vehicles along roadways, or persons in cities or buildings.

Environmental Identification—uses one or more traffic visual indicator devices 24 to record and/or send temperature and/or other environmental details such as humidity, or composition of air quality of geographic locality to remote location or store internally for remote uplink Seismic Transponder—uses one or more traffic visual indicator devices 24 to sense seismic activity along a surface area, to record, triangulate, and/or store and transmit related data. By having sensors along the stem of each traffic visual indicator devices 24, they may record geographic forces such as earth movements and other geographic shocks. This information may be recorded and stored or sent.

Stoplight Trigger—uses one or more traffic visual indicator devices 24 to sense the approach of a vehicle through either magnetic or motion detection, such as radar, infrared or an optical sensor. Rather than digging up roadway to install and wire a magnetic sensor, traffic visual indicator device 24 may be used to wirelessly transmit the approach of a vehicle to the traffic control box, resulting in the appropriate change of the stoplight lighting signal.

Figure 26:
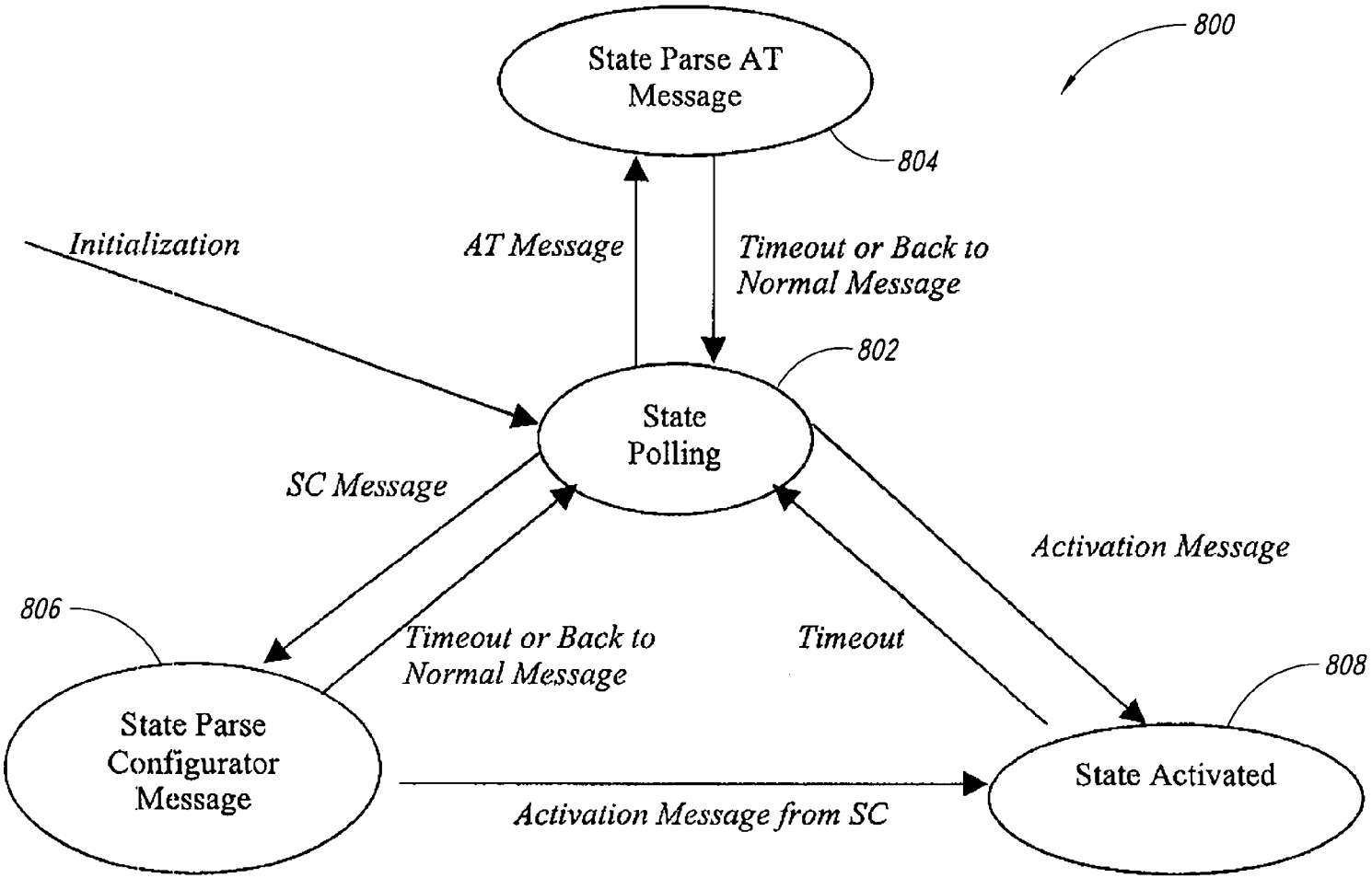
FIG. 26 is a schematic diagram of an overall state machine implementing the functionality of a traffic visual indicator device of a traffic information system, according to one illustrated embodiment.

FIG. 26 shows an overall state machine 800 implementing the traffic information system 22, according to one illustrated embodiment. The states include: polling 802, parsing an activation message 804, parsing a configurator message 806, and activated 808, with acceptable transitions between the states defined by the arrows.

Figure 27:
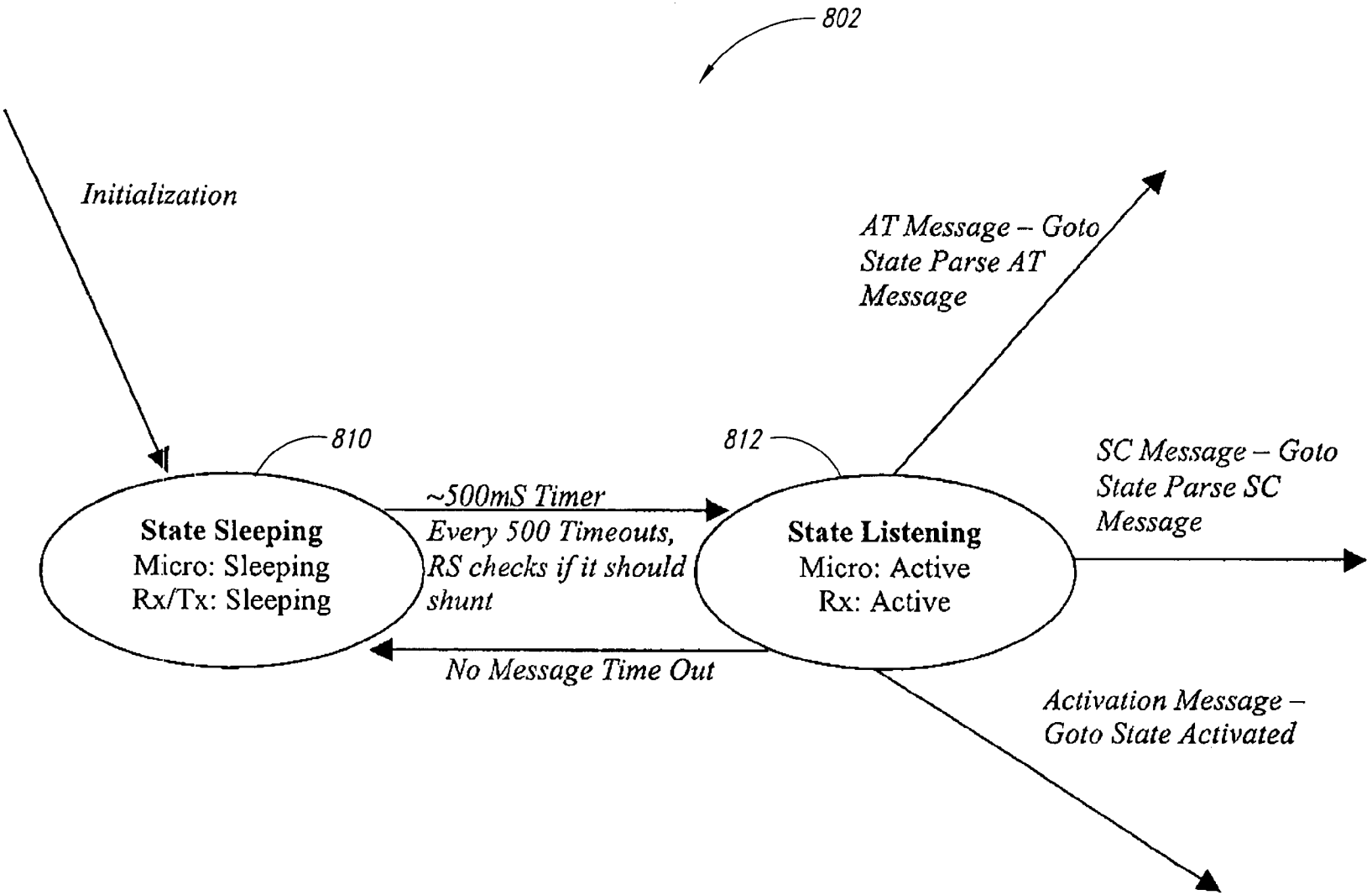
FIG. 27 is a schematic diagram of a state machine implementing a polling state of the state machine of FIG. 26, according to one illustrated embodiment.

FIG. 27 shows a state machine implementing the polling state 802 (FIG. 26) in the traffic information system, according to one illustrated embodiment. The states include a sleeping state 810 and a listening state 812, with acceptable transitions between the states defined by the arrows.

Figure 28:
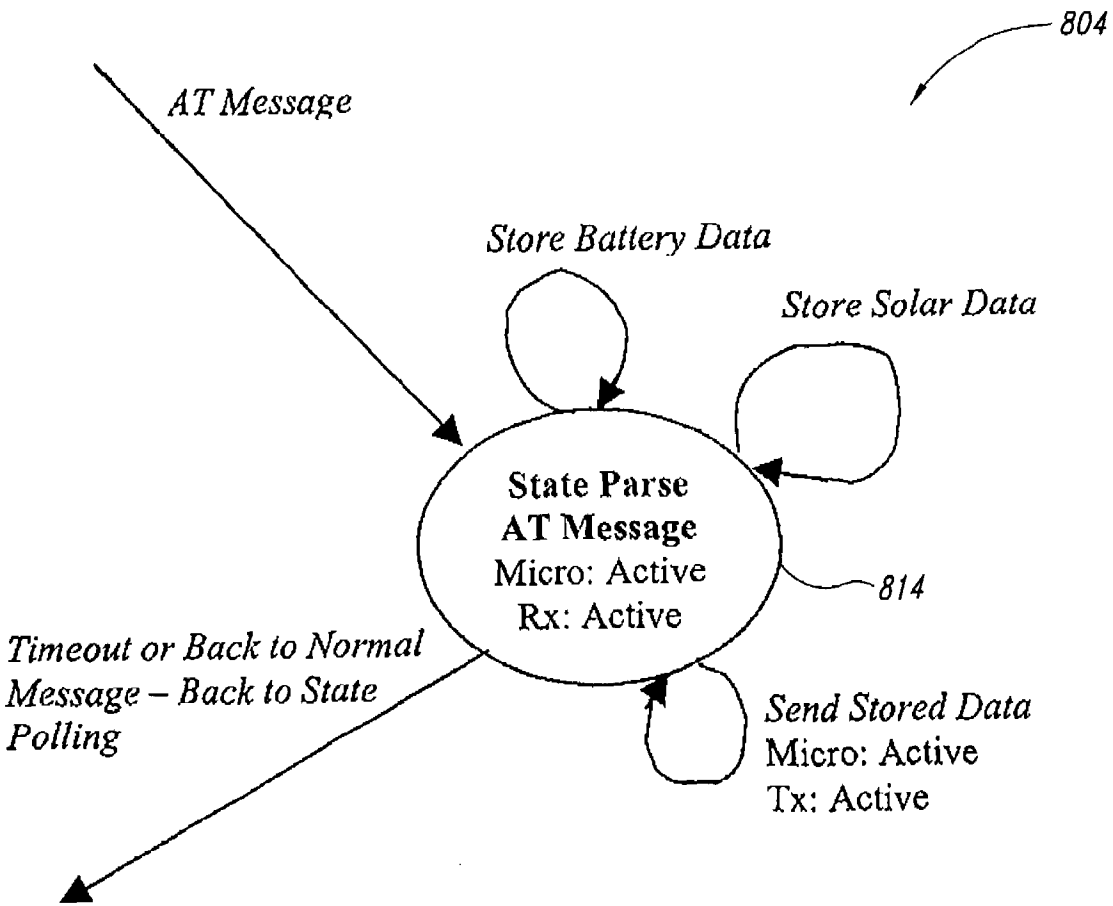
FIG. 28 is a schematic diagram of a state machine implementing an activation message parsing state of the state machine of FIG. 26 to parse an activation message received from an activation device, according to one illustrated embodiment.

FIG. 28 shows a state machine implementing the parsing an activation message state 804 (FIG. 26), according to one illustrated embodiment. The states include parsing the message 814, with acceptable transitions into an out of the state defined by the arrows.

Figure 29:
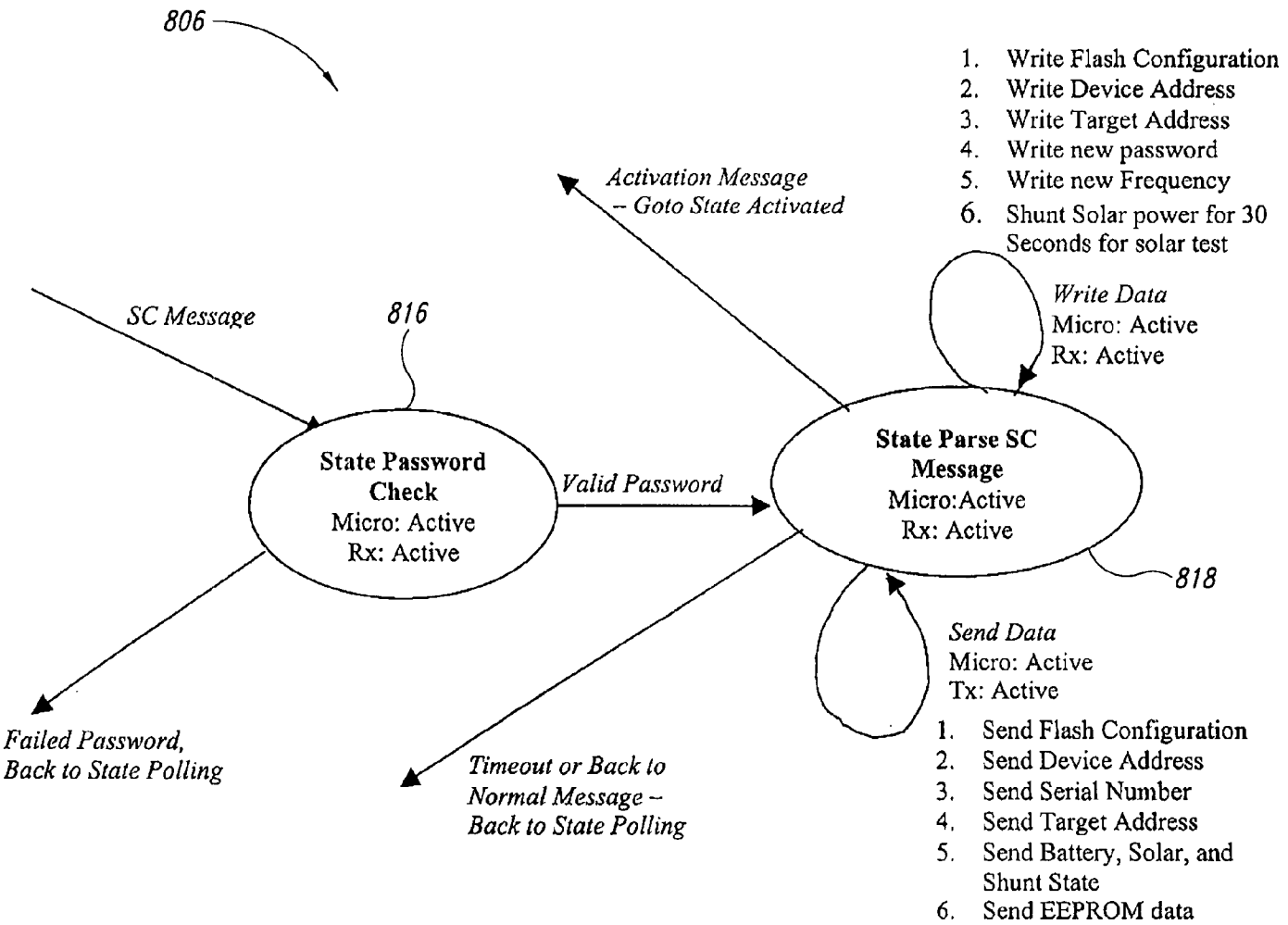
FIG. 29 is a schematic diagram of a state machine implementing a configuration message parsing state of the state machine of FIG. 26 to parse a configuration message received from another traffic visual indication device, according to one illustrated embodiment.

FIG. 29 shows a state machine implementing the parsing an configurator message 806 (FIG. 26), according to one illustrated embodiment. The states include password checking 816 and parsing of the message 818, with acceptable transitions between the states defined by the arrows.

Figure 30:
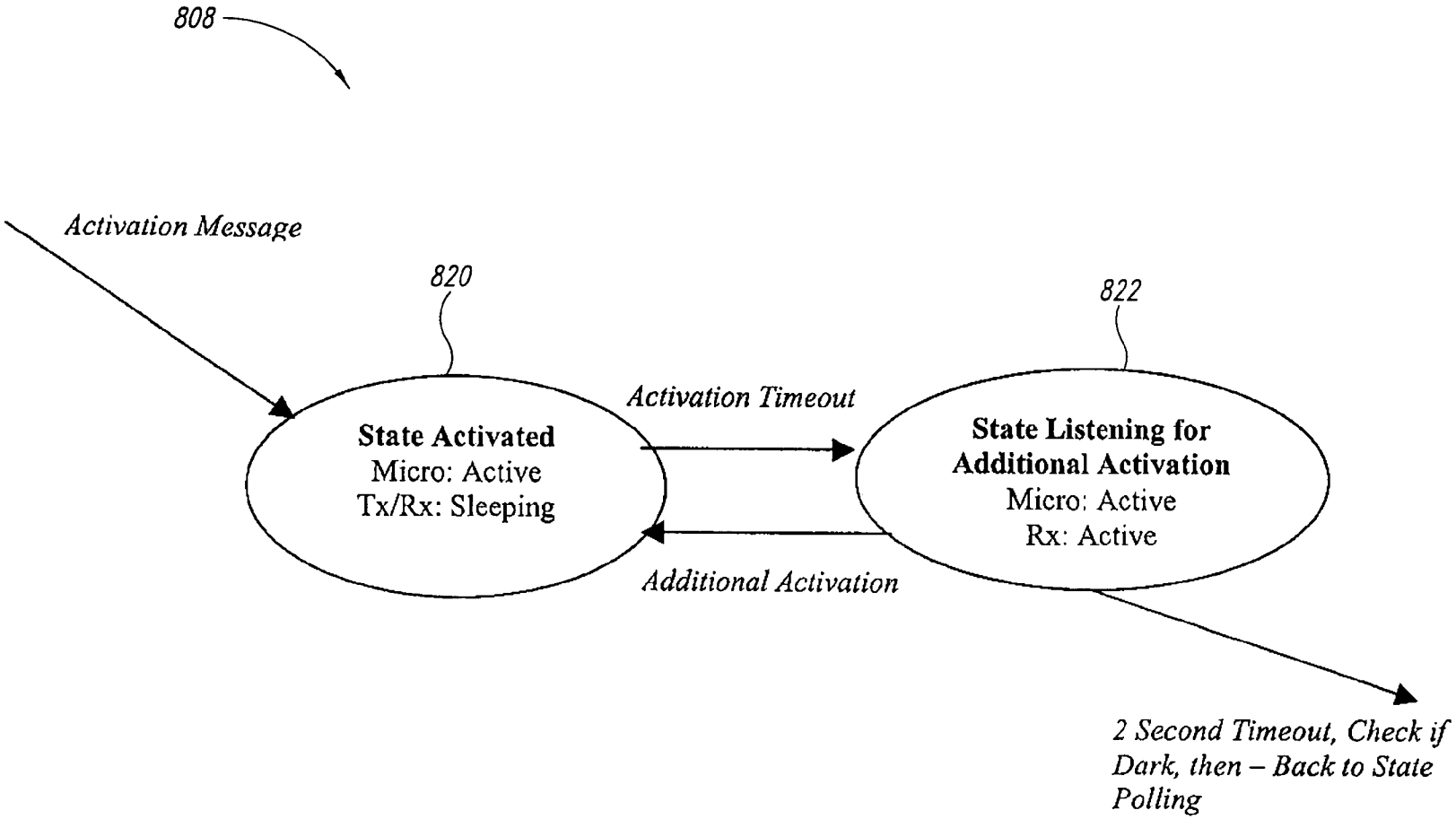
FIG. 30 is a schematic diagram of a state machine implementing an activated state of the state machine of FIG. 26, according to one illustrated embodiment.

FIG. 30 shows a state machine implementing the activated state 808 (FIG. 26), according to one illustrated embodiment. The states include an activated state 820 and a listening for additional activation state 822, with acceptable transitions between the states defined by the arrows.

Figure 32:
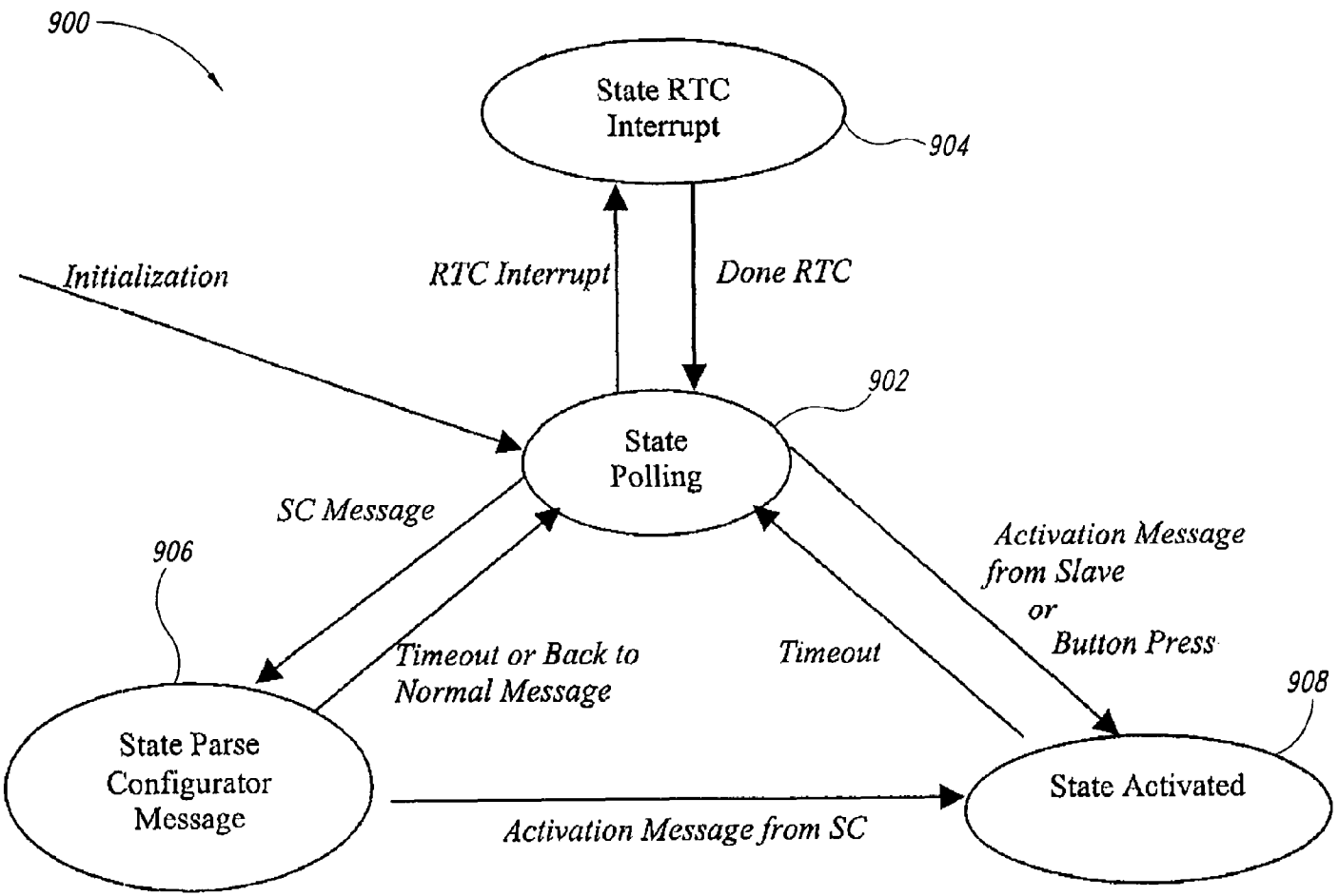
FIG. 32 is a schematic diagram of an overall state machine implementing the functionality of a master activation device of a traffic information system, according to one illustrated embodiment.

FIG. 32 shows an overall state machine 900 implementing the functionality of a master activation device 26 of a traffic information system 22, according to one illustrated embodiment. The states include a polling state 902, an RTC (i.e., real time clock) interrupt state 904, a parsing configurator message state 906, and an activated state 908, with acceptable transitions between the states defined by the arrows.

Figure 33:
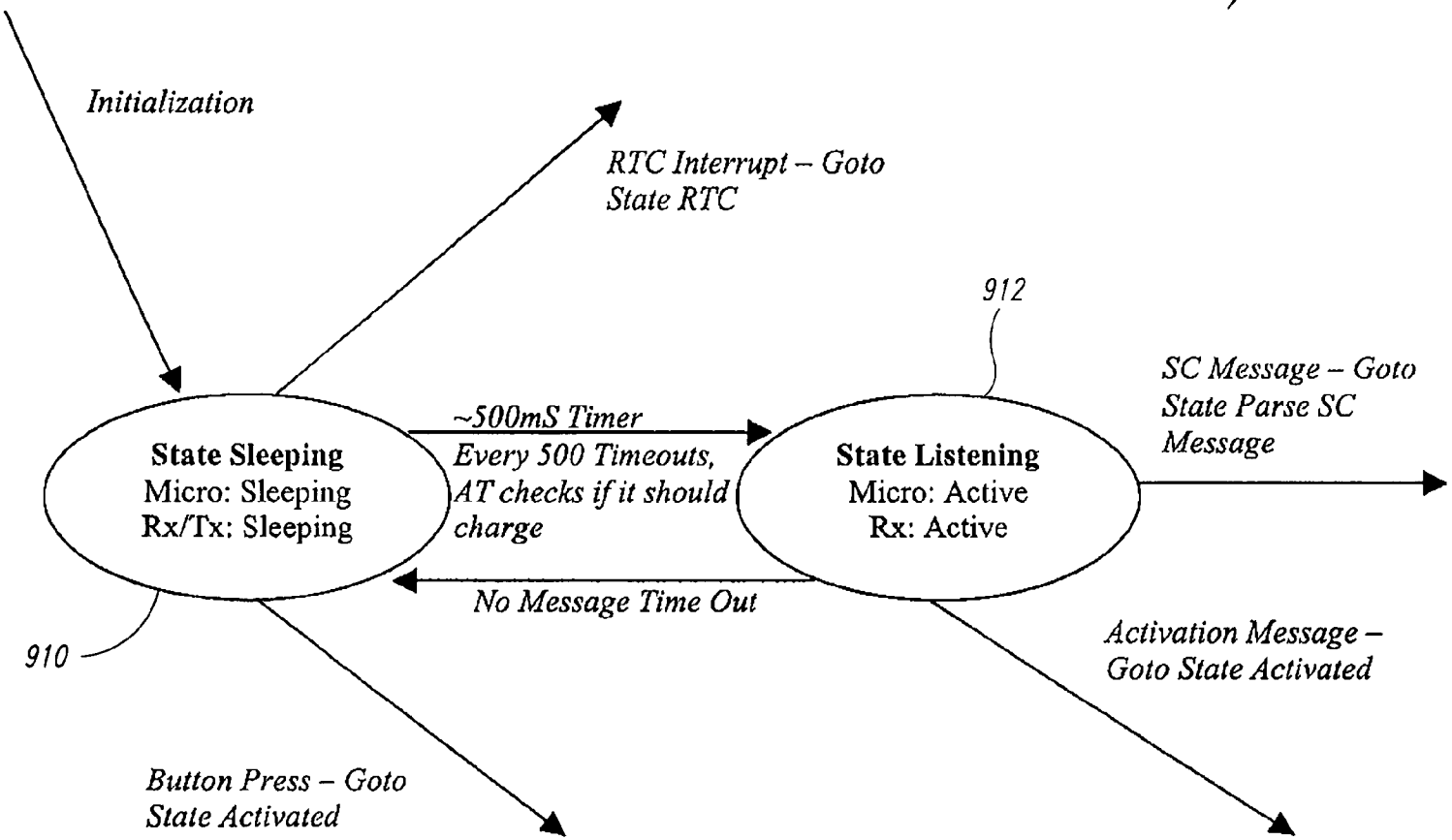
FIG. 33 is a schematic diagram of a state machine implementing a polling state of the state machine of FIG. 32, according to one illustrated embodiment.

FIG. 33 shows a state machine implementing the polling state 902 (FIG. 32), according to one illustrated embodiment. The states include a sleeping state 910 and a listening state 912, with acceptable transitions between the states defined by the arrows.

Figure 34:
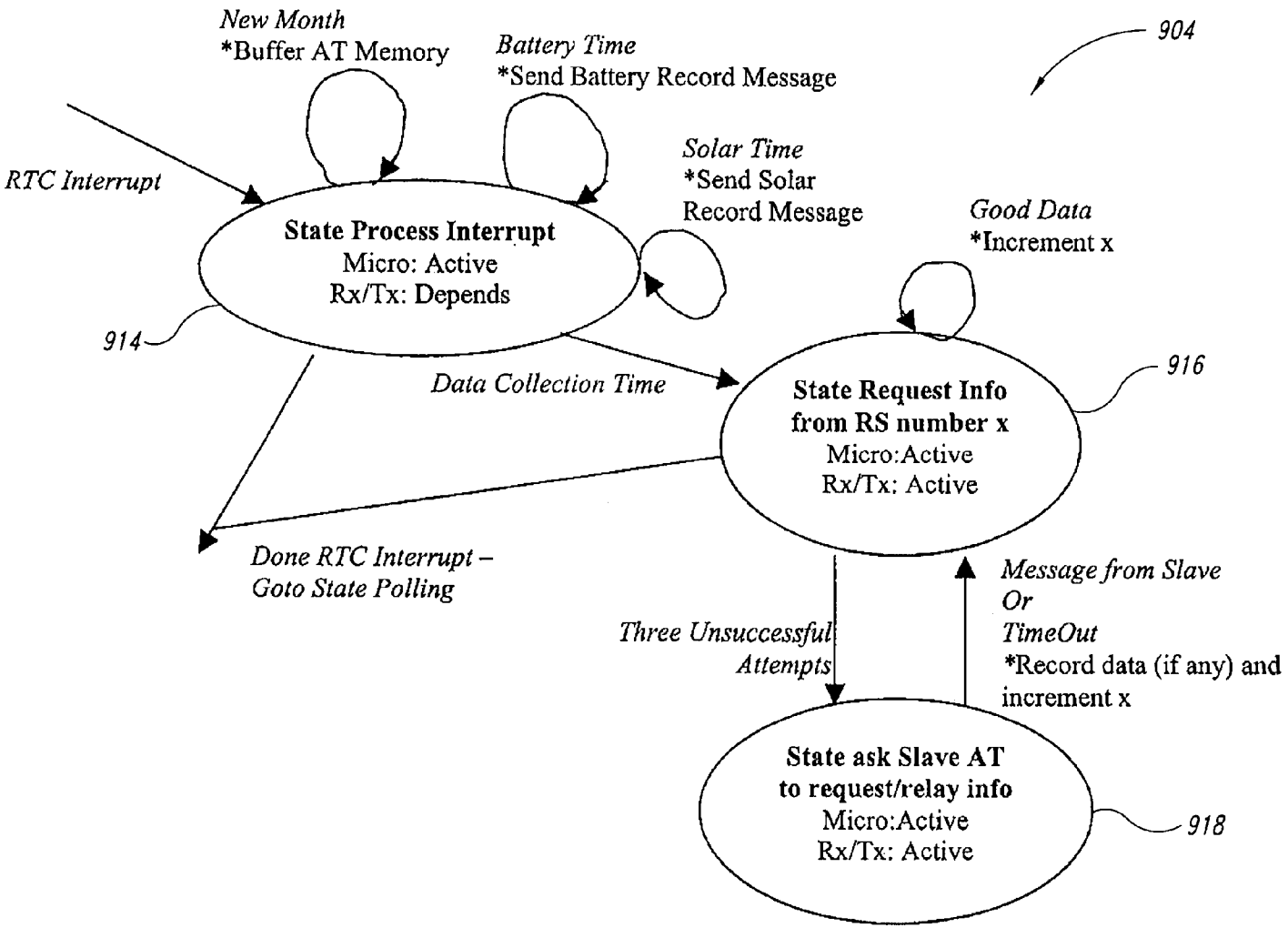
FIG. 34 is a schematic diagram of a state machine implementing an RTC interrupt state of the state machine of FIG. 32, according to one illustrated embodiment.

FIG. 34 shows a state machine implementing the RTC interrupt state 904 (FIG. 32), according to one illustrated embodiment. The states include a process interrupt state 914, a Request information from RS (i.e., traffic visual information device) number x state 916, and an ask slave AT (i.e., activation device 26) to request/relay information state 918, with acceptable transitions between the states defined by the arrows.

Figure 35:
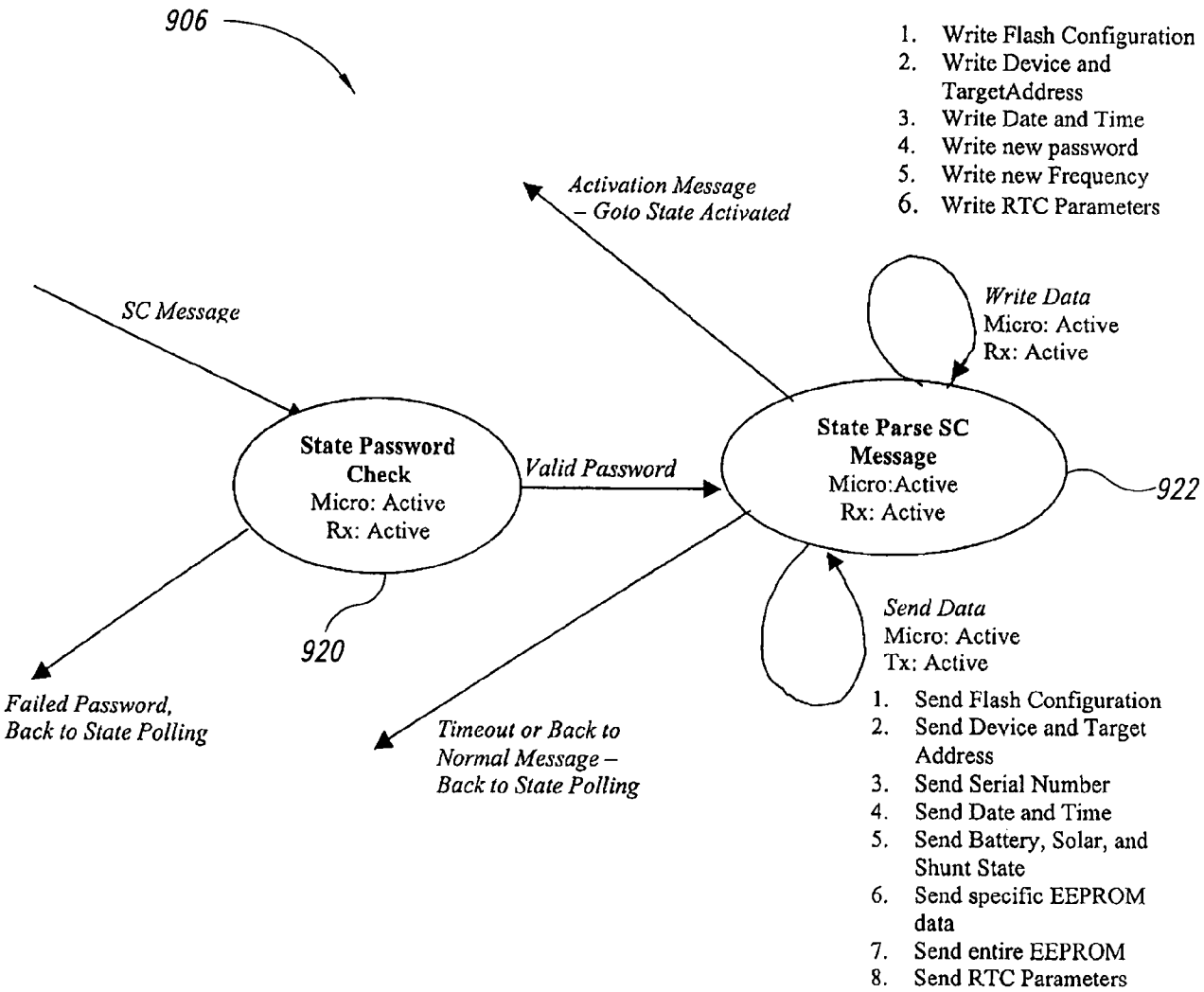
FIG. 35 is a schematic diagram of a state machine implementing a parsing state of the state machine of FIG. 32, according to one illustrated embodiment.

FIG. 35 is a schematic diagram of a state machine implementing the parse configurator message state 906 of the state machine of FIG. 32, according to one illustrated embodiment. The states include a password check state 920 and a parse SC (e.g., a small PC adapter that manages the configuration software) message state 922, with acceptable transitions between the states defined by the arrows.

Figure 36:
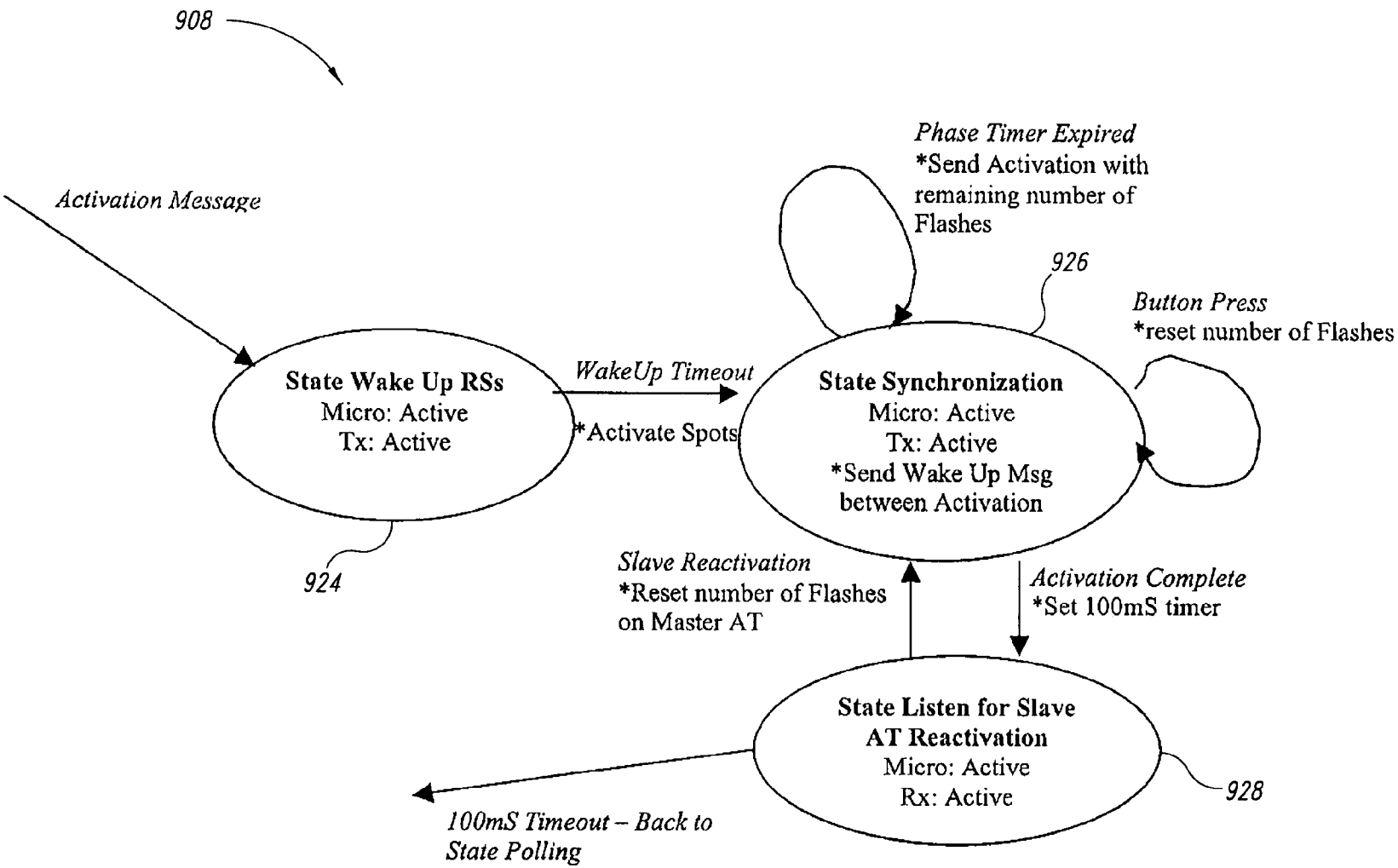
FIG. 36 is a schematic diagram of a state machine implementing an activated state of the state machine of FIG. 32, according to one illustrated embodiment.

FIG. 36 shows a state machine implementing the activated state 908 (FIG. 32), according to one illustrated embodiment. The states include a wake up RSs state 924, a synchronization state 926, and a listen for slave activation device reactivation state 928, with acceptable transitions between the states defined by the arrows.

Figure 37:
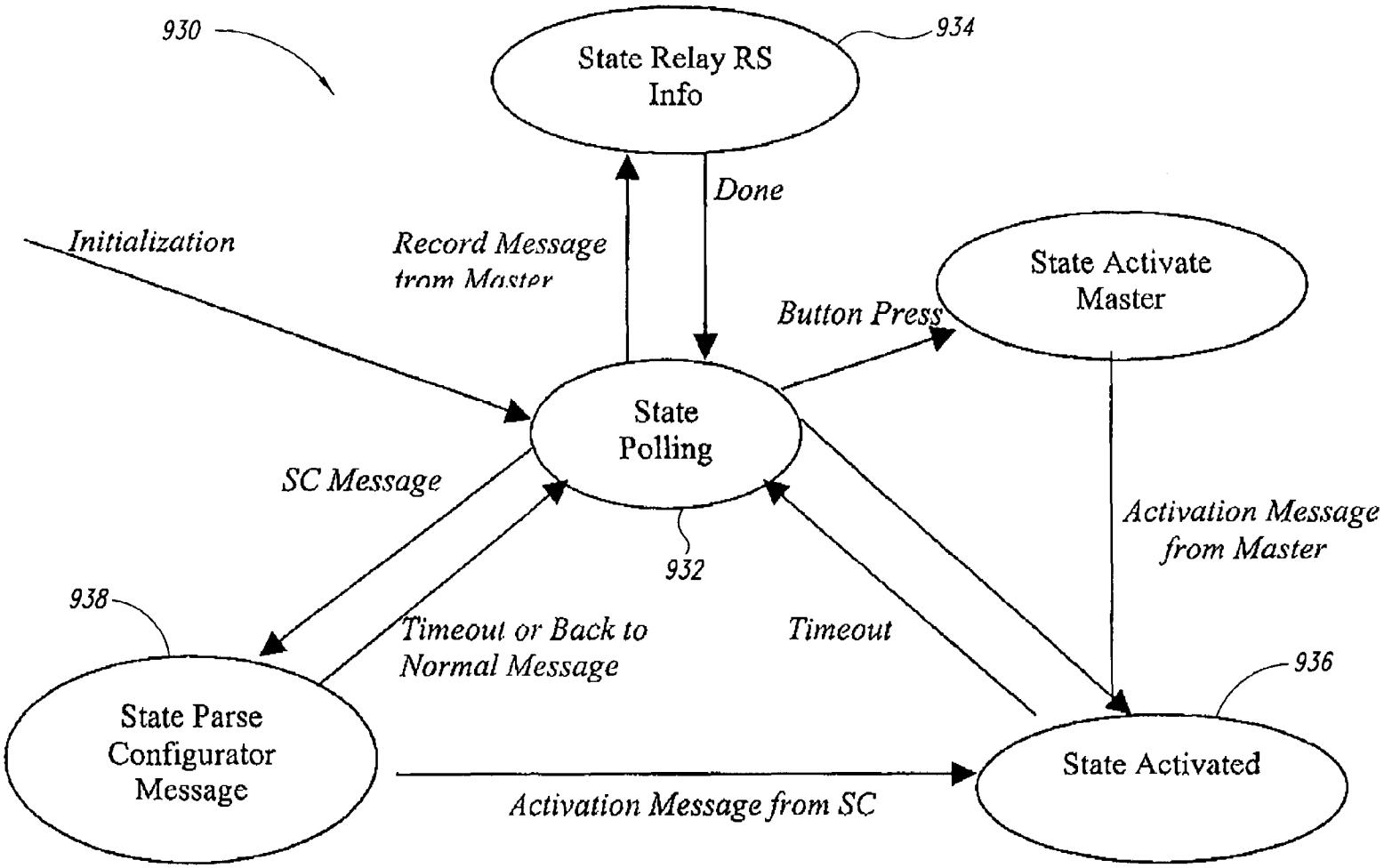
FIG. 37 is a schematic diagram of an overall state machine implementing the functionality of a slave activation device of a traffic information system, according to one illustrated embodiment.

FIG. 37 shows an overall state machine 930 implementing the functionality of a slave activation device 26 of a traffic information system 22, according to one illustrated embodiment. The states include a polling state 932, a relay RS information state 934, an activated state 936, and a parse configurator message state 938, with acceptable transitions between the states defined by the arrows.

Figure 38:
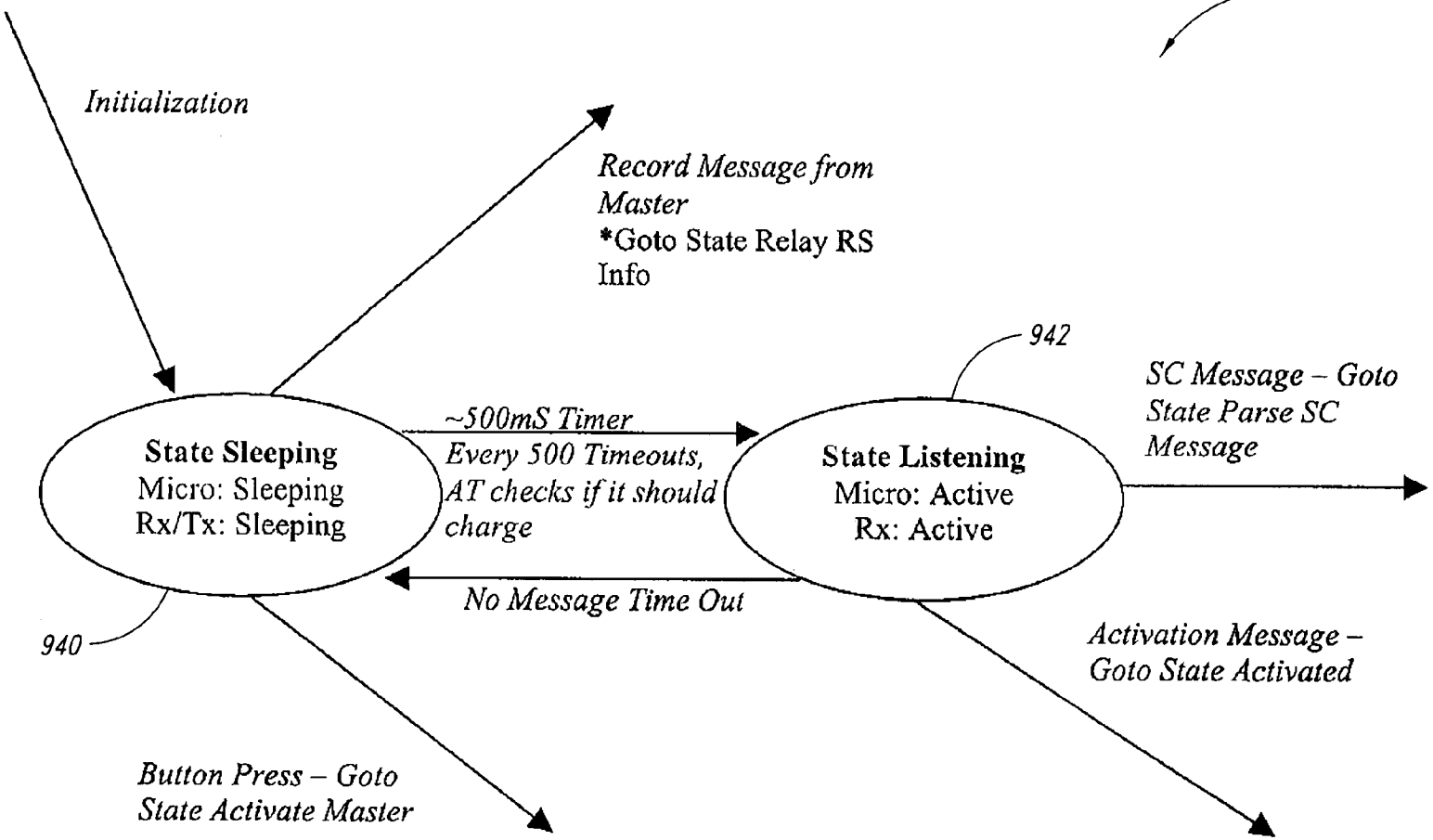
FIG. 38 is a schematic diagram of a state machine implementing a polling state of the state machine of FIG. 37, according to one illustrated embodiment.

FIG. 38 shows a state machine implementing the polling state 932 (FIG. 37), according to one illustrated embodiment. The states include a sleeping state 940 and a listening state 942, with acceptable transitions between the states defined by the arrows.

Figure 39:
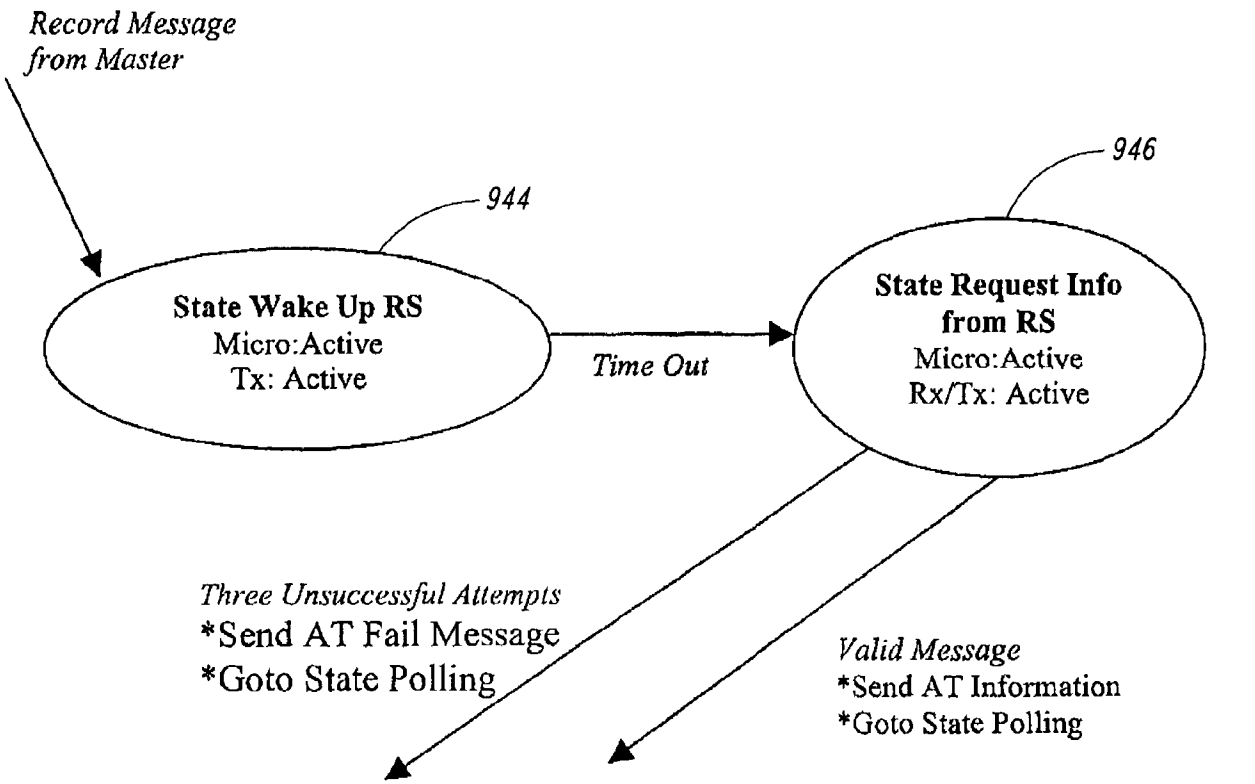
FIG. 39 is a schematic diagram of a state machine implementing a relay traffic visual indicator device information state of the state machine of FIG. 37, according to one illustrated embodiment.

FIG. 39 shows a state machine implementing the relay RS (i.e., traffic visual information device 24) information state 934 (FIG. 37), according to one illustrated embodiment. The states include a wake up RS state 944 and a request information from RS state 946, with acceptable transitions between the states defined by the arrows.

Figure 40:
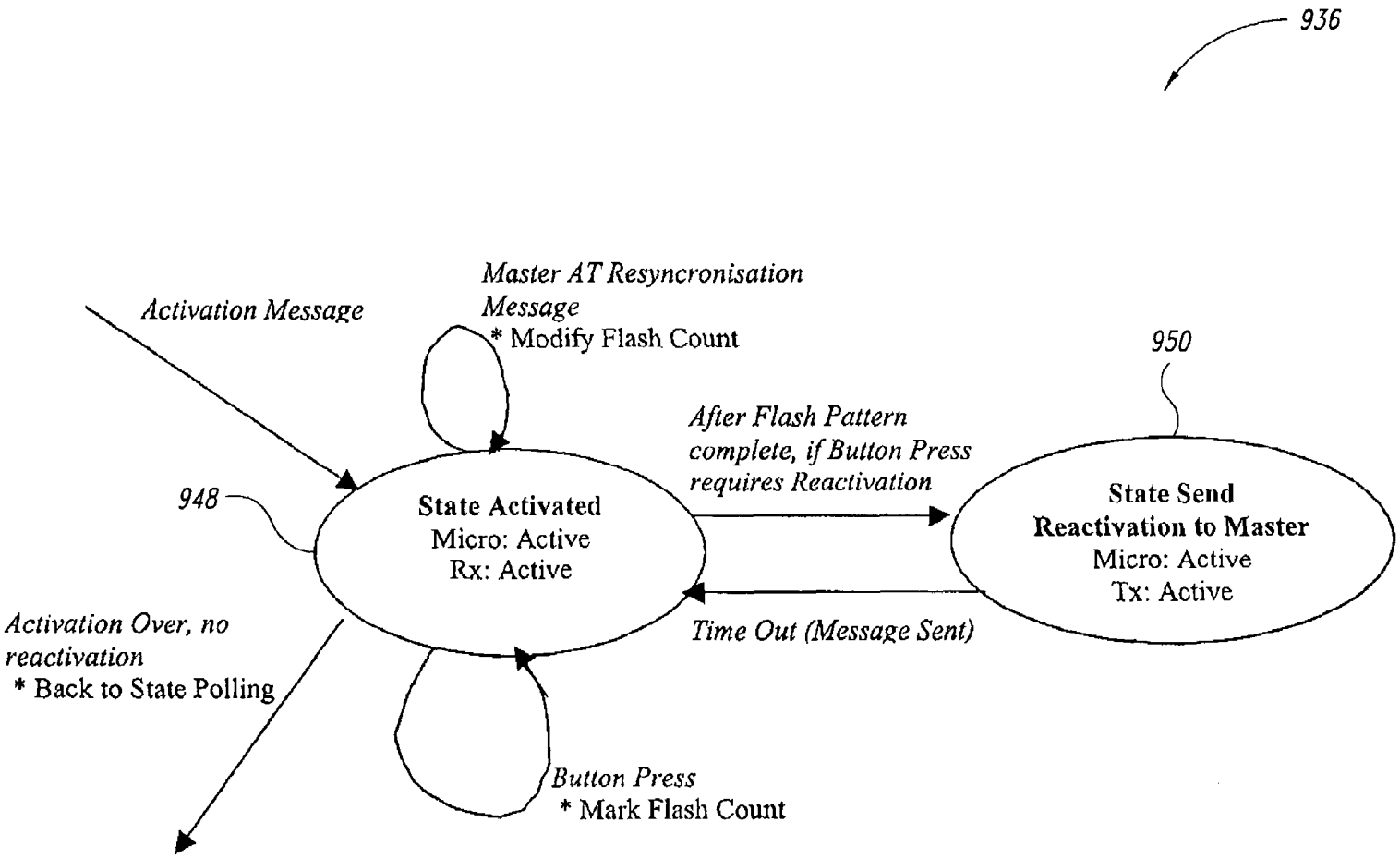
FIG. 40 is a schematic diagram of a state machine implementing an activated state of the state machine of FIG. 37, according to one illustrated embodiment.

FIG. 40 shows a state machine implementing the activated state 936 (FIG. 37), according to one illustrated embodiment. The states include an activated state 948 and a send reactivation to master state 950, with acceptable transitions between the states defined by the arrows.

Figure 41:
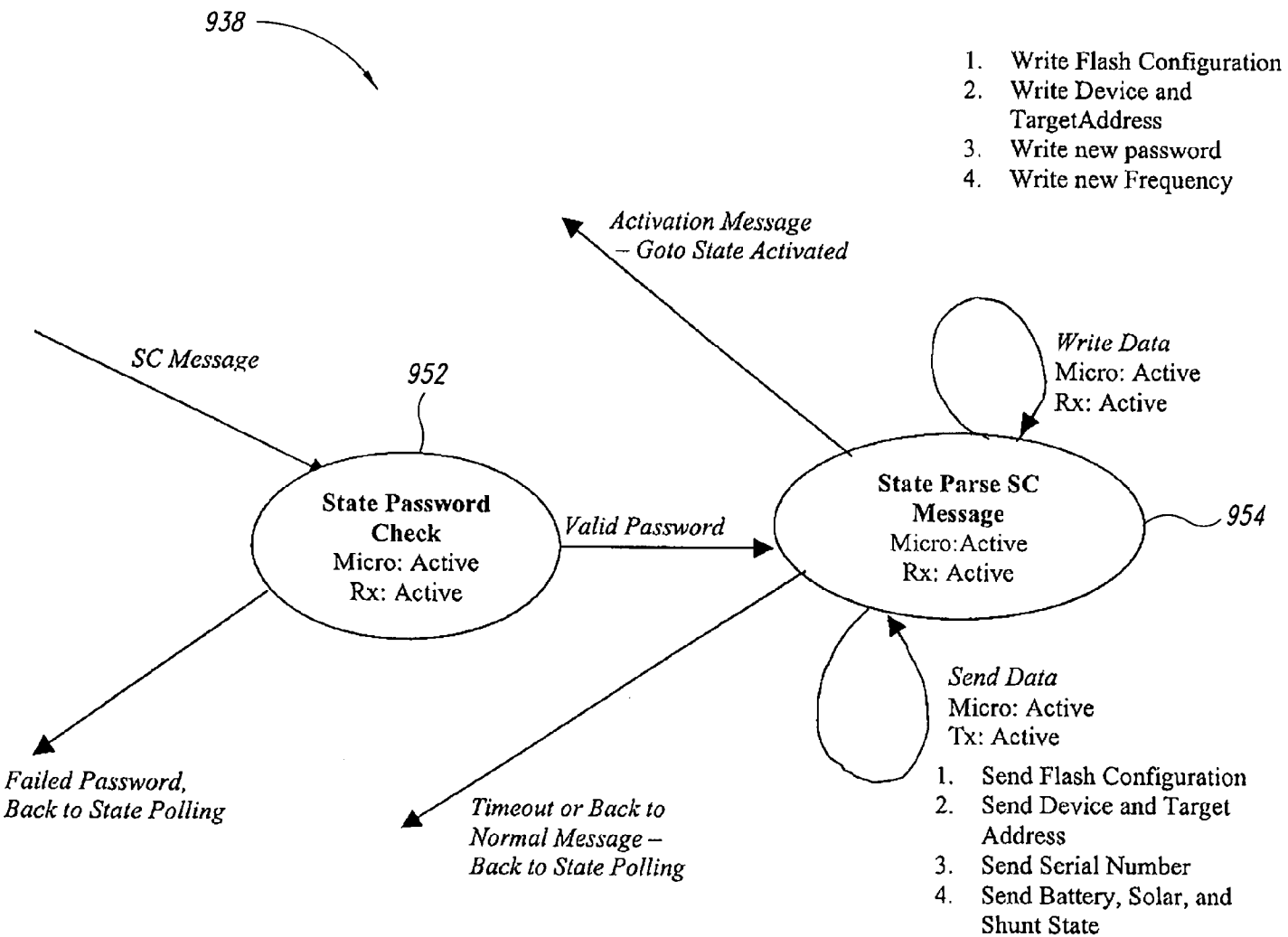
FIG. 41 is a schematic diagram of a state machine implementing a parsing state of the state machine of FIG. 37, according to one illustrated embodiment.

FIG. 41 shows a state machine implementing the parse configurator message state 938 (FIG. 37), according to one illustrated embodiment. The states include a password check state 952 and a parse SC message state 954, with acceptable transitions between the states defined by the arrows.

The present disclosure discusses a wide variety of methods and devices for controlling and monitoring limited power while performing one or more forms of communication. These includes: 1) one-way energy valve diode; 2) directional current sensor; 3) frequency shift keying; 4) threshold controls; 5) energy valve diode; 6) communication modulation; 7) switching system; 8) packet minimization; 9) individual addressing of each traffic visual indicator device 24; 10) channel differentiation; 11) staggered output signaling; 12) sensory filter; 13) sensor management; 14) frequency hopping; 15) sensor control; 16) slave and master; and 17) visual implementation demonstration.

It includes a wide-variety of physical forms and alternative embodiments that rely on the present invention's ability to perform multiple calculations, sensory responses and actions, and data capture and dynamic transmission within a tight window of technical feasibility.

These alternative embodiments are also novel and unique, in both form and function and include:

(1) Advanced Warnings—Activated by such means as inroad (loop) detectors or radar, inroad lights can warn motorists of impending stops and stoplights, dangerous turns and other road hazards, railroad crossings, or intersections.

(2) Unsignalized Crosswalk Lighting—With the push of a button or other activation mechanism, pedestrians can activate inroad lights to alert motorists to their presence in the crosswalk.

(3) Feature Locators—Activated by the approach of a fire truck or other vehicle, inroad lights identify such things as fire hydrants, minimizing the time to locate them and potentially saving millions of dollars of potential devastation. They may also be used to identify road turnouts, roundabout, traffic circles, and apron markings for things like buses and taxis.

(4) Shared Lane—By placing on roadways with high directional commuter traffic, lanes may be switched from one direction to another by time of day or other dynamic circumstances. Additionally, lanes may be changed for an emergency or for environmental circumstances such as the start/release of a sporting event or concert.

The above description of illustrated embodiments, including what is described in the Abstract, is not intended to be exhaustive or to limit the invention to the precise forms disclosed. Although specific embodiments of and examples are described herein for illustrative purposes, various equivalent modifications can be made without departing from the spirit and scope, as will be recognized by those skilled in the relevant art. The teachings provided herein can be applied to other signaling device, not necessarily the exemplary traffic visual indicator devices 24 and traffic information system 22 generally described above.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that the mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to U.S. provisional patent application Ser. No. 60/544,138, filed Feb. 13, 2004, and entitled Self-powered In-Surface Communications Device, are incorporated herein by reference, in their entirety. Aspects of the invention can be modified, if necessary, to employ systems, circuits and concepts of the various patents, applications and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all methods, systems and devices that operated in accordance with the claims. Accordingly, the invention is not limited by the disclosure, but instead its scope is to be determined entirely by the following claims.

The invention claimed is:

1. A road mounted indicator comprising:

a housing comprising a base and at least one face extending generally upward from the base, wherein said housing is removably mountable in the path of oncoming vehicles such that the vehicles may pass over the indicator and one end of the face is adjacent to and extends generally upward from the surface of a roadway carrying the vehicles; the housing being constructed such that it can withstand the weight of the vehicles that may come in contact with the housing when the housing is mounted in the oath of oncoming vehicles;

a non-photovoltaic power producing source housed in the housing and operable to produce electrical power from a source remotely located from the housing;

an illumination device housed in the housing and positioned to transmit light through the face of the housing in the direction of the oncoming vehicles when the housing is mounted in the path of the oncoming vehicles;

a circuit housed in the housing, electrically coupled to the power producing source and the first illumination source, the circuit operable to selectively cause the illumination device to generate light; and a wireless communications subsystem housed in the housing and operable to receive wireless communications at least from an external source remote from the housing.

2. The road mounted indicator of claim 1 wherein the non-photovoltaic power producing source comprises at least one radio frequency transducer operable to convert electromagnetic signals to an electrical current.

3. The road mounted indicator of claim 1 wherein the non-photovoltaic power producing source comprises at least one pressure transducer operable to convert pressure into an electrical current.

4. The road mounted indicator of claim 1 wherein the circuit comprises power conversion circuitry including at least one switch and at least one of a capacitor or an inductor, the power conversion circuitry operable to change a voltage of power produced by the power producing source.

5. The road mounted indicator of claim 1, further comprising:

at least a rechargeable power storage device housed in the housing and electrically coupled to selectively receive power produced by the power producing source and provide power to the illumination device.

6. The road mounted indicator of claim 5, further comprising:

at least one non-rechargeable power storage device housed in the housing and electrically coupled to selectively provide power to the illumination device.

7. The road mounted indicator of claim 5 wherein the circuit comprises at least one unidirectional current flow device electrically coupled between the power producing source and the rechargeable power storage device to allow power produced by the power producing source to flow to the power storage device, and to preclude power flow from the power storage device to the power producing source.

8. The road mounted indicator of claim 1 wherein the illumination device comprises at least a first filter transmissive of light of a first color and at least a second filter transmissive of light of a second color.

9. The road mounted indicator of claim 1 wherein the illumination device is operable to produce at least a first number of colors of light from a second number of light sources, where the first number is greater than the second number.

10. The road mounted indicator of claim 1 wherein the wireless communications subsystem comprises an optical receiver.

11. The road mounted indicator of claim 1 wherein the wireless communications subsystem employs a unique identifier stored in the housing, whereby the indicator may be individually addressed in wireless communications.

12. The road mounted indicator of claim 1, further comprising:

at least one of a camera;

a video camera; or a precipitation sensor.

13. The road mounted indicator of claim 1 further comprising an anchor assembly; the anchor assembly including an anchor; wherein the housing is attached to the anchor; the anchor constructed so as to be capable of being partially embedded in the roadway of the oncoming traffic to secure the road mounted indicator in the path of the oncoming vehicles.

14. The road mounted indicator of claim 13 wherein the anchor comprises a stem.

15. The road mounted indicator of claim 13 wherein the anchor assembly further comprises an anchoring mechanism comprising a base plate attached to a cylinder; the base plate comprising an aperture aligned with the centerline of the cylinder; the cylinder configured to receive and securely retain the anchor.

16. The road mounted indicator of claim 1 wherein the housing is constructed to withstand a vehicle weight of 15 metric tons.

17. A method of providing information to vehicles moving along a road in at least a first direction, the method comprising:

producing power from a non-photovoltaic power producing source at each of a number of road mounted indicator devices mounted in the path of oncoming vehicles; wherein each of the road mounted indicator devices is partially embedded in the roadway such that the vehicles travel over the road mounted indicator devices;

wirelessly receiving information by at least a first one of the road mounted indicator devices, the wirelessly received information from an external device remotely located with respect to at least the first one of the number of road mounted indicator devices; and transmitting light from at least one of the number of road mounted indicator devices toward the oncoming vehicles, in a direction generally opposed to the first direction based at least in part on the wirelessly received information.

18. The method of claim 17 wherein producing power from a non-photovoltaic power producing source at each of a number of road mounted indicator devices comprises converting radio frequency transmissions into an electrical current.

19. The method of claim 17 wherein producing power from a non-photovoltaic power producing source at each of a number of road mounted indicator devices comprises converting pressure generated when a vehicle tire presses on the road mounted indicator device into an electric current.

20. The method of claim 17 wherein wirelessly receiving information by at least a first one of the road mounted indicator devices comprises receiving an optical signal transmitted by the external device at an optical sensor of at least the first one of the road mounted indicator devices.

21. The method of claim 17, further comprising:

changing a voltage of the power produced from the power producing source of the road mounted indicator device; and selectively supplying the power with the changed voltage to an integral illumination device of each of the number of road mounted indicator devices, respectively.

22. The method of claim 17, further comprising:

storing the produced power in a rechargeable power storage device of at least one of the number of road mounted indicator devices; and selectively supplying the stored power to an integral illumination device of the at least one of the number of road mounted indicator devices from the rechargeable power storage device.

23. The method of providing information to vehicles of claim 17 wherein the road mounted indicator devices are removably mounted in the roadway to define at least a part of a pedestrian crosswalk across the roadway carrying the vehicles.

24. A traffic informational system for providing information to traffic moving along a road in at least a first direction, the traffic informational system comprising:

a plurality of road mounted visual information devices mountable in the path of oncoming traffic such that the oncoming traffic can pass over the visual information devices without harm to the traffic or the visual information device, each of the visual information devices comprising:

a housing comprising a base;

a non-photovoltaic power producing source carried by the housing, the power producing source operable to produce power;

a first illumination source carried by the housing, the first illumination source operable to transmit light out of the housing generally toward oncoming traffic when the visual information device is mounted in the path of oncoming traffic such that the oncoming traffic gasses over the visual information device;

a circuit carried by the housing, the circuit operable to selectively cause the illumination source to generate light; and a wireless communications subsystem carried by the housing and operable to receive wireless communications.

25. The traffic informational system of claim 24, further comprising:

a plurality of external control devices, each of the external control devices comprising a transmitter and an antenna, where at least one of the external control devices further comprises a receiver, and at least the one of the external control devices acts as a repeater to relay wireless communications received from at least another one of the external control devices to at least one of the plurality of road mounted visual information devices.

26. The traffic informational system of claim 24, further comprising:

a plurality of external control devices, each of the external control devices comprising a transmitter, a receiver and an antenna, and at least some of the external control devices act as repeaters to relay wireless communications received from one to another of the external control devices.

27. The traffic informational system of claim 24 wherein the wireless communications subsystem of at least one of the road mounted visual information devices comprises a receiver and a transmitter, and at least the one of the road mounted visual information devices acts as a repeater to relay received wireless communications to at least another one of the visual information devices.

28. The traffic informational system of claim 24 wherein the wireless communications subsystem of at least a plurality of the road mounted visual information devices comprises a receiver and a transmitter, and the road mounted visual information devices act as repeaters to relay received wireless communications from one to another of the road mounted visual information devices.

29. The traffic informational system of claim 24 wherein the road mounted visual information devices are removably mounted in the roadway to define at least a part of a pedestrian crosswalk across the roadway carrying the traffic.

* * * * *

UNITED STATES PATENT AND TRADEMARK OFFICE

CERTIFICATE OF CORRECTION

PATENT NO. : 7,688,222 B2
APPLICATION NO. : 11/055558
DATED : March 30, 2010
INVENTOR(S) : Peddie et al.

It is certified that error appears in the above-identified patent and that said Letters Patent is hereby corrected as shown below:

In column 34, line 36 Claim 1, delete "oath" and insert -- path --, therefor.

In column 36, line 61 Claim 24, delete "gasses" and insert -- passes --, therefor.

Signed and Sealed this

Twenty-fifth Day of May, 2010

David J. Kappos

David J. Kappos
*Director of the United States Patent and Trademark Office*